US011933108B2

(12) United States Patent
Radford et al.

(10) Patent No.: US 11,933,108 B2
(45) Date of Patent: Mar. 19, 2024

(54) SELECTABLE HOLE TRIMMER AND METHODS THEREOF

(71) Applicant: Black Diamond Oilfield Rentals LLC, Houston, TX (US)

(72) Inventors: Steven R. Radford, Houston, TX (US); Brian D. Hill, Houston, TX (US); Carl E. Poteet, III, Houston, TX (US)

(73) Assignee: Black Diamond Oilfield Rentals LLC, Houston, TX (US)

( * ) Notice: Subject to any disclaimer, the term of this patent is extended or adjusted under 35 U.S.C. 154(b) by 0 days.

(21) Appl. No.: 17/365,128

(22) Filed: Jul. 1, 2021

(65) Prior Publication Data

US 2021/0363832 A1 Nov. 25, 2021

Related U.S. Application Data

(63) Continuation-in-part of application No. 17/089,616, filed on Nov. 4, 2020, now Pat. No. 11,512,558.

(60) Provisional application No. 63/047,451, filed on Jul. 2, 2020, provisional application No. 63/008,364, filed on Apr. 10, 2020, provisional application No. 62/931,629, filed on Nov. 6, 2019.

(51) Int. Cl.

| | |
|---|---|
| ***E21B 34/14*** | (2006.01) |
| ***E21B 10/61*** | (2006.01) |
| ***E21B 21/10*** | (2006.01) |
| ***E21B 34/08*** | (2006.01) |
| *E21B 47/06* | (2012.01) |

(52) U.S. Cl.
CPC ..... *E21B 10/61* (2013.01); *E21B 21/103* (2013.01); *E21B 34/08* (2013.01); *E21B 34/142* (2020.05); *E21B 47/06* (2013.01); *E21B 2200/06* (2020.05)

(58) Field of Classification Search
CPC .... E21B 10/61; E21B 21/103; E21B 2200/06; E21B 34/14; E21B 34/08
See application file for complete search history.

(56) References Cited

U.S. PATENT DOCUMENTS 6,263,969 B1 7/2001 Stoesz et al.
6,782,952 B2 8/2004 Garay et al.
(Continued)

OTHER PUBLICATIONS

Foreign Search Report on PCT PCT/US2020/059416 dated Feb. 4, 2021.

(Continued)

*Primary Examiner* — Caroline N Butcher
(74) *Attorney, Agent, or Firm* — Foley & Lardner LLP

(57) ABSTRACT

A downhole device is configured as a selectable hole trimmer. The selectable hole trimmer comprises an upper sleeve affixed inside a body via a stop. A charge sleeve is slidable inside the upper sleeve to provide a pressure to a pressurized volume. A catch sleeve is slidable inside the charge sleeve to align a bypass port and a return port with a drilling mud volume. An actuator is fluidly connected to the pressurized volume via a port. The actuator is configured to provide a pressure to a selectable hole cutter of the body via an actuation port in the transfer sleeve and actuate the selectable hole cutter piston of the selectable hole cutter to move relative to the body, wherein the cutter piston comprises one or more cutters. A manual controller configured to operate the actuator in response to a dropped activation ball.

21 Claims, 49 Drawing Sheets

FIG. 6

(56) References Cited

U.S. PATENT DOCUMENTS

| | | | | |
|---|---|---|---|---|
| 2005/0178560 | A1 | 8/2005 | Johansen et al. | |
| 2008/0105465 | A1* | 5/2008 | Radford | E21B 47/18 175/57 |
| 2008/0277119 | A1 | 11/2008 | Hill et al. | |
| 2015/0053484 | A1* | 2/2015 | Meister | E21B 44/005 175/26 |
| 2015/0345240 | A1 | 12/2015 | Roders et al. | |
| 2016/0290066 | A1* | 10/2016 | Frith | E21B 47/24 |
| 2017/0058644 | A1 | 3/2017 | Andreychuk et al. | |
| 2018/0045003 | A1* | 2/2018 | Evans | E21B 4/02 |
| 2018/0258721 | A1 | 9/2018 | Pawar et al. | |
| 2018/0306000 | A1 | 10/2018 | Deboer | |
| 2019/0145178 | A1* | 5/2019 | Fuller | E21B 47/18 175/57 |

OTHER PUBLICATIONS

U.S. Office Action on U.S. Appl. No. 17/089,616 dated Feb. 14, 2022.

* cited by examiner

SELECTABLE HOLE TRIMMER AND METHODS THEREOF

PRIOR RELATED APPLICATIONS

This application is a continuation-in-part of U.S. Non-provisional patent application Ser. No. 17/089,616 entitled "DEVICE AND METHOD TO TRIGGER, SHIFT, AND/OR OPERATE A DOWNHOLE DEVICE OF A DRILLING STRING IN A WELLBORE," filed on Nov. 4, 2020, which claims the benefit of U.S. Provisional Patent Application No. 63/008,364 entitled "DEVICE AND METHOD TO TRIGGER, SHIFT, AND/OR OPERATE A DOWNHOLE DEVICE OF A DRILLING STRING INA WELLBORE," filed on Apr. 10, 2020, and U.S. Provisional Patent Application Ser. No. 62/931,629 entitled "DEVICE AND METHOD TO TRIGGER, SHIFT, AND/OR OPERATE A DOWNHOLE DEVICE OF A DRILLING STRING INA WELLBORE," filed on Nov. 6, 2019.

This application also claims benefit of U.S. Provisional Patent Application Ser. No. 63/047,451 entitled "SELECTABLE HOLE TRIMMER AND METHODS THEREOF," filed on Jul. 2, 2020.

FIELD

The present invention relates generally to a device for use in downhole drilling.

BACKGROUND

While performing drilling operations in an oil and gas well, a drill string rotates a drill bit at an end of the drill string and circulates fluids, such as drilling mud, through the drill string and the drill bit. The fluids may lubricate, cool, and clean the drill bit. The fluids may also control downhole pressure, stabilize the wall of the borehole, and remove drill bit cuttings from the bottom of the hole. Very often, the fluids are engineered with different chemical make-ups to suit specific well applications. Sometimes controlling certain physical or operation properties of the fluids, such as the flow rate through the drill bit, may be as important as controlling the chemical make-ups.

Sometimes operations of downhole tools may be controlled using various sensors and controllers in a closed control loop. For example, U.S. Pat. No. 9,879,518 discloses an intelligent reamer for drilling using rotation sensor, fluid operation sensor, and a control scheme based on the measured rotational rate of the drill string (e.g., an rpm protocol).

Conventionally, a specialized downhole tool (i.e., DSI PBL® sub) may be used to bypass fluids from the drill bit. Such specialized downhole tool may achieve the bypass function by dropping a metal or polymer, hard or malleable ball into the drill string from the derrick floor. The ball then travels downhole and eventually seats into the bypass sub, sealing against the passage downhole. After sealing, the drilling fluids are forced toward lateral vent holes, thus bypassing the drill bit. To terminate this bypass, additional small balls are pumped down the drill string. The smaller balls will block the lateral vent holes. As the lateral vent holes are closed, the malleable metal or polymer ball are deformed and pushed through its seat and into a collector below, thus restoring the flow path to the drill bit.

Such downhole tool (i.e., DSI PBL® sub) often takes a long time for the various balls (either to cause the bypass or to restore the flow) to travel through the drill string and be seated on the seal. In some instances, pumping at 600 gpm down a 10,000 ft drill pipe of 5½-inch diameter would take approximately 12-15 minutes. Such downhole tool (i.e., DSI PBL® sub) also has a limited number of bypass/restore cycles before tool replacement. In some instances, because the collector becomes fully filled, only five sets of malleable metal or polymer ball may be inserted to cause bypasses before the whole downhole tool (i.e., DSI PBL® sub) must be replaced before further bypass operations. Furthermore, dropping the balls into the drill string to be pumped down to the bypass sub is typically a manual operation.

Another specialized tool (i.e., a fixed blade reamer) may be used to slightly enlarge a hole. The fixed blade reamer has a larger diameter than the rest of the drill string. Due to this larger diameter, the fixed blade reamer creates a high drag when sliding and not rotating in directional drilling. This high drag is problematic to the directional drilling process.

Accordingly, a downhole device (e.g., a selectable hole trimmer) is needed that does not create a high drag when sliding and not rotating in directional drilling.

SUMMARY

This disclosure presents a downhole device and method to trigger, shift, and/or operate a downhole device (e.g., a selectable hole trimmer) of a drilling string in a wellbore. At a high level, the disclosed device causes cutters to extend and causes a portion of drilling fluids to bypass the drill bit and into the annulus. The tool operation may be triggered upon certain conditions related to the rotation speeds of the drill string or other conditions such as the pressure of the drilling fluids. For example, the drill string may be rotated in some protocol of operation (e.g., rotate at certain rpm for a certain time period, and/or stop at certain other rpm for a certain time period or stop rotating for a predetermined time period, and so forth) to describe a recognizable series of signals to an accelerometer and/or microprocessor that will communicate to pumps or valves to operate or pause/stop operations. In other instances, the bypass may be triggered in response to changes in the drill string weight, which may be varied in a recognizable fashion such that a load cell may send signals to a microprocessor and open or close valves or pump. The internal drill string pressure variations may be distinctive and recognizable by a pressure transducer in the downhole device. Such variations may then trigger a microprocessor to send further signals to start/stop a pump or open/close a bypass valve or port in the disclosed device.

The disclosed device and method of bypassing drilling fluids from the drill bit may be used in various situations. For example, the use of rotation rate (e.g., revolutions per minute, or rpm) recognition or other methods may be used to start a pump or open/close valves and flow paths for the drilling mud to bypass some or all of the drilling mud from the drill string to the annulus. The bypass fluids may also be used to power other devices or provide a source of data for measurements. Also one of the primary purposes for the bypass flow through the nozzles is that it can provide mud flow to cool and clean the cutters on the pistons and to prevent a pressure lock if the tool fails and the sleeve seals the pistons in the out position.

The disclosed device employs sensors and controllers to make use of the rpm protocol to produce signals that may also be used to extend/retract certain pistons in the downhole device wall to cut a small amount of wall material. For example, after a certain protocol to wake up the downhole device that whenever certain rpm is recognized, reamer pistons may extend a short amount in response to the recognized condition. Continuing to rotate the downhole device will cause the hole to open a small amount more than the bit is cutting so that ultimately when the bottom hole assembly (BHA) is tripped out of the hole and the casing is later tripped into the hole, the components may pass more easily with less interference. Additionally, during directional drilling, particularly rotate and slide procedures, the hole may tend to have a wavy profile as it is drilled, called porpoising. The hole literally may move feet up and down in a wave shape. This also will be reduced or eliminated by utilizing this tool invention.

Such hole opening processes utilizing the monitored rpm and controller signals may be automatic and thus unnoticed by the driller. As a result of the reamer piston's operation, the reamer may smooth out the tight spots caused by the bent motor or other drilling equipment in directional drilling. The rpm or other signal from the driller to the disclosed device may also open an expandable reamer. For example, the disclosed tool may shift a sleeve connected by linkages to reamer blocks, causing the blocks to slide axially up and radially out at a prescribed small angle, thus opening a reamer. Polycrystalline diamond compacts (PDC) and/or other cutting elements of extreme hardness, wear resistance and thermal conductivity will ream and radially enlarge the hole, for example, more or less by 20%.

In a first general aspect, the disclosed downhole device for having bypassing drill fluids bypass a drill bit is disclosed. The device includes a sleeve, sealingly slidable inside a body, the sleeve having a port alignable with a nozzle of the body. The device further includes means for resiliently biasing the sleeve against the body and an actuator configured to provide a pressure to the sleeve and actuate the sleeve to move relative to the body. The device also includes a controller configured to operate the actuator in response to a change of a monitored operation condition.

In one specific aspect, the resilient member includes a spring providing a biasing force corresponding to a threshold trigger pressure.

In another specific aspect, the sleeve may be configured to direct drill fluids to a downhole drill bit when the port is not aligned with the nozzle of the body and is configured to direct a portion of the drill fluids to the downhole drill bit when the port becomes at least partially aligned with the nozzle of the body such that another portion of the drill fluids bypasses the drill bit.

In yet another specific aspect, the downhole device further includes a lock ring setting a movement limit to the sleeve. The lock ring may also provide a point of support for the resilient member.

In one specific aspect, the body may include an internal tube housing the sleeve and at least one radial compartment housing at least one of an oil accumulator, a motor pump, a battery, the actuator, or the controller.

In another specific aspect, the actuator includes a three-way control valve.

In yet another specific aspect, the actuator may include an accumulator or a pressure compensator.

In one specific aspect, the controller may be configured to operate the actuator in response to an internal drill string pressure variation measured in a pressure transducer, in some embodiments, the internal drill string pressure variation satisfies a trigger condition.

In a second general aspect, a method for bypassing drilling fluids from a downhole drill bit is disclosed. The method includes: providing a drill bit a flow of drilling fluids; determining whether a trigger condition has been satisfied; upon determining the trigger condition has been satisfied, actuating a sleeve to move relative to a body, sealingly housing the sleeve, and at least partially aligning a port in the sleeve to a nozzle of the body; and directing a portion of the flow of drilling fluids through the port and the nozzle to bypass the drill bit.

In one specific aspect, determining the satisfaction of the trigger condition may include measuring a value related to a rotation speed of the downhole drill bit or a pressure of the drilling fluids and comparing the measured value to a reference value.

In another specific aspect, determining the satisfaction of the trigger condition may include receiving a control signal from a controller, in some embodiments, the control signal is provided in response to a rotation protocol. In other instances, the control signal may also be determined based on depth, user input, or other operation feedbacks.

In yet another specific aspect, determining the satisfaction of the trigger condition may include comparing a pressure of the drilling fluids inside the drill string and a pressure of the drilling fluids in the annulus outside the drill string to ascertain a pressure difference and in some embodiments, actuating the sleeve to move relative to the body includes actuating a three-way valve in response to the pressure difference between the drilling fluids inside the drill string and the drilling fluids in the annulus.

In one specific aspect, comparing the pressure of the drill fluids inside the drill string and the pressure of the drilling fluids in the annulus outside the drill string may include receiving the drilling fluids inside the drill string in an accumulator or pressure compensator and receiving the drilling fluids in the annulus in another accumulator or pressure compensator.

In another specific aspect, the method further includes biasing the sleeve against the body to close the port from the nozzle upon determining the trigger condition has not been satisfied.

In yet another specific aspect, biasing the sleeve against the body to close the port from the nozzle may include offsetting the port from the nozzle using a spring.

In one specific aspect, actuating the sleeve to move relative to the body may include sliding the sleeve inside the body, or rotating the sleeve inside the body, or both.

In an embodiment, a device for bypassing drill fluids around a drill bit comprises a sleeve sealingly slidable inside a body, the sleeve having a port alignable with a nozzle of the body and an activation port alignable with a selectable hole cutter of the body, a resilient member biasing the sleeve against the body, an actuator configured to provide a pressure to the sleeve and actuate the sleeve to move relative to the body, and a controller configured to operate the actuator in response to a change of a monitored operation condition.

In an embodiment, the resilient member comprises a spring providing a biasing force corresponding to a threshold trigger pressure.

In an embodiment, the sleeve is configured to direct drill fluids to the drill bit when the port is not aligned with the nozzle of the body and is configured to direct a portion of the drill fluids to the drill bit when the port becomes at least partially aligned with the nozzle of the body such that another portion of the drill fluids bypasses the drill bit. In an embodiment, the sleeve is configured to direct drill fluids to the drill bit when the port is not aligned with the nozzle of the body and the activation port is not aligned with the selectable hole cutter of the body, and wherein the sleeve is configured to direct a portion of the drill fluids to the drill bit when the port becomes at least partially aligned with the nozzle of the body and the activation port is at least partially aligned with the selectable hole cutter such that another portion of the drill fluids bypasses the drill bit and activates the selectable hole cutter.

In an embodiment, the device further comprises a lock ring setting a movement limit to the sleeve.

In an embodiment, the body comprises an internal tube housing the sleeve and at least one radial compartment housing at least one of an oil accumulator, a motor pump, a battery, the actuator, or the controller.

In an embodiment, the actuator includes a three-way control valve. In an embodiment, the actuator includes an accumulator, a pressure compensator, or both.

In an embodiment, the controller is configured to operate the actuator in response to an internal drill string pressure variation measured in a pressure transducer, wherein the internal drill string pressure variation satisfies a trigger condition.

In an embodiment, the body comprises helical carved structures distributed radially on an external surface of the body. In an embodiment, the helical carved structures are oriented in an axial direction of the body and are configured to facilitate flow of the drill fluids bypassed the drill bit.

In an embodiment, a method for controlling drilling fluids in a drill string to bypass a drill bit comprises providing the drill bit a flow of drilling fluids in the drill string, wherein the flow of drilling fluids returns in an annulus, determining whether a trigger condition has been satisfied, upon determining the trigger condition has been satisfied, actuating a sleeve to move relative to a body sealingly housing the sleeve, and at least partially aligning a port in the sleeve to a nozzle of the body and an activation port in the sleeve to a selectable hole cutter of the body, and directing a portion of the flow of drilling fluids through the port to the nozzle to bypass the drill bit and through the activation port to the selectable hole cutter to activate the selectable hole cutter.

In an embodiment, the determining the trigger condition being satisfied comprises measuring a value related to a rotation speed of the downhole drill bit or a pressure of the drilling fluids and comparing the measured value to a reference value. In an embodiment, the determining the satisfaction of the trigger condition comprises receiving a control signal from a controller, wherein the control signal is provided in response to a rotation protocol. In an embodiment, the determining the trigger condition being satisfied comprises comparing a pressure of the drilling fluids inside the drill string and a pressure of the drilling fluids in the annulus outside the drill string to ascertain a pressure difference and wherein actuating the sleeve to move relative to the body comprises actuating a three-way valve in response to the pressure difference between the drilling fluids inside the drill string and the drilling fluids in the annulus.

In an embodiment, the comparing the pressure of the drill fluids inside the drill string and the pressure of the drilling fluids in the annulus outside the drill string comprises receiving the drilling fluids inside the drill string in an accumulator or pressure compensator and receiving the drilling fluids in the annulus in another accumulator or pressure compensator.

In an embodiment, the method further comprises biasing the sleeve against the body to close the port from the nozzle and the activation port from the selectable hole cutter upon determining the trigger condition has not been satisfied. In an embodiment, the biasing the sleeve against the body to close the port from the nozzle and the activating port from the selectable hole cutter comprises offsetting the port from the nozzle and the activation port from the selectable hole cutter using a spring.

In an embodiment, the actuating the sleeve to move relative to the body comprises sliding the sleeve inside the body or rotating the sleeve inside the body or both.

In an embodiment, the method further comprises regulating the portion of the flow of drilling fluids bypassed the drill bit using helical carved structures to facilitate fluid flow in the annulus.

In an embodiment, the directing a portion of the flow of drilling fluids through the port and the nozzle to bypass the drill bit comprises actuating the sleeve to move relative to the body to align an opening in the sleeve to an outlet of the body, wherein actuating the sleeve includes providing a high pressure oil flow, using a motor driven pump, to move the sleeve. In an embodiment, the directing a portion of the flow of drilling fluids through the activation port to the selectable hole cutter to activate the selectable hole cutter comprises actuating the sleeve to move relative to a body to align an opening in the sleeve to an outlet of the body, wherein actuating the sleeve includes providing a high pressure oil flow, using a motor driven pump, to move the sleeve, and actuating the sleeve to move relative to the body to align the activation port to the selectable hole cutter.

In an embodiment, a device for bypassing drill fluids around a drill bit comprises a sleeve sealingly slidable inside a body, the sleeve having a port alignable with a nozzle and an activation port alignable with a selectable hole cutter of the body, a resilient member biasing the sleeve against the body, wherein the resilient member comprises a spring providing a biasing force corresponding to a threshold trigger pressure, an actuator configured to provide a pressure to the sleeve and actuate the sleeve to move relative to the body, and a controller configured to operate the actuator in response to a change of a monitored operation condition.

In an embodiment, the sleeve is configured to direct drill fluids to the drill bit when the port is not aligned with the nozzle of the body and is configured to direct a portion of the drill fluids to the drill bit when the port becomes at least partially aligned with the nozzle of the body such that another portion of the drill fluids bypasses the drill bit.

In an embodiment, the sleeve is configured to direct drill fluids to the drill bit when the port is not aligned with the nozzle of the body and the activation port is not aligned with the selectable hole cutter of the body, and wherein the sleeve is configured to direct a portion of the drill fluids to the drill bit when the port becomes at least partially aligned with the nozzle of the body and the activation port is at least partially aligned with the selectable hole cutter such that another portion of the drill fluids bypasses the drill bit and activates the selectable hole cutter.

In an embodiment, the device further comprises a lock ring setting a movement limit to the sleeve.

In an embodiment, the body comprises an internal tube housing the sleeve and at least one radial compartment housing at least one of an oil accumulator, a motor pump, a battery, the actuator, or the controller.

In an embodiment, the actuator includes a three-way control valve. In an embodiment, the actuator includes an accumulator, a pressure compensator, or both.

In an embodiment, the controller is configured to operate the actuator in response to an internal drill string pressure variation measured in a pressure transducer, wherein the internal drill string pressure variation satisfies a trigger condition.

In an embodiment, the body comprises helical carved structures distributed radially on an external surface of the body. In an embodiment, the helical carved structures are oriented in an axial direction of the body and are configured to facilitate flow of the drill fluids bypassed the drill bit.

In an embodiment, a method for controlling drilling fluids in a drill string to bypass a drill bit comprises providing the drill bit a flow of drilling fluids in the drill string, wherein the flow of drilling fluids returns in an annulus, wherein a resilient member comprises a spring providing a biasing force corresponding to a threshold trigger pressure, determining whether a trigger condition has been satisfied, upon determining the trigger condition has been satisfied, actuating a sleeve to move relative to a body sealingly housing the sleeve, and at least partially aligning a port in the sleeve to a nozzle and an activation port with a selectable hole cutter of the body, and directing a portion of the flow of drilling fluids through the port and the nozzle to bypass the drill bit and through the activation port to the selectable hole cutter to activate the selectable hole cutter.

In an embodiment, the determining the trigger condition being satisfied comprises measuring a value related to a rotation speed of the downhole drill bit or a pressure of the drilling fluids and comparing the measured value to a reference value. In an embodiment, the determining the satisfaction of the trigger condition comprises receiving a control signal from a controller, wherein the control signal is provided in response to a rotation protocol. In an embodiment, the determining the trigger condition being satisfied comprises comparing a pressure of the drilling fluids inside the drill string and a pressure of the drilling fluids in the annulus outside the drill string to ascertain a pressure difference and wherein actuating the sleeve to move relative to the body comprises actuating a three-way valve in response to the pressure difference between the drilling fluids inside the drill string and the drilling fluids in the annulus. In an embodiment, the comparing the pressure of the drill fluids inside the drill string and the pressure of the drilling fluids in the annulus outside the drill string comprises receiving the drilling fluids inside the drill string in an accumulator or pressure compensator and receiving the drilling fluids in the annulus in another accumulator or pressure compensator.

In an embodiment, the method further comprises biasing the sleeve against the body to close the port from the nozzle and the activation port from the selectable hole cutter upon determining the trigger condition has not been satisfied. In an embodiment, the biasing the sleeve against the body to close the port from the nozzle and the activation port from the selectable hole cutter comprises offsetting the port from the nozzle and the activation port from selectable hole cutter using a coil spring.

In an embodiment, the actuating the sleeve to move relative to the body comprises sliding the sleeve inside the body or rotating the sleeve inside the body or both.

In an embodiment, the method further comprises regulating the portion of the flow of drilling fluids bypassed the drill bit using helical carved structures to facilitate fluid flow in the annulus.

In an embodiment, the directing a portion of the flow of drilling fluids through the port and the nozzle to bypass the drill bit comprises actuating the sleeve to move relative to a body to align an opening in the sleeve to an outlet of the body, wherein actuating the sleeve includes providing a high pressure oil flow, using a motor driven pump, to move the sleeve. In an embodiment, the directing a portion of the flow of drilling fluids through the activation port to the selectable hole cutter to activate the selectable hole cutter comprises actuating the sleeve to move relative to a body to align an opening in the sleeve to an outlet of the body, wherein actuating the sleeve includes providing a high pressure oil flow, using a motor driven pump, to move the sleeve, and actuating the sleeve to move relative to the body to align the activation port to the selectable hole cutter.

In an embodiment, a method of making a device for bypassing fluids around a drill bit comprises providing a lower sleeve, an upper sleeve and a resilient member, assembling the lower sleeve, the upper sleeve and the resilient member to form a sleeve, assembling a body and the sleeve to form the device for bypassing drill fluids around the drill bit, wherein the sleeve is sealingly slidable inside the body and wherein the sleeve has a port alignable with a nozzle of the body and an activation port alignable with a selectable hole cutter of the body.

In an embodiment, the resilient member comprises a spring providing a biasing force corresponding to a threshold trigger pressure.

In an embodiment, a device for a selectable hole trimmer is disclosed. The device comprises an intermediate sleeve sealingly affixed inside a body via a stop block, a sleeve sealingly slidable inside the intermediate sleeve to form a pressurized volume there between, an actuator fluidly connected to the pressurized volume via a port, wherein the actuator is configured to provide a pressure to a selectable hole cutter of the body via an activation port and actuate a cutter piston of the selectable hole cutter to move relative to the body, and a controller configured to operate the actuator in response to a change of a monitored operation condition.

In an embodiment, the cutter piston comprises one or more cutters. In an embodiment, the cutter piston comprises a cutter blade, wherein the cutter blade comprises the one or more cutters.

In an embodiment, the selectable hole cutter comprises one or more cutter pistons, wherein the one or more cutter pistons comprise a cutter blade and wherein the cutter blade comprises the one or more cutters.

In an embodiment, the sliding sleeve is disposed between a return spring and a compensating spring. In an embodiment, the sliding sleeve is biased against a return spring at a first end and against a compensating spring at a second end.

In an embodiment, the body comprises at least one radial compartment housing at least one of a pump, a battery, the actuator, or the controller.

In an embodiment, the actuator includes a two-way control valve. In an embodiment, the actuator includes an oil accumulator, a pressure compensator, or both.

In an embodiment, the controller is configured to operate the actuator in response to an internal drill string pressure variation measured in a pressure transducer, wherein the internal drill string pressure variation satisfies a trigger condition.

In an embodiment, another device for selectable hole trimmer is disclosed. The device comprises an intermediate sleeve sealingly affixed inside a body via a stop block, a sleeve sealingly slidable inside the intermediate sleeve to form a pressurized volume, an actuator fluidly connected to the pressurized volume via a port, wherein the actuator is configured to provide a pressure to a selectable hole cutter of the body via an activation port and actuate a cutter piston of the selectable hole cutter to move relative to the body, and a controller configured to operate the actuator in response to a change of a monitored operation condition.

In an embodiment, the cutter piston comprises one or more cutters. In an embodiment, the cutter piston comprises a cutter blade, wherein the cutter blade comprises the one or more cutters.

In an embodiment, the selectable hole cutter comprises one or more cutter pistons, wherein the one or more cutter pistons comprise a cutter blade and wherein the cutter blade comprises the one or more cutters.

In an embodiment, the body comprises at least one radial compartment housing at least one of a pump, a battery, the actuator, or the controller.

In an embodiment, the actuator includes a two-way control valve. In an embodiment, the actuator includes an oil accumulator, a pressure compensator, or both.

In an embodiment, the controller is configured to operate the actuator in response to an internal drill string pressure variation measured in a pressure transducer, wherein the internal drill string pressure variation satisfies a trigger condition.

In an embodiment, a method of using a downhole device as a selectable hole trimmer comprises: providing a drill bit a flow of drilling fluids in the drill string, wherein the flow of drilling fluids returns in an annulus; determining whether a trigger condition has been satisfied; upon determining the trigger condition has been satisfied, opening a valve in a control system to pressurize a volume; at least partially pressurizing an activation port to a selectable hole cutter of a body; and directing a portion of the flow of drilling fluids through the activation port to the selectable hole cutter to activate the cutter piston.

In an embodiment, determining the trigger condition being satisfied comprises measuring a value related to a rotation speed of the downhole drill bit or a pressure of the drilling fluids and comparing the measured value to a reference value. In an embodiment, determining the satisfaction of the trigger condition comprises receiving a control signal from a controller, wherein the control signal is provided in response to a rotation protocol. In an embodiment, determining the trigger condition being satisfied comprises comparing a pressure of the drilling fluids inside the drill string and a pressure of the drilling fluids in the annulus outside the drill string to ascertain a pressure difference. In an embodiment, comparing the pressure of the drill fluids inside the drill string and the pressure of the drilling fluids in the annulus outside the drill string comprises receiving the drilling fluids inside the drill string in an accumulator or pressure compensator and receiving the drilling fluids in the annulus in another accumulator or pressure compensator.

In an embodiment, the method further comprises operating a pump in the control system to return the drilling fluids to the volume and to deactivate the cutter piston upon determining the trigger condition has not been satisfied; and closing the valve in the control system.

In an embodiment, the method further comprises, in an event of a power failure, a hydraulic fluid leak or a temperature spike, opening a fail-safe valve to vent drilling fluids out of the downhole device and to deactivate the cutter piston.

In an embodiment, a downhole device configured as a selectable hole trimmer comprises a dual solenoid compensation sleeve sealingly affixed inside a body, an annular compensating ring slidingly sealable outside the dual solenoid compensation sleeve, a volume/waste ring slidingly sealable outside the dual solenoid compensation sleeve to form a pressurized volume, an actuator fluidly connected to the pressurized volume via a port, wherein the actuator is configured to provide a pressure to a selectable hole cutter of the body via an activation port and actuate a cutter piston of the selectable hole cutter to move relative to the body, wherein the cutter piston comprises one or more cutters, and a controller configured to operate the actuator in response to a change of a monitored operation condition.

In an embodiment, the cutter piston comprises a cutter blade, wherein the cutter blade comprises the one or more cutters.

In an embodiment, the selectable hole cutter comprises one or more cutter pistons, wherein the one or more cutter pistons comprise a cutter blade and wherein the cutter blade comprises the one or more cutters.

In an embodiment, the volume/waste ring is biased against a hydraulic fluid return spring at a second end.

In an embodiment, the body comprises at least one radial compartment housing at least one of a battery, the actuator, or the controller.

In an embodiment, the actuator includes a dual solenoid valve, wherein a first end of the dual solenoid is fluidly connected to the activation port and a second end of the dual solenoid valve is fluidly connected to a waste port into a waste volume.

In an embodiment, the controller is configured to operate the actuator in response to an internal drill string pressure variation measured in a pressure transducer, wherein the internal drill string pressure variation satisfies a trigger condition.

In an embodiment, the dual solenoid compensating sleeve is held in place with a snap ring at an upper end and a hydraulic fluid return spring at a lower end.

In an embodiment, the volume/waste ring comprises a one-way valve between a waste volume and the pressurized volume.

In an embodiment, a method of using a downhole device configured as a selectable hole trimmer comprises: providing a drill bit a flow of drilling fluids, lowering a selectable hole trimmer in a borehole to move a solenoid compensating sleeve and a volume/waste ring downward to compress hydraulic fluid in a pressurized volume, and directing the flow of hydraulic fluids from the pressurized volume through an activation port to a selectable hole cutter to activate the selectable hole cutter.

In an embodiment, the method further comprises: stopping the flow of drilling fluids through the selectable hole trimmer to deactivate the selectable hole cutter.

In an embodiment, the method further comprises: stopping the flow of drilling fluids through the selectable hole trimmer, and directing the flow of the hydraulic fluids through a waste port into a waste volume to move an annular compensating ring upward, wherein the annular compensating ring forces the flow of the drilling fluids out of the selectable hole cutter through a drilling fluid port.

In an embodiment, the method further comprises: stopping the flow of the hydraulic fluids through the selectable hole trimmer to decompress a hydraulic return spring and to move a volume/waste ring upwards, wherein the volume/waste ring forces the flow of the hydraulic fluids in the waste volume through a one-way valve into the pressurized volume.

In an embodiment, a downhole device configured as a selective hole trimmer comprises: an intermediate sleeve affixed to a body via a stop lock, a slidable sleeve inside the intermediate sleeve to provide a pressurized volume, wherein the slidable sleeve comprises a seat, an actuator fluidly connected to the pressurized volume via a port, wherein the actuator is configured to provide a pressure to a selectable hole cutter of the body via an actuation port in the transfer sleeve and actuate the selectable hole cutter piston of the selectable hole cutter to move relative to the body, wherein the cutter piston comprises one or more cutters, and a manual controller configured to operate the actuator in response to a dropped activation dart.

In an embodiment, the cutter piston comprises a cutter blade, wherein the cutter blade comprises the one or more cutters.

In an embodiment, the selectable hole cutter comprises one or more cutter pistons, wherein the one or more cutter pistons comprise a cutter blade and wherein the cutter blade comprises the one or more cutters.

In an embodiment, an upper port in the sliding sleeve is capable of being aligned with a lower port the intermediate sleeve to pressurize a top of a divider seal ring with drilling mud to provide the pressurized volume.

In an embodiment, the sliding sleeve is capable of moving downward and pressing on a top of a divider seal ring to provide the pressurized volume.

In an embodiment, the seat is made from a polymer or a rubber. In an embodiment, the seat is made from polyurethane.

In an embodiment, the activation dart comprises a port. In an embodiment, the activation dart is made of a metal, a polymer or a rubber. In an embodiment, the activation dart is made of a metal.

In an embodiment, the manual controller configured to operate the actuation in response to a dropped deactivation ball. In an embodiment, the deactivation ball is made from a metal, a polymer or a rubber. In an embodiment, the deactivation ball is made from a metal.

In an embodiment, the body comprises a check valve to bypass an upper seal when the divider seal ring is forced upwards.

In an embodiment, the downhole device further comprises a catcher basket affixed to the body to catch the activation dart and deactivation ball.

In an embodiment, the downhole device further comprises an automatic controller to provide the pressurized volume.

In an embodiment, a method of using a downhole device configured as a selectable hole trimer comprises: providing a drill bit a flow of drilling fluids, lowering the selectable hole trimmer in a borehole, and dropping an activation dart to seal a seat, compress a return spring and move the sliding sleeve downward to pressurize a top of a divider seal with the flow of the drilling fluids, wherein the divider seal ring moves downward and forces pressurized hydraulic fluids through an activation port to a selectable hole cutter to activate the selectable hole cutter.

In an embodiment, the method further comprises: stopping the flow of the drilling fluids through the selectable hole trimmer to deactivate the selectable hole cutter.

In an embodiment, the method further comprises: dropping a deactivation ball to stop the flow of the drilling fluids through the selectable hole trimmer and to deactivate the selectable hole cutter.

In an embodiment, the method further comprises: dropping a deactivation ball, and forcing the drop dart and the deactivation ball through the seat to stop the flow of the drilling fluids through the selectable hole trimmer and to deactivate the selectable hole cutter.

In an embodiment, the method further comprises: providing a drill bit a flow of drilling fluids, and dropping a second activation dart to seal a seat, compress a return spring and move the sliding sleeve downward to pressurize a top of a divider seal with the flow of the drilling fluids, wherein the divider seal ring moves downward and forces pressurized hydraulic fluids through an activation port to a selectable hole cutter to activate the selectable hole cutter.

In an embodiment, a downhole device configured as a selectable hole trimmer comprises: an upper sleeve affixed inside a body via a stop, wherein the body comprises a drilling mud volume, a charge sleeve comprising a bypass port, wherein the charge sleeve is slidable inside the upper sleeve to provide a pressure to a pressurized volume, a catch sleeve comprising a return port, wherein the catch sleeve is slidable inside the charge sleeve to align the bypsss port and the return port with the drilling mud volume, an actuator fluidly connected to the pressurized volume via a port, wherein the actuator is configured to provide a pressure to a selectable hole cutter of the body via an actuation port in the transfer sleeve and actuate the selectable hole cutter piston of the selectable hole cutter to move relative to the body, wherein the cutter piston comprises one or more cutters, and a manual controller configured to operate the actuator in response to a dropped activation ball.

In an embodiment, the cutter piston comprises a cutter blade, wherein the cutter blade comprises the one or more cutters.

In an embodiment, the selectable hole cutter comprises one or more cutter pistons, wherein the one or more cutter pistons comprise a cutter blade and wherein the cutter blade comprises the one or more cutters.

In an embodiment, the downhole device further comprising: a charge subassembly, wherein the charge subassembly comprises the upper sleeve, the charge sleeve, and the catch sleeve, and a trimmer subassembly, wherein the transfer subassembly comprises a transfer sleeve and the selectable hole cutter.

In an embodiment, the upper sleeve acts as an upper stop for the charge sleeve.

In an embodiment, the upper sleeve is held in place with a stop at a lower end and a snap ring at an upper end.

In an embodiment, an internal stop in the charge sleeve acts as a lower stop for the catch sleeve.

In an embodiment, the catch sleeve is capable of moving to a lower position to provide the pressure through the activation ports.

In an embodiment, the downhole device further comprises a detent ring disposed between the charge sleeve and the catch sleeve. In an embodiment, the detent ring is made of a metal, a polymer or a rubber. In an embodiment, the detent ring is made of a rubber. In an embodiment, the detent ring is made of a metal. In an embodiment, the detent ring holds the charge sleeve in a relative position to the catch sleeve.

In an embodiment, the activation ball is made of a metal, a polymer or a rubber. In an embodiment, the activation ball is made of a metal.

In an embodiment, a method of using a downhole device configured as a selectable hole trimer comprises: providing a drill bit a flow of drilling fluids, lowering a selectable hole trimmer in a borehole, dropping an activation ball to seal a seat in a catch sleeve, disengage a detent ring between the charge sleeve and a catch sleeve and allow the catch sleeve to move downward to a lower position within the charge sleeve, and directing the flow of the drilling fluids from the charge sleeve through a bypass port into a drilling fluid volume and from the drilling fluid volume through a return port back into an interior of the charge sleeve to move the charge sleeve downward, wherein the charge sleeve forces hydraulic fluid through an activation port to a selectable hole cutter to activate a selectable hole cutter.

In an embodiment, the method further comprises: stopping the flow of the drilling fluids through the selectable hole trimmer to deactivate the selectable hole cutter and to move the charge sleeve and the catch sleeve upward.

In an embodiment, the method further comprises: stopping the flow of the drilling fluids through the selectable hole trimmer, raising the selectable hole trimer in the borehole, and draining drilling fluids from above the actuation ball in the charge sleeve through a port into the drilling mud volume and from the drilling mud volume through the return port back into the interior of the charge sleeve and out of the selectable hole trimmer.

These and other objects, features and advantages will become apparent as reference is made to the following detailed description, preferred embodiments, and examples, given for the purpose of disclosure, and taken in conjunction with the accompanying drawings and appended claims.

BRIEF DESCRIPTION OF THE DRAWINGS

For a further understanding of the nature and objects of the present invention, reference should be made to the following detailed disclosure, taken in conjunction with the accompanying drawings, in which like parts are given like reference numerals, and wherein:

FIG. 11C-1 shows a side view of a stop block of the exemplary embodiment of the downhole device shown in FIGS. 11A-11B prior to a second step of assembly;

FIG. 11C-2 shows a side view of the assembled sleeve of the exemplary embodiment of the downhole device shown in FIG. 11B prior to a second step of assembly;

and

Figure 29A:
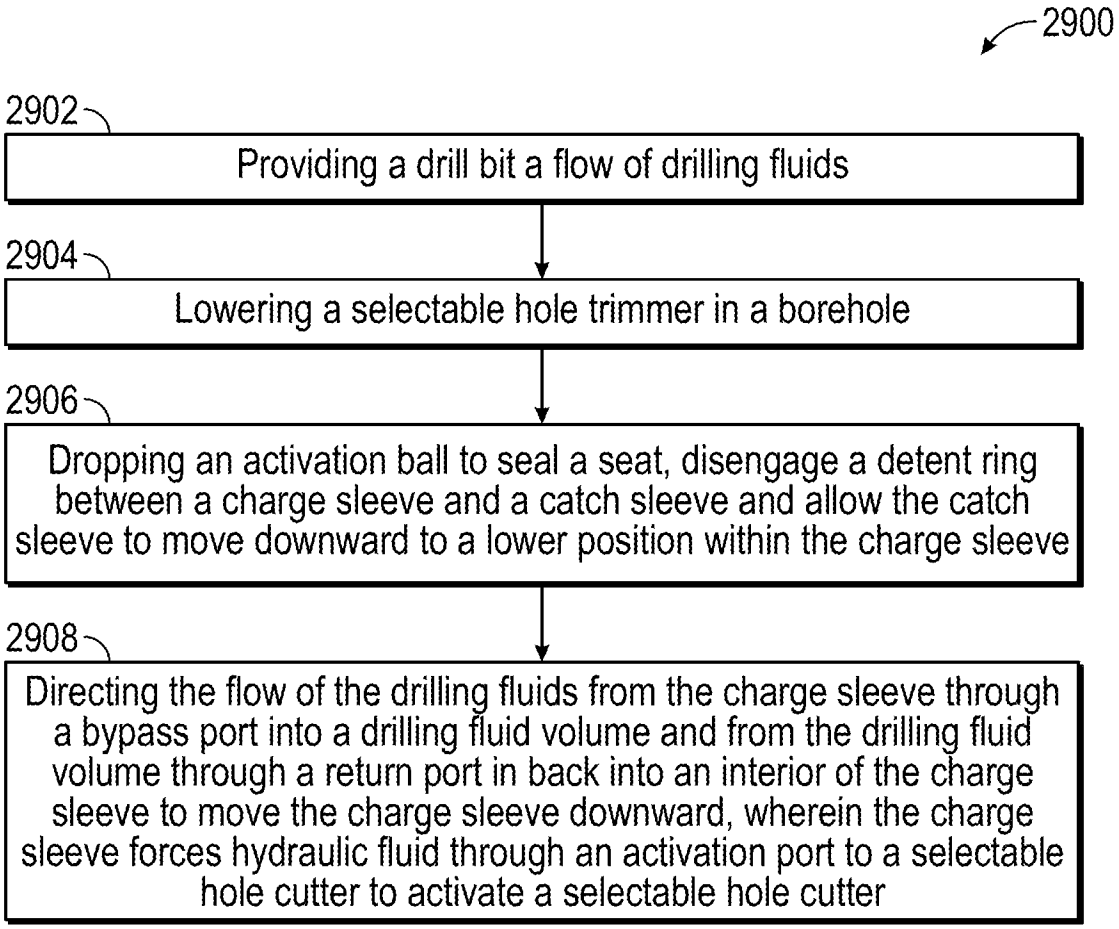
FIG. 29A shows a flow diagram of a method of using the selectable hole trimmer of FIGS. 26A-26I.
Figure 29B:
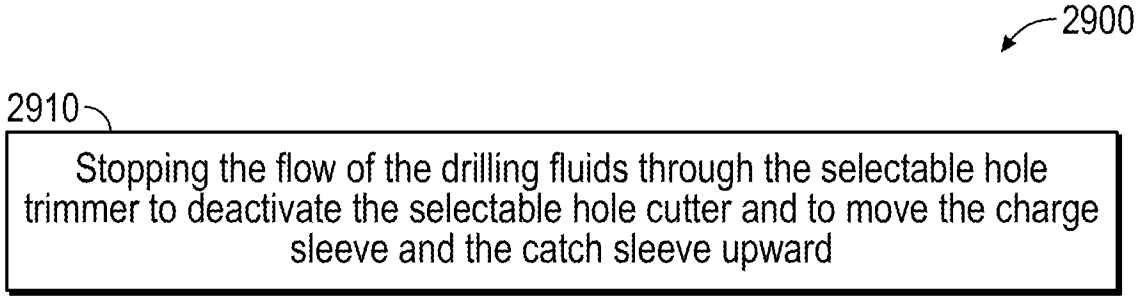
FIG. 29B shows a flow diagram of additional steps for the method of FIG. 29A.
Figure 29C:
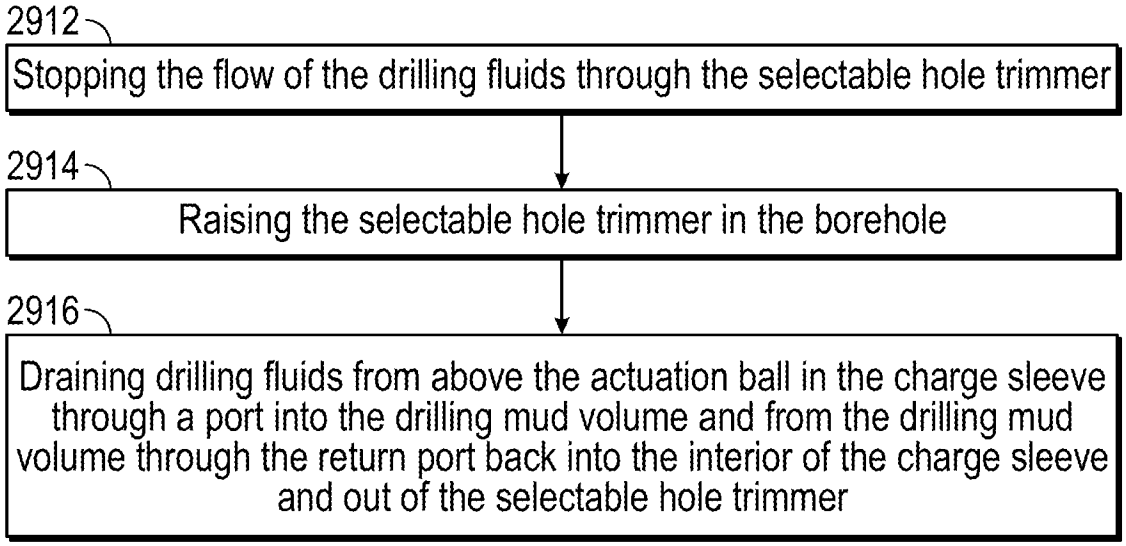

FIG. 29C shows a flow diagram of additional steps for the method of FIG. 29A.

Like numerals refer to like elements.

DETAILED DESCRIPTION

The following detailed description of various embodiments of the present invention references the accompanying drawings, which illustrate specific embodiments in which the invention can be practiced. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains. Therefore, the scope of the present invention is defined only by the appended claims, along with the full scope of equivalents to which such claims are entitled.

In general, the disclosed downhole device may run on a drill string during a drilling operation for an oil and gas well. The downhole device may operate to bypass some of the drilling fluid (mud) on command to reduce the flow through the drill bit, to clean/cool the cutters and to prevent cutter piston lock-out. The downhole device may respond to a downlink, or communication from the driller on surface, such as signal generated in response to a protocol of rpm changes to a drilling string. In some embodiments, the downhole device may be deployed in the hole in an asleep mode that awaits actuation signals. Once in position, an operator may produce rotation, pressure, weight, or other predetermined protocol to wake up the tool. Once awakened, the downhole device may respond to rotation rates above a predetermined value for initiating the bypass operation and respond to rotation rates not above the predetermined value for stopping the bypass operation. Other controls based on different measurable values may be used.

The downhole device response to the signal may include the opening or closing of one or more valves and changing of the flow path of hydraulic oil in a mechanism. Alternatively, this action may begin operation of a pump/motor and pump oil to shift a sleeve. This action changes the flow path of drilling mud through the downhole device to accomplish a function, such as sliding a sleeve or opening or closing a flow path for the drilling mud.

Further rpm protocol, or other downlink, pressure, or bit weight protocol may shift the flow path and open and close valves. Other tools incorporating this triggering method may move an internal sleeve to expose drilling reamer elements to expand and increase the inner diameter of the borehole. Another tool may use the resultant sliding sleeve action to force a reaming cutter block up a ramp to increase the inner diameter of the hole. Finally, another modification may be to fully close the tool bore and force all of the mudflow to exit the downhole device allowing none to go to the drilling bit.

The disclosed downhole device may begin operation in response to a protocol of rpm changes or changes in bit weight or pressure or flow rate or other. These signals would be recognized by the disclosed downhole device to make the change of flow path or other activity in the downhole device. The disclosed downhole device may open a flow path from the internal tool flow path of drilling mud to the annulus of the downhole device. Some percentage of the mud flowing through the drill string may then bypass to the annulus. In other embodiments, the disclosed downhole device may also open flow path of the drilling mud to borehole reaming pistons or sliding cutter blocks, which may enlarge the borehole.

Drilling Environment Implementing the Downhole Device

Figure 1:
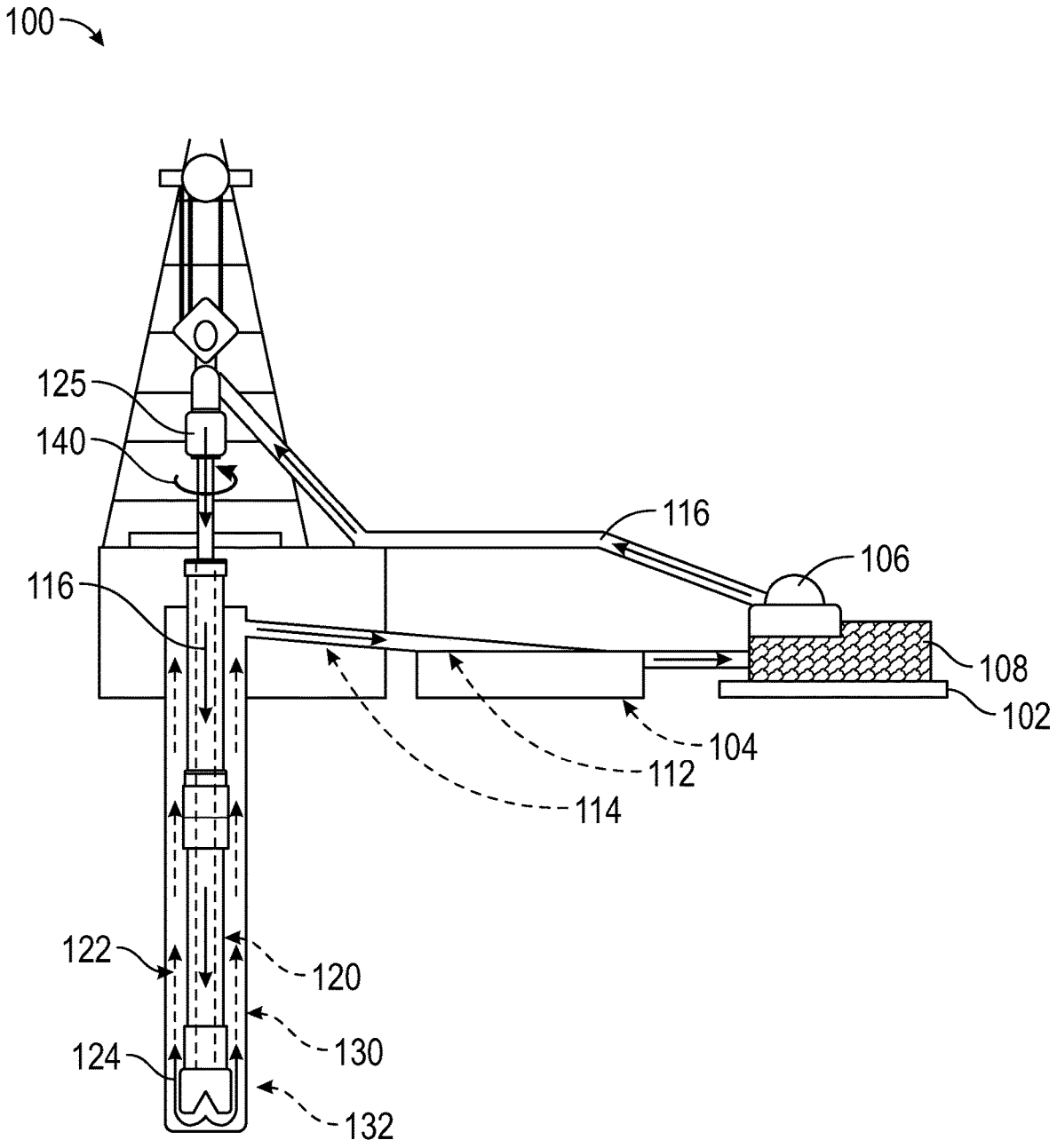
FIG. 1 illustrates an exemplary drilling environment for implementing a downhole device.

FIG. 1 illustrates an exemplary drilling environment 100 for implementing the disclosed downhole device. As shown, the exemplary drilling environment 100 includes a drilling rig having a drilling fluid (e.g., drilling mud) circulation system summarized below. The drilling environment 100 provides a conceptual understanding for the placement of the disclosed downhole device to be discussed and may include other components not shown in FIG. 1. The drilling environment 100 includes a mud reservoir 108 on the ground 102. The mud reservoir 108 receives return drilling mud caught in the mud pit 104 and supplies the mud pump 106 drilling mud to send to the mud feed line 116. The mud feed line 116 feeds drilling mud into the drill string 120 through the swivel or top drive 125. The drilling mud travels along the drill string 120 from the Kelly drive 140 down to and exits the drill bit 132. The drilling mud carries away heat and debris from the drill bit 132 and returns it to the ground 102 via the annulus 122. The annulus 122 is the clearance space created between the outer diameter of the drill string 120 and the side surface 130 of the drilled hole created by the drill bit 132. The returning mud 124 flows from the drill bit 132 in the annulus 122 upward. After returning to the ground 102, the returning mud 124 travels in the mud return line 114 to return to the mud pits 104, passing by the shale shaker 112 to remove the drill debris.

Figure 2:
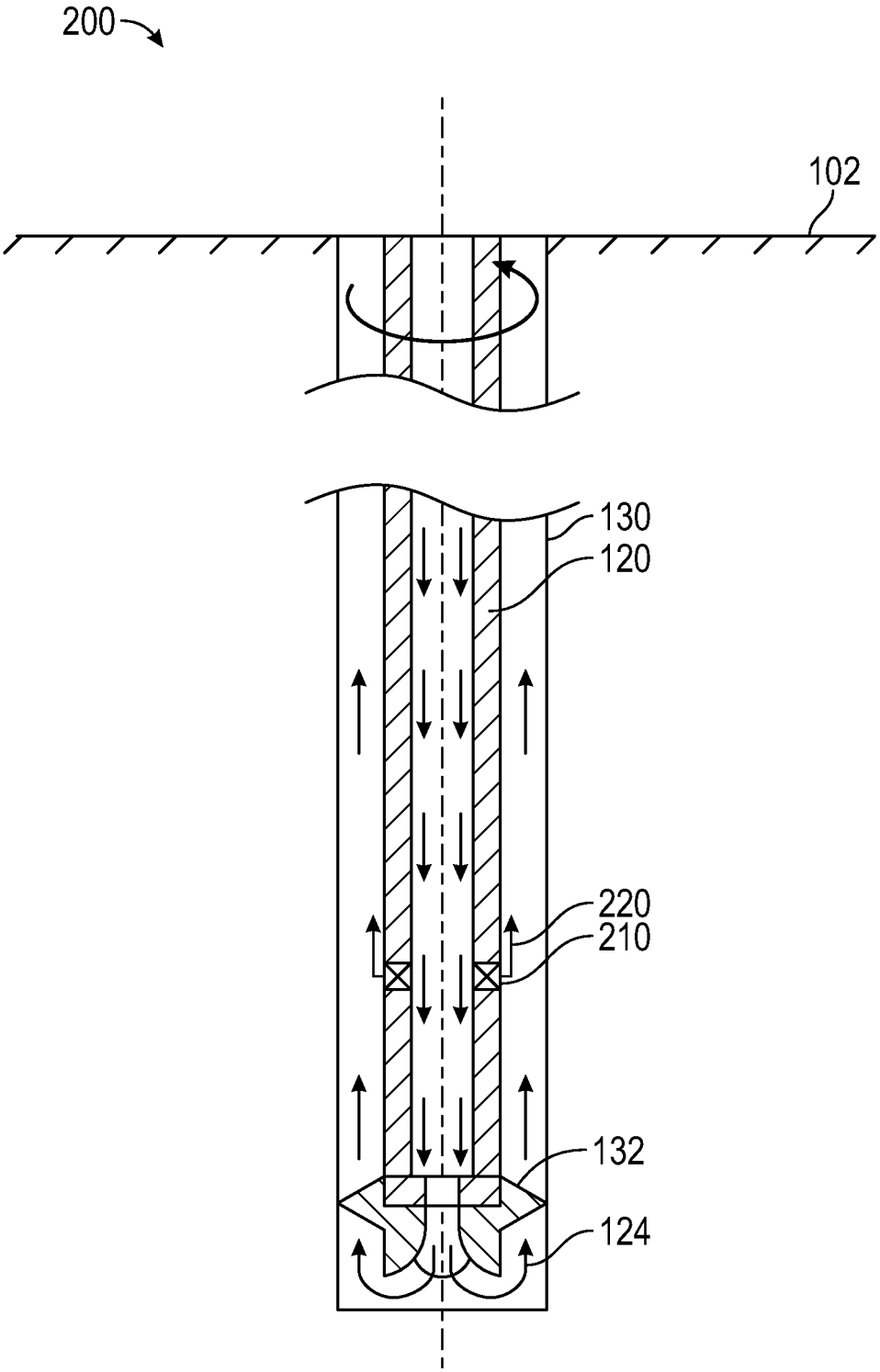
FIG. 2 shows a cross-sectional side view of a conceptual operation of the downhole device in the exemplary drilling environment of FIG. 1.

FIG. 2 shows a local cross-sectional side view of a conceptual operation of the downhole device 210 in the exemplary drilling environment 100 of FIG. 1. The downhole device 210 may be positioned at a desired location between the drill bit 132 and the ground 102. Other components or downhole devices may be installed or positioned between the downhole device 210 and the drill bit 132. When the downhole device 210 is actuated, a portion 220 of the drilling mud may bypass the drill bit 132 and flows into the annulus 120 while the returning mud 124 may include the remaining portion of the drilling mud. Details of the structure of the downhole device 210 in different embodiments are illustrated in FIGS. 3-6 and discussed below.

Exemplary Downhole Devices

Figure 3:
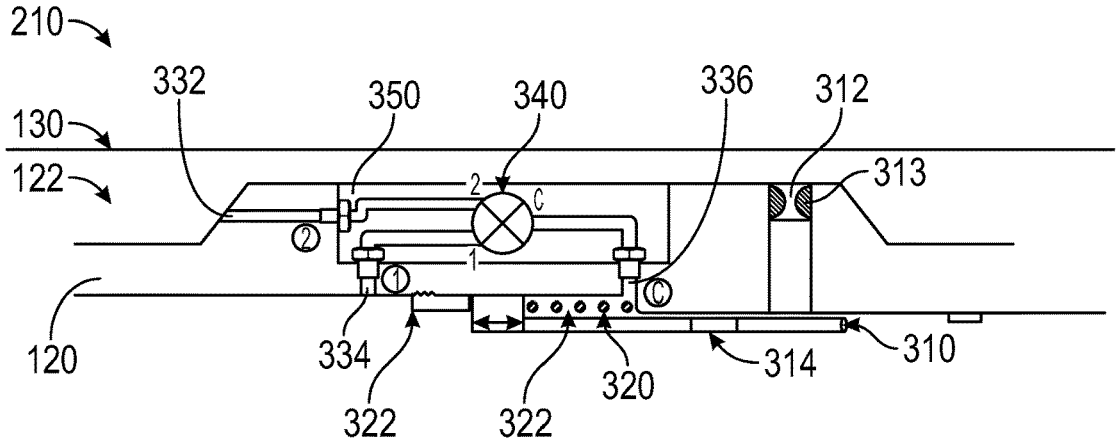
FIG. 3 shows a cross-sectional side view of a first exemplary embodiment of the downhole device.

FIG. 3 shows a cross-sectional side view of a first exemplary embodiment of the downhole device 210. As shown, the downhole device 210 includes a body as part of the drill string 120, a sleeve 310 sealingly slidable inside the body 120. See e.g., FIG. 14A: 310. The sleeve 310 may include at least one port 314 alignable with a corresponding bypass outlet 312 of the body 120. See e.g., FIG. 14A: 310, 312, 313 & 314. The bypass outlet 312 may include an erosion resistant nozzle 313. Id. The downhole device 210 further includes a resilient member 320 (e.g., a spring) biasing the sleeve 310 against the body 120. See e.g., FIG. 14A: 310 & 320. The downhole device 210 further includes a three-way valve with an actuator 340 that is configured to provide a pressure to the sleeve 310. See e.g., FIG. 14A: 310 & 340. The actuator 340 can actuate the sleeve 310 to move relative to the body 120, such as to align the bypass outlet 312 with the port 314. See e.g., FIG. 14A: 310, 312, 314 & 340. The downhole device 210 also includes a controller (e.g., the controller electronics 620 shown in FIG. 6, or implemented as the computer device 700 of FIG. 7 as discussed below) configured to operate the actuator 340 in response to a change of a monitored operation condition. Id.

In some embodiments, the downhole device 210 would use information, measurements, and other received signals (electric or mechanical, such as pressure signals) to actuate the actuator 340. See e.g., FIG. 14A: 340. For example, the downhole device 210 may sense or measure the rotation rate in revolutions per minute ("rpm"), weight or pressure signals (e.g., related to well depth, length of drill string 120, and installed components) and control the actuator 340 in response to the measured signals. Id.

Turning to FIG. 3, the downhole device 210 may have a neutral position where the sleeve 310 is biased away from the bypass outlet 312. See e.g., FIG. 14A: 310 & 312. As a result, the sleeve 310 forms a volume 322 with the body 120. Id. Before actuation, the drill string inlet 334 communicates fluid or its pressure (or both) to the volume inlet 336. See e.g., FIG. 14A: 334. Since the drill string inlet 334 takes drilling mud from the bore of the drill string 120 and is fluidly connected to the volume inlet 336 via the three-way valve actuator 340, the sliding sleeve volume 322 would have the same fluid pressure as that of the drill string 120. See e.g., FIG. 14A: 334 & 340. This pressure of the sliding sleeve volume 322 would be equal to the pressure outside of the sleeve 310 and therefore the sleeve 310 is subject only to the spring 320 and in the neutral position. See e.g., FIG. 14A: 310 & 320.

In the illustrated embodiment, a lock ring 330 may further be used to define the neutral position, for example, to allow the spring 320 to statically push the sleeve 310 against the lock ring 330. See e.g., FIG. 14A: 310 & 320. The lock ring 330, however, may be optional if an equivalent form of stopping mechanism, such as a catch key or the like formed in the sleeve 310 is employed. Id. Different configurations of providing the neutral position of the sleeve 310 under similar principle are possible and not exhaustively enumerated here. Id.

During operation, when the downhole device 210 is to shift flow paths to bypass the drill bit 132, a signal may be sent via rpm, for example, to the downhole device 210. The signal may be measured and/or processed in a microprocessor in the downhole device 210. The processor may then send a signal to the three-way valve and actuator 340 to change the pressure in the volume inlet 336. See e.g., FIG. 14A: 340. For example, the actuator 340 may increase or decrease the pressure in the volume 322. Id.

In some embodiments, the actuator 340 may connect the volume inlet 336 to the annulus outlet 332 and equalize the pressures in the sliding sleeve volume 322 to the annulus 122. See e.g., FIG. 14A: 340. Because the pressure in the annulus 122 is lower than the pressure in the drill string 120 (often by 2000 psi), the pressure applied to external surfaces of the sleeve 310 (outside the volume 322) becomes greater than the pressure applied to inner surfaces of the sleeve 310 (surfaces forming the volume 322). Id. The collective effect of this pressure difference would cause the sleeve 310 to compress the spring 320 and move toward the bypass outlet 312. See e.g., FIG. 14A: 310, 312 & 320.

The spring 320 may have a desired elasticity such that the pressure difference between the drill string pressure and the annulus pressure may fully align the bypass port 314 to the bypass outlet 312. See e.g., FIG. 14A: 312, 314 & 320. At least a portion of the drilling mud may bypass the drill bit 140 when the bypass port 314 is at least partially aligned with the bypass outlet 312. See e.g., FIG. 14A: 312 & 314. When the downhole device 210 sends a different rpm signal or stops sending a triggering signal, the actuator 340 (or its controller 620, 700) may shift the sleeve 310 back to the neutral position, by reconnecting the drill string inlet 334 to the volume inlet 336. See e.g., FIG. 14A: 310 & 334. As such, the operation of the sleeve 310 need not be externally powered, and the operation may fully use the existing pressure differences between the drill string 120 and the annulus 122. Id. The control and actuation of the three-way valve actuator 340 may be electrically powered like other downhole tools. See e.g., FIG. 14A: 340.

In some embodiments, the spring 320 may be a coil spring providing a biasing force corresponding to a threshold trigger pressure, i.e., a pressure balancing the force applied by the spring 320 to the sleeve 310. See e.g., FIG. 14A: 310 & 320. Once the pressure difference exceeds the threshold trigger pressure, the sleeve 310 may be moved toward the bypass outlet 312. See e.g., FIG. 14A: 310 & 312.

In some embodiments, the actuator 340 may be controlled in response to other signals besides rpm signals, such as an internal drill string pressure variation measured in a pressure transducer. See e.g., FIG. 14A: 340. For example, the internal drill string pressure variation satisfies a trigger condition for initiating a bypass of the drilling fluids. Sensors for measuring pressures, rpm, and other aspect of the downhole device 210 or the drill string 120 may be installed in various locations along the drill string 120, or may be onboard other tools of the drill string 120. Controller, power supply and other electronics are discussed in relation to FIG. 6 below.

Figure 4:
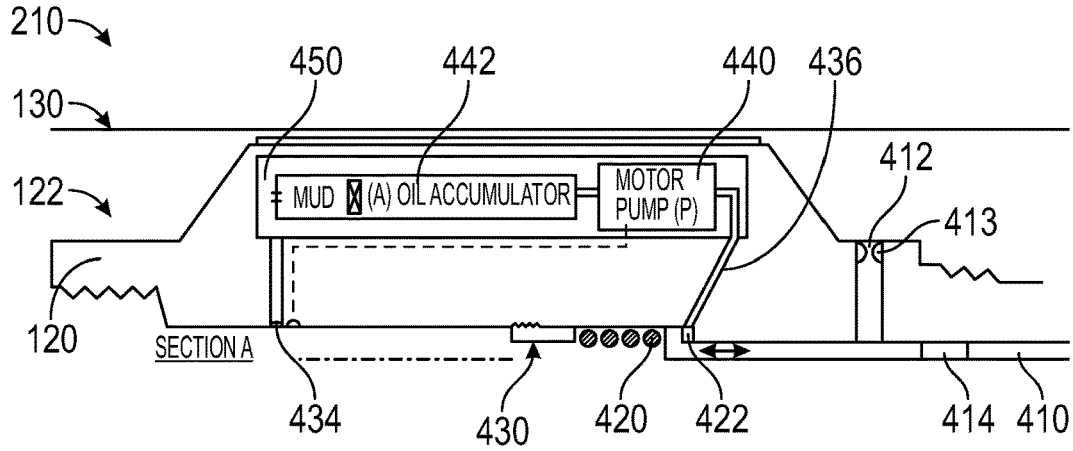
FIG. 4 shows a cross-sectional side view of a second exemplary embodiment of the downhole device.

FIG. 4 shows a cross-sectional side view of a second exemplary embodiment of the downhole device 210. Similar to the previous embodiment, the downhole device 210 includes a body as part of the drill string 120, a sleeve 410 sealingly slidable inside the body 120. See e.g., FIG. 14A: 410. The sleeve 410 may include at least one port 414 alignable with a corresponding bypass outlet 412 of the body 120. See e.g., FIG. 14A: 410 & 414. The bypass outlet 412 may include an erosion resistant nozzle 413. The downhole device 210 further includes a resilient member 420 (e.g., a spring) biasing the sleeve 410 against the body 120. See e.g., FIG. 14A: 410 & 420. The downhole device 210 further includes a motor driven pump 440 (herein called motor pump) that is configured to provide a pressure to the sleeve 410. See e.g., FIG. 14A: 410 & 440. The motor pump 440 can actuate the sleeve 410 to move relative to the body 120, such as to align the bypass outlet 412 with the port 414. See e.g., FIG. 14A: 410, 414 & 420.

The downhole device 210 may have a neutral position where the sleeve 410 is biased toward the bypass outlet 412 and the bypass port 414 is offset from the bypass outlet 412. See e.g., FIG. 14A: 410 & 414. The sleeve 410 is pushed by the spring 420 secured at a lock ring 430 toward the bypass outlet, forming a volume 422 with the body 120. See e.g., FIG. 14A: 410, 420 & 430. The volume 422 is connected to the motor pump 440 via a motor pump fluid line 436. See e.g., FIG. 14A: 436 & 440. In this embodiment, the pressure of the drilling fluids in the downhole device 210 bore (or the drill string 120) may communicate with an accumulator/pressure compensation vessel 442 (the "accumulator" 442). See e.g., FIG. 14A: 442. The accumulator 442 may actuate the adjacent piston to pressurize the internal oil in its oil chamber to the same pressure as that of the downhole device 210 (i.e., pressure inside the drill string 120). Id. The accumulator 442 and the motor pump 440 may both be housed in a radial housing 450 of the body 120. See e.g., FIG. 14A: 440, 442 & 450.

During operation, a microprocessor (e.g., included in the electronics 620 of FIG. 6) sends control signals to the motor pump 440. See e.g., FIG. 14A: 440. Upon receiving the control signals from the microprocessor, the motor pump 440 may pump pressurized oil from the accumulator 442 to the volume 422 via the motor pump fluid line 436. See e.g., FIG. 14A: 436, 440 & 442. As such, the pumped oil pressure caused by the motor pump 440 may move the sleeve 410 to align the bypass port 414 with the bypass outlet 412. See e.g., FIG. 14A: 410, 414 & 440. Because the drill string inlet 434 is hydraulically linked to the motor pump fluid line 436, the motor pump 440 needs not overcome the pressure in the drill string 120 and needs only overcome the bias force applied by the spring 420. See e.g., FIG. 14A: 420, 434, 436 & 440. When the bypass port 414 and the bypass outlet 412 are aligned, a portion of the drilling mud passing through the downhole device 210 is bypassed to the annulus 122. See e.g., FIG. 14A: 414. Whenever rpm ceased the downhole device 210 may be and is typically programmed to close the bypass path.

In some embodiments, the microprocessor sends control signals based on preprogrammed rpm protocols. When the operator decides to put the downhole device 210 to sleep and stop the bypass flow from the bore to the annulus, then a different, pre-programmed rpm protocol would be performed. Such intent may be transmitted through the drill string 120 and recognized by an accelerometer connected to the microprocessor. The resulting signal may shut off the pump and allow the spring 420 to return the sleeve 410 to the original position to seal the bypass outlet 412. See e.g., FIG. 14A: 410 & 420.

In some embodiments, the actuation of the sleeve 410 by the motor pump 440 may include linear sliding motion, spiral sliding motion, rotational motion, or a combination thereof. See e.g., FIG. 14A: 410 & 440. For example, the bypass port 414 and the bypass outlet 412 may be apart linearly or radially in different embodiments. See e.g., FIG. 14A: 414. The motor pump 440 may employ various hydraulic actuators to move the sleeve 410, not limited to the disclosed examples. See e.g., FIG. 14A: 410 & 440.

Figure 5:
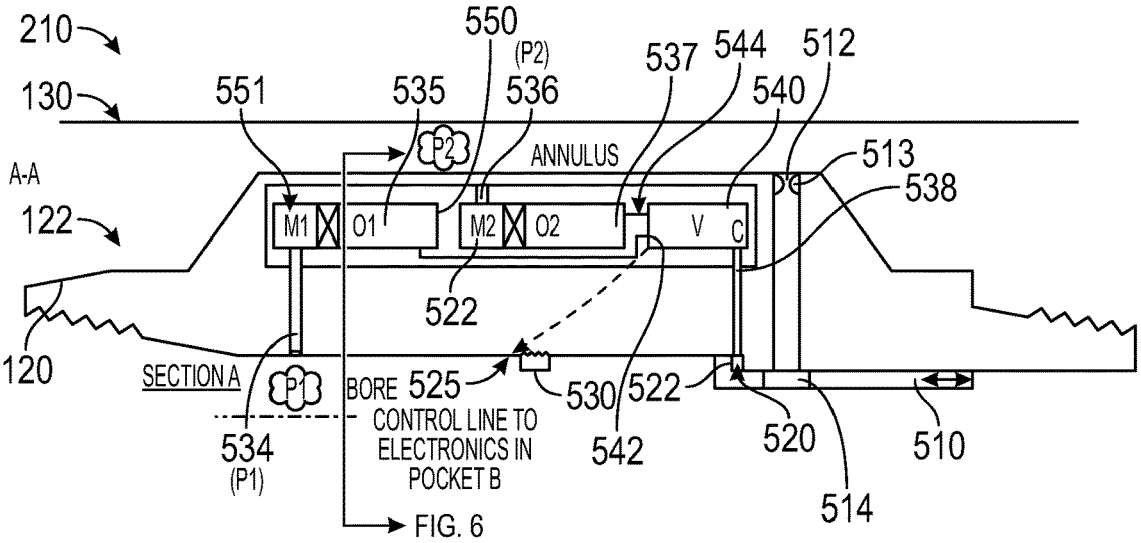
FIG. 5 shows a cross-sectional side view of a third exemplary embodiment of the downhole device.

FIG. 5 shows a cross-sectional side view of a third exemplary embodiment of the downhole device 210. Similar to the previous embodiments, the downhole device 210 in this embodiment also includes a body as part of the drill string 120, a sleeve 510 sealingly slidable inside the body 120. The sleeve 510 may include at least one port 514 alignable with a corresponding bypass outlet 512 of the body 120. The bypass outlet 512 may include an erosion resistant nozzle 513. The downhole device 210 further includes a resilient member 520 (e.g., a spring) biasing the sleeve 510 against the body 120. The downhole device 210 further includes a three-way valve 540 that is configured to provide a pressure to the sleeve 510 to actuate the sleeve 510 to move relative to the body 120, such as to align (as illustrated when bypass actuation conditions are met) the bypass outlet 512 with the port 514. See e.g., FIG. 14A.

In FIG. 5, the body 120 includes a radial housing 550 for enclosing a bore pressure oil accumulator 535, an annulus pressure oil accumulator 537, and the three-way valve 540. See e.g., FIG. 14A: 535 & 537. The bore pressure oil accumulator 535 is connected to the drill string inlet 534 that is open to the bore to receive pressure therein. Id. The bore pressure oil accumulator 535 may have mud from the drill string 120 to enter the volume 551 and apply pressure to the bore pressure oil accumulator 535. See e.g., FIG. 14A: 535 & 551. The bore pressure is communicated to the three-way valve 540 via the bore pressure oil accumulator inlet 542. Id. The annulus pressure oil accumulator 537 is connected to the annulus inlet 536 to receive pressure therein. See e.g., FIG. 14A: 537. The annulus pressure oil accumulator 537 may have mud from the annulus 122 to enter the volume 552 and apply pressure to the annulus pressure oil accumulator 537. Id. The annulus pressure is communicated to the three-way valve 540 via the annulus pressure oil accumulator inlet 544. Id.

During operation, the pressure in the bore of the downhole device 210 is higher than the pressure in the annulus 122, often by about 1000-2000 psi. The bore pressure is communicated from the drill string inlet 534 through the bore pressure oil accumulator 535 to the three-way valve 540. See e.g., FIG. 14A: 535. Similarly, the pressure of the mud in the annulus between the downhole device 210 and the side surface 130 of the drilled hole is communicated to the volume 536 and the annulus pressure oil accumulator 537. See e.g., FIG. 14A: 537. The oil from the annulus pressure oil accumulator 537 is then communicated to the three-way valve 540. Id.

The output port of the three-way valve 540 is shown as the sleeve volume inlet 538 and communicates, via the volume inlet 538, to the volume 522 between the sliding sleeve 510 and the downhole device 210's inner diameter, sealed by seals that allows for relative movement between the sleeve 510 and the body 120. See e.g., FIG. 14A.

Inside that volume 522 is also a spring 520 which forces the sleeve 510 to the left (toward top of the downhole device 210) when there is no pressure differential between the bore and the volume 522, similar to the first embodiment shown in FIG. 3. When the three-way valve 540 relays the pressure from the drill string inlet 540 to the sleeve volume inlet 538, the sleeve 510 is positioned in a normally "closed" position. See e.g., FIG. 14A.

Whenever an rpm protocol or other prescribed signal (pressure, bit weight, etc.) is sensed by one or more accelerometers and communicated to the microprocessor (both located in another pocket in the downhole device 210 (not shown) then the valve (V) is signaled to shift to the non-closed position. The three-way valve 540 communicates the pressure of the annulus 122 via the annulus pressure oil accumulator inlet 544 to the volume inlet 538 and thus to the volume 522. See e.g., FIG. 14A. Because the annulus pressure can be said to be always lower than the internal flow in the tool, this lower pressure in the volume 522 shifts the sleeve 510 to the right as shown, aligning the bypass port 514 to the bypass outlet 512. This actuates the bypass flow and allows free flow of drilling fluids from the bore to the annulus.

When drilling mud bypass is no longer desired, then an rpm signal (or other types of signals) may be given, such as stopping the rotation entirely. The accelerometer measures such signals and the microprocessor processes the measured signals to determine a corresponding control output. The three-way valve 540 may then be controlled to shift back to the original closed position. This is achieved by communicating the bore pressure from the drill string inlet 534 to the volume 522 (which are identical pressures) and allowing the spring 520 to move the sleeve 510 to offset the bypass port 514 from the bypass outlet 512, sealing off the bypass flow. See e.g., FIG. 14A.

Figure 6:
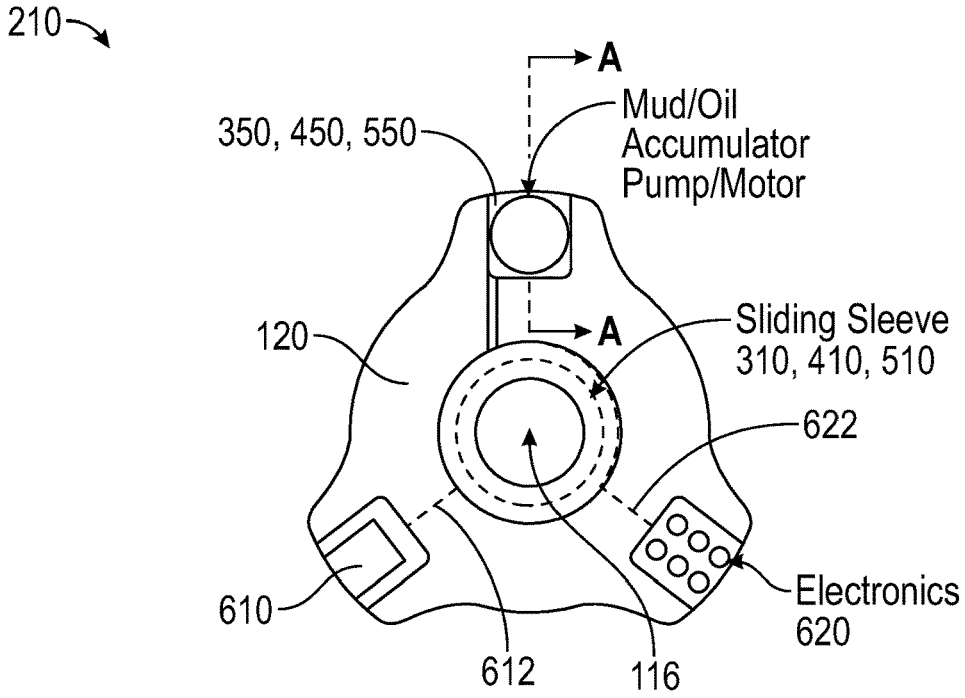
FIG. 6 shows a cross-sectional top view of an exemplary embodiment of the downhole device.

FIG. 6 shows a cross-sectional top view of an exemplary embodiment of the downhole device 210. The configuration shown in FIG. 6 is applicable to the previous embodiments discussed in FIGS. 3-5. For example, the downhole device 210 may include one or more radial housing 350, 450, or 550 for containing the actuator 340, 440, or 540. The downhole device 210 may include an internal tube (e.g., the internal cylindrical surface) housing the sleeve 310, 410, or 510.

As shown, the downhole device 210 includes three radial housings, possibly equally spaced 120 degrees apart. In some embodiments, one or more, such as two, or four, or another different number of radial housings may be used instead of three. The radial housing 350, 450, or 550 may each include one or more, or all the component(s) of the bypass actuation system without preference or limitations. For example, the radial housing 350, 450, or 550 may include at least one of an oil accumulator, a motor pump, a battery 610, the actuator, the three-way valve, or motor pump 340, 440, or 540, or the controller/electronics 620, 700 as discussed above.

In some embodiments, the battery 610, the electronics 620, and the actuators 340, 440, and 540 may respectively be connected by a wire 612 and a control line 622. For example, the control line 622 may be embedded in a bored hole or holes in the body 120 around the sleeve 310, 410, or 510 to reach the corresponding radial housing 350, 450, or 550. In some embodiments, the power line 612 may connect directly with the actuator or motor pump 340, 440, or 540. In other embodiments, the power line 612 may connect directly with the electronics 620, 700. In other embodiments, the power line 612 may connect indirectly with the actuator or motor pump 340, 440, or 540 via the electronics 620, 700. Other arrangements are possible. In some implementations, wireless communication for receiving sensing signals and sending control signals may be employed between the electronics 620 and the actuator or pump 340, 440, or 540. Although the battery 610, the electronics 620, and the actuator or pump 340, 440, or 540 are shown to be separately placed in individual radial housings 350, 450, or 550, they may be reconfigured to share one or more radial housings as desired.

Figure 7A:
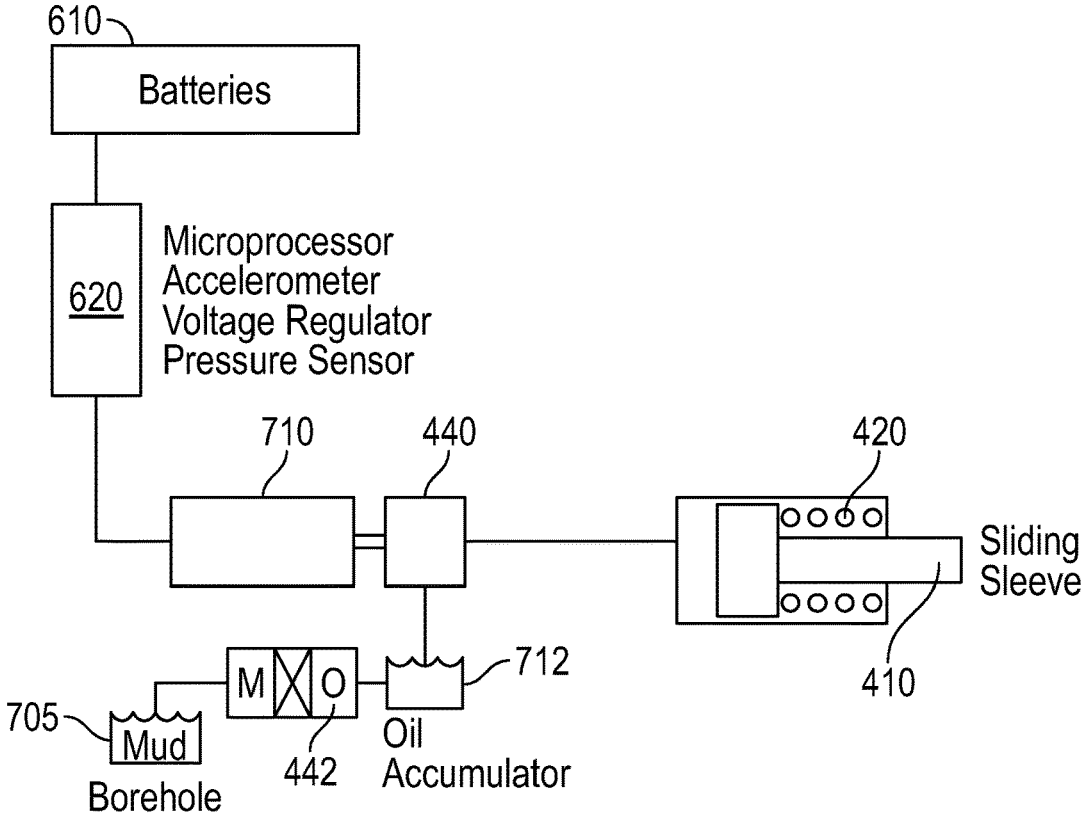
FIG. 7A shows an exemplary schematic for controlling the downhole device.

FIG. 7A illustrates an exemplary schematic for controlling the downhole device 210 as shown in FIGS. 3-6. The electronics 620 may include a microprocessor, one or more accelerometers, a voltage regulator, and a pressure sensor, for example. In some embodiments, the illustrated schematic applies to FIG. 4. For example, the electronics 620 may send control signals to a motor or actuator 710 that is operable to power the motor pump 440. Details of data acquisition and generation of the control signals may reference U.S. Pat. No. 9,879,518, specifically, FIGS. 5, 6, and 6A and the corresponding descriptions.

Upon receiving power or actuation from the actuator 710, the motor pump 440 may communicate pressurized oil from the oil reservoir or accumulator 712 to actuate the sleeve 410 to overcome the bias force by the spring 420 and to align bypass port 414 with bypass outlet 412. The mud 705 in borehole is communicated to the oil accumulator 442 that provides the pressurized oil to the oil accumulator 712. Different configurations are possible in view of the bypass method discussed below.

Figure 7B:
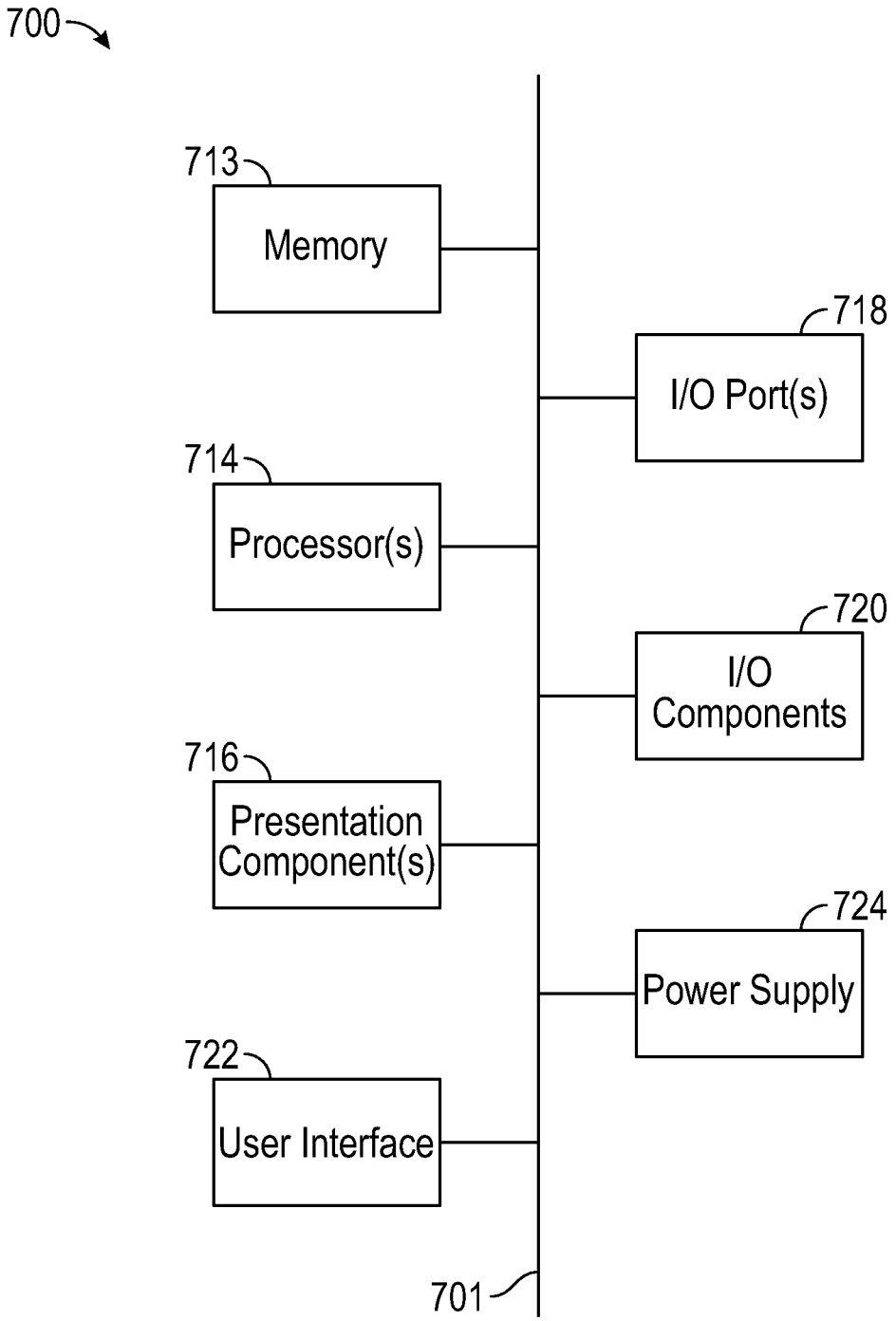
FIG. 7B shows an exemplary schematic of a controller applicable to the downhole device.

FIG. 7B shows an exemplary schematic of a controller 700 of the electronics 620 applicable to the downhole device 210. Referring to the drawings in general, and initially to FIGS. 7A and 7B in particular, the controller 700 is but one example of a suitable configuration for the electronics 620 and is not intended to suggest any limitation as to the scope of use or functionality of this disclosure. Neither should the controller 700 be interpreted as having any dependency or requirement relating to any one or combination of components illustrated.

Embodiments of this disclosure may be described in the general context of computer code or machine-executable instructions stored as program modules or objects and executable by one or more computing devices, such as a laptop, server, mobile device, tablet, etc. Generally, program modules including routines, programs, objects, components, data structures, etc., refer to code that perform particular tasks or implement particular abstract data types. Embodiments of this disclosure may be practiced in a variety of system configurations, including handheld devices, consumer electronics, general-purpose computers, more specialty computing devices, and the like. Embodiments of this disclosure may also be practiced in distributed computing environments where tasks may be performed by remote-processing devices that may be linked through a communications network.

With continued reference to FIG. 7B, the controller 700 of the downhole device 210 includes a bus 701 that directly or indirectly couples the following devices: memory 713, one or more processors 714, one or more presentation components 716, one or more input/output (I/O) ports 718, I/O components 720, a user interface 722 and an illustrative power supply 724 (such as the battery 610 of FIG. 6). The presentation components 716 and the user interface 722 may be above ground and connected to the bus 701 remotely or when the tool is located above ground for servicing. The bus 701 represents what may be one or more busses (such as an address bus, data bus, or combination thereof).

Although the various blocks of FIG. 7B are shown with lines for the sake of clarity, in reality, delineating various components is not so clear, and metaphorically, the lines would more accurately be fuzzy. For example, one may consider a presentation component such as a display device to be an I/O component. Additionally, many processors have memory. The diagram of FIG. 7B is merely illustrative of an exemplary computing device that can be used in connection with one or more embodiments of the present invention. Further, a distinction is not made between such categories as "workstation," "server," "laptop," "mobile device," etc., as all are contemplated within the scope of FIG. 7B and reference to "computing device."

The controller 700 of the downhole device 210 typically includes a variety of computer-readable media. Computer-readable media can be any available media that may be accessed by the controller 700 and include both volatile and nonvolatile media, removable and non-removable media. By way of example, and not limitation, computer-readable media may comprise computer-storage media and communication media.

The computer-storage media includes volatile and nonvolatile, removable and non-removable media implemented in any method or technology for storage of information such as computer-readable instructions, data structures, program modules, or other data. Computer-storage media includes, but is not limited to, Random Access Memory (RAM), Read Only Memory (ROM), Electronically Erasable Programmable Read Only Memory (EEPROM), flash memory or other memory technology, CD-ROM, digital versatile disks (DVD) or other holographic memory, magnetic cassettes, magnetic tape, magnetic disk storage or other magnetic storage devices, or any other medium that can be used to encode desired information and which can be accessed by the controller 700.

The memory 713 includes computer-storage media in the form of volatile and/or nonvolatile memory. The memory 713 may be removable, non-removable, or a combination thereof. Suitable hardware devices include solid-state memory, hard drives, optical-disc drives, etc. The controller 700 of the downhole device 210 includes one or more processors 714 that read data from various entities such as the memory 713 or the I/O components 720.

The presentation component(s) 716 present data indications to a user or other device. In an embodiment, the controller 700 outputs present data indications including separation rate, temperature, pressure and/or the like to a presentation component 716. Suitable presentation components 716 include a display device, speaker, printing component, vibrating component, and the like.

The user interface 722 allows the user to input/output information to/from the controller 700. Suitable user interfaces 722 include keyboards, key pads, touch pads, graphical touch screens, and the like. For example, the user may input a type of signal profile into the controller 700 or output a separation rate to the presentation component 716 such as a display. In some embodiments, the user interface 722 may be combined with the presentation component 716, such as a display and a graphical touch screen. In some embodiments, the user interface 722 may be a portable hand-held device. The use of such devices is well known in the art.

The one or more I/O ports 718 allow the controller 700 to be logically coupled to other devices including the accelerometers, pressure sensors, rpm sensors, and other I/O components 720, some of which may be built in. Examples of other I/O components 720 include a control terminal above the ground, the actuators 340, 440, and 540, wireless device, other sensors, and actuators in the drill string 120, and the like. During operation, for example, the I/O ports 718 enables the controller 700, via the control line 622, for example, to operate on the three-way valves 340 and 540 to alter the connection between different ports.

Any suitable controller may be used with this invention. For example, U.S. Pat. No. 9,879,518 discloses an intelligent reamer for drilling using rotation sensor, fluid operation sensor, and a control scheme based on the measured rotational rate of the drill string (e.g., an rpm protocol). The U.S. Pat. No. 9,879,518 disclosure regarding the data acquisition, sensing, signal transmission, signal processing, control, and other technical aspects in the that patent are hereby cited as background and incorporated by reference to the extent that they is not inconsistent with this invention.

Figure 8A:
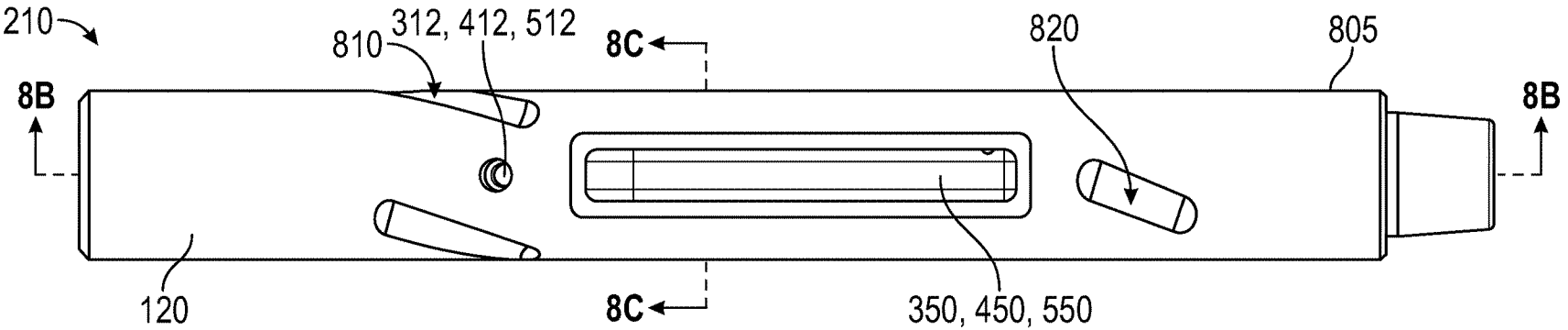
FIG. 8A shows a side view of an exemplary embodiment of the downhole device having carved structures for regulating the annular fluid flow.
Figure 8B:
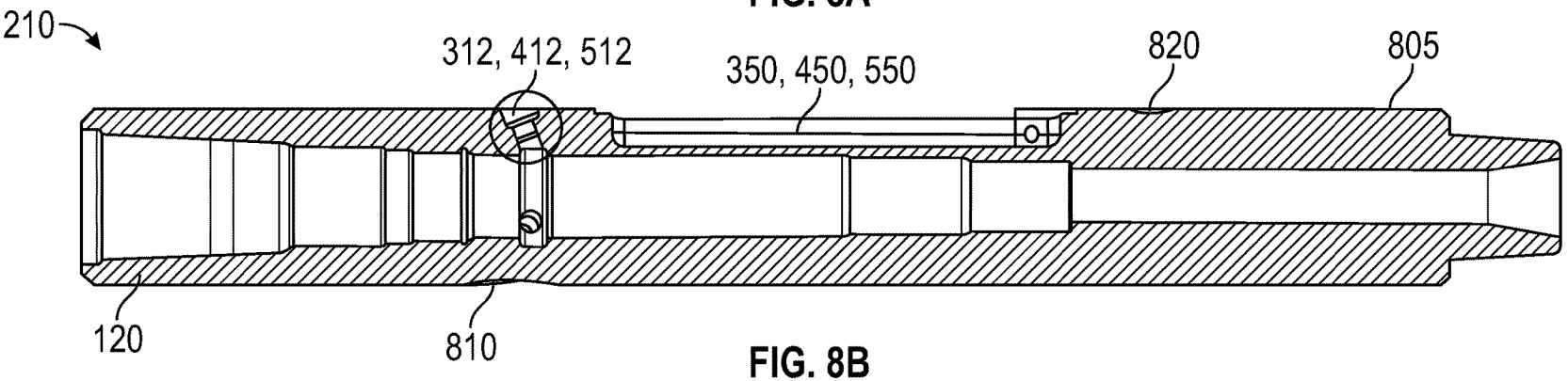
FIG. 8B shows a cross-sectional side view of the exemplary embodiment of the downhole device shown in FIG. 8A.
Figure 8C:
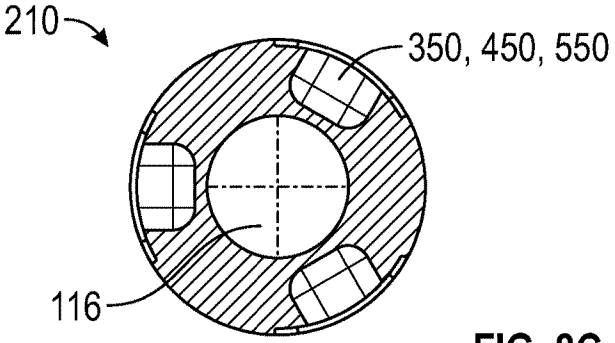
FIG. 8C shows a cross-sectional top view of the exemplary embodiment of the downhole device shown in FIG. 8A.

FIG. 8A shows a side view of an exemplary embodiment of the downhole device 210 having carved structures 810 and 820 for regulating the annular fluid flow. FIG. 8B shows a cross-sectional side view, and FIG. 8C shows a cross-sectional top view of the same. The carved structures 810 and 820 may be slots carved on the external surface of the body 805 of the downhole device 210. The carved structure 820 is lower than the carved structure 810 when the example downhole device 210 is positioned in an erected orientation. The carved structures 810 and 820 may motivate the annular flow of the drilling fluids upward. For example, the carved structures 810 and 820 form helical profiles that when the carved structures 810 and 820 are rotated clockwise (viewing downward into the well), the fluids in the carved structures 810 and 820 would receive an upward actuation. This may be similar to a full coverage stabilizer or a spiral collar.

In some embodiments, the carved structures 810 and 820 may cause turbulence to bring the cuttings off the wall and allow the upward flow from the bit to carry them upward in the well. In some embodiments, the carved structure 810 may intersect with the bypass outlet 312, 412, or 512 to provide the helical motion of the circulated drill fluids in the annulus 122 from the outset. Although FIG. 8A illustrates the carved structures 810 and 820 to be certain helical shape, different shapes, such as the varying degrees of helical angles, may be used, as long as they form a general axial arrangement. In some embodiments, the carved structures 810 and 820 may have a substantial depth based on the wall thickness, as shown in FIG. 8B.

Alternative Exemplary Downhole Device

Figure 10A:
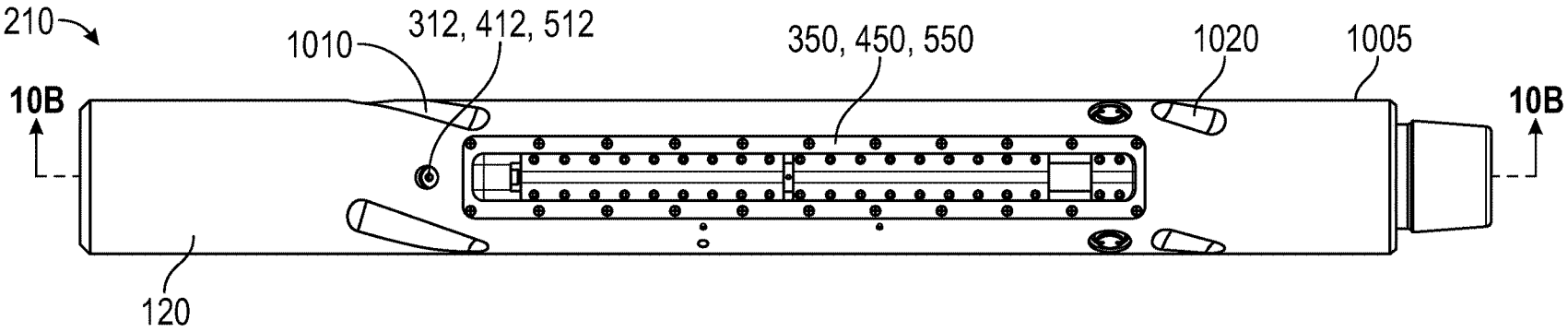
FIG. 10A shows a side view of an exemplary embodiment of an alternative downhole device having carved structures for regulating annular fluid flow.
Figure 10B:
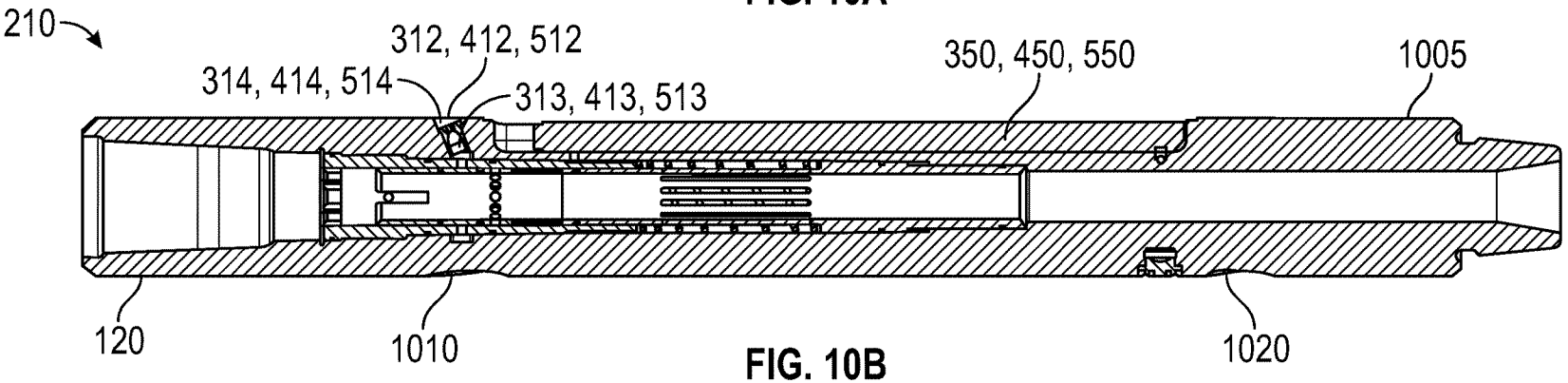
FIG. 10B shows a cross-sectional side view of the exemplary embodiment of the downhole device shown in FIG. 10A.
Figure 10C:
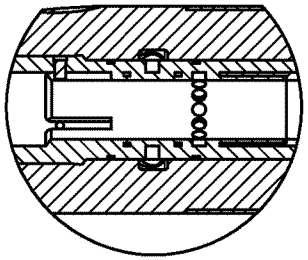
FIG. 10C shows a detailed view cross-sectional top view of the exemplary embodiment of the downhole device shown in FIG. 10B.

FIG. 10A shows a side view of an exemplary embodiment of an alternative downhole device 210 having carved structures 1010 and 1020 for regulating annular fluid flow. FIG. 10B shows a cross-sectional side view, and FIG. 10C shows a cross-sectional top view of the same. The carved structures 1010 and 1020 may be slots carved on the external surface of the body 1005 of the downhole device 210. The carved structure 1020 is lower than the carved structure 1010 when the example downhole device 210 is positioned in an erected orientation. The carved structures 1010 and 1020 may motivate the annular flow of the drilling fluids upward. For example, the carved structures 1010 and 1020 form helical profiles that when the carved structures 1010 and 1020 are rotated clockwise (viewing downward into the well), the fluids in the carved structures 1010 and 1020 would receive an upward actuation. This may be similar to a full coverage stabilizer or a spiral collar.

In some embodiments, the carved structures 1010 and 1020 may cause turbulence to bring the cuttings off the wall and allow the upward flow from the bit to carry them upward in the well. In some embodiments, the carved structure 1010 may intersect with the bypass outlet 312, 412, or 512 to provide the helical motion of the circulated drill fluids in the annulus 122 from the outset. Although FIG. 10A illustrates the carved structures 1010 and 1020 to be certain helical shape, different shapes, such as the varying degrees of helical angles, may be used, as long as they form a general axial arrangement. In some embodiments, the carved structures 1010 and 1020 may have a substantial depth based on the wall thickness, as shown in FIG. 10B.

Exemplary Downhole Devices Configured as a Selectable Hole Trimmer

Figure 14A:
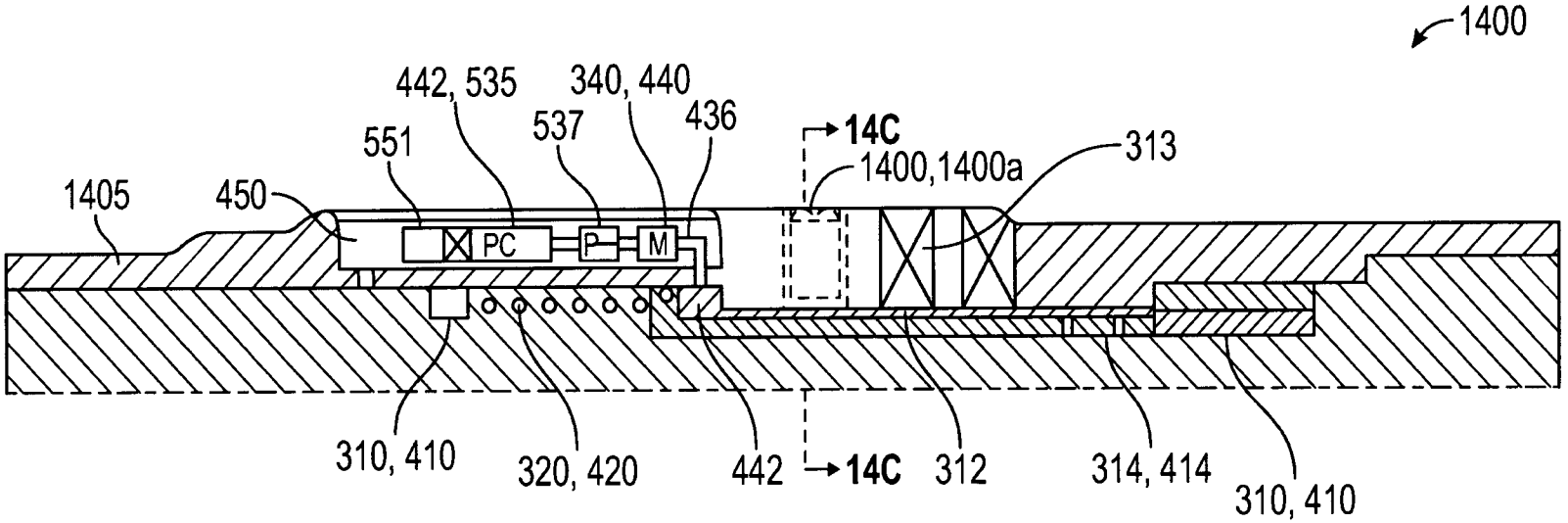
FIG. 14A shows a cross-sectional side view of an exemplary embodiment of the downhole device configured as a selectable hole trimmer, showing a selectable hole cutter on the downhole device.
Figure 14B:
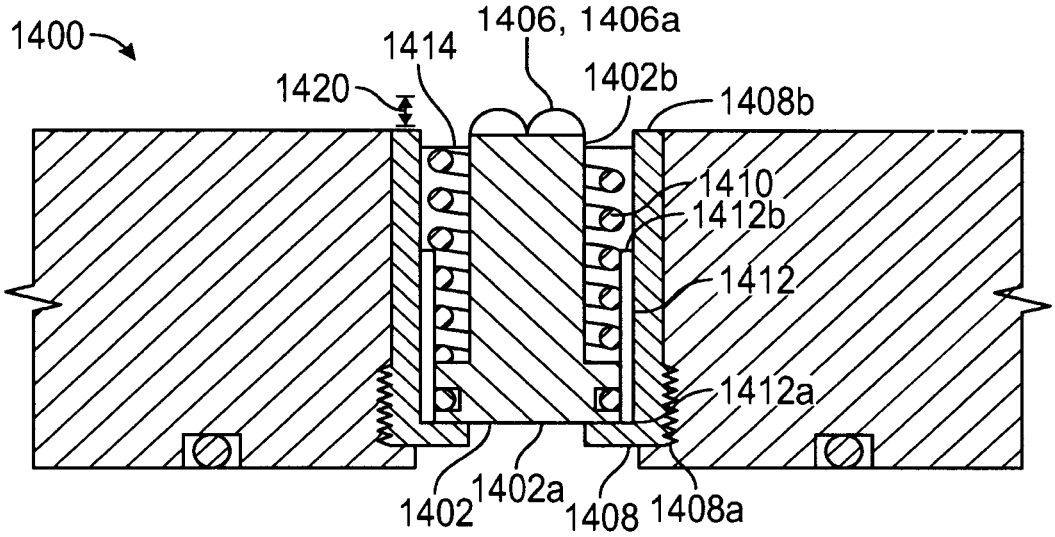
FIG. 14B shows a detailed view of the selectable hole trimmer of FIG. 14A.
Figure 14C:
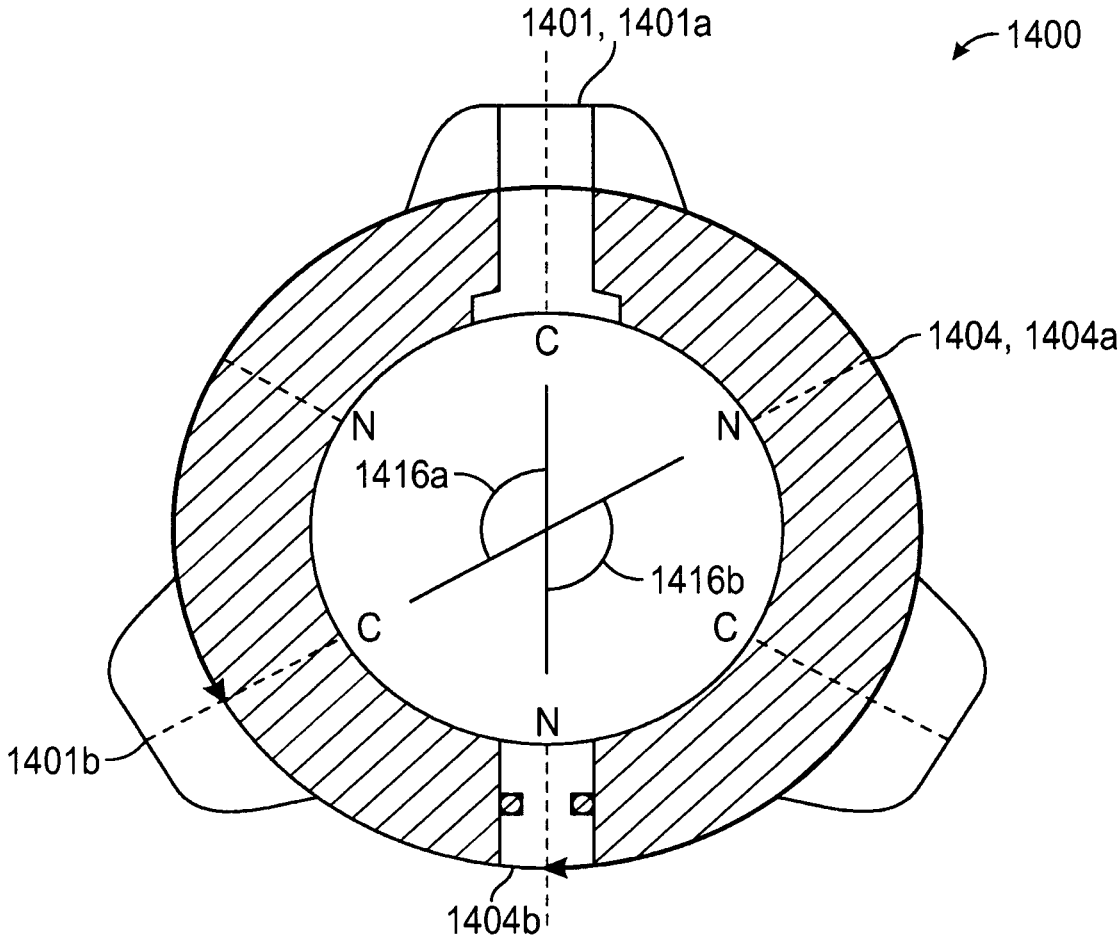
FIG. 14C shows a Section A cross-sectional view of the selectable hole trimmer of FIG. 14A.

FIG. 14A shows a cross-sectional side view of an exemplary embodiment of the downhole device configured as a selectable hole trimmer 1400, showing a selectable hole cutter 1401 on the downhole device 1400; FIG. 14B shows a detailed view of the selectable hole trimmer 1400 of FIG. 14A; and FIG. 14C shows a Section A cross-sectional view of the selectable hole trimmer 1400 of FIG. 14A.

Figure 15A:
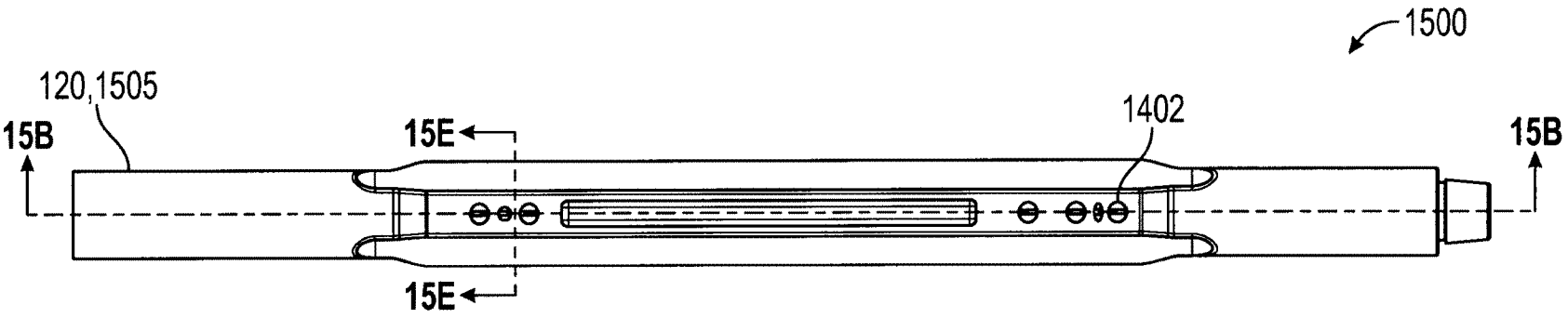
FIG. 15A shows a view of an exemplary embodiment of a downhole device configured as a selectable hole trimmer, showing a plurality of selectable hole cutters on the downhole device in a deactivated position.
Figure 15B:
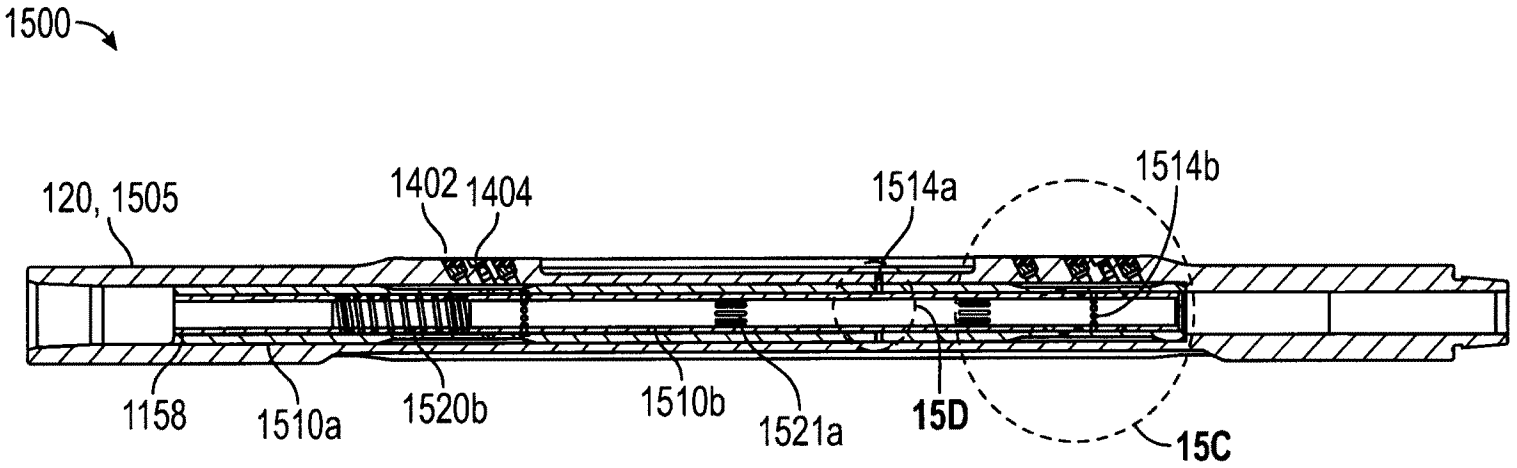
FIG. 15B shows a Section A-A cross-sectional view of the selectable hole trimmer of FIG. 15A, showing a deactivated cutter piston, a nozzle, a body, an intermediate sleeve, a sliding sleeve, a pressure equalization slot, and a return spring.
Figure 15C:
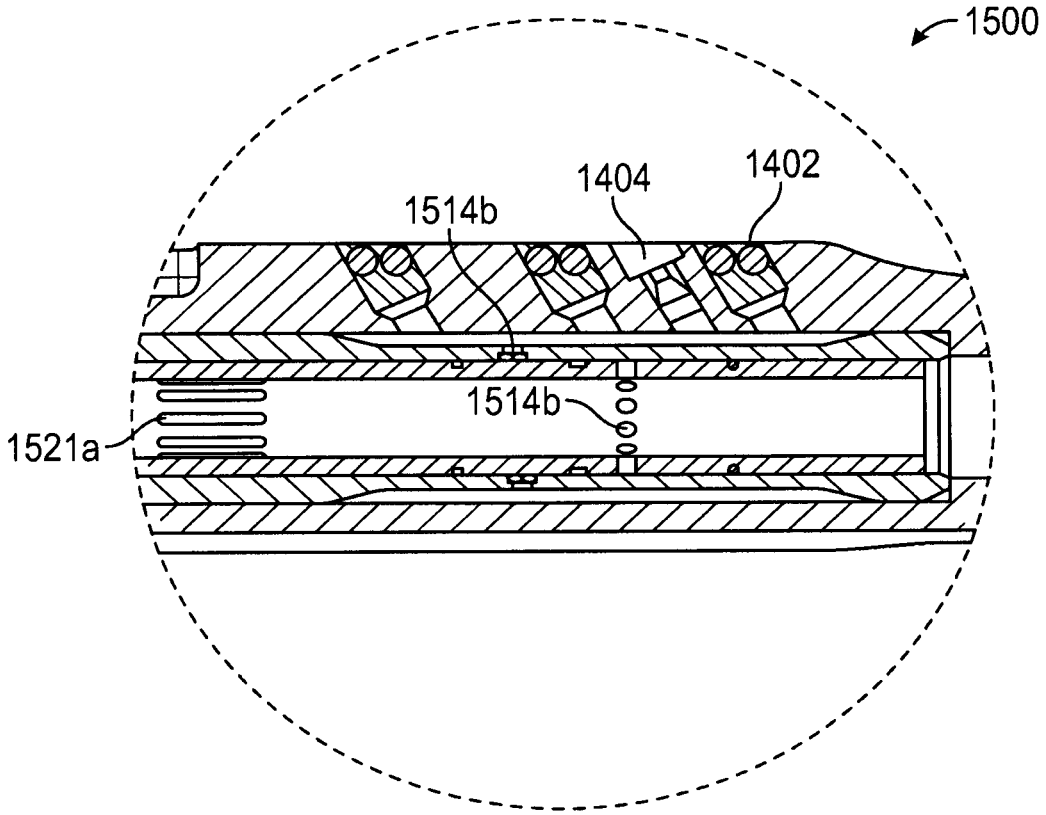
FIG. 15C shows a detailed B view of the selectable hole trimmer of FIG. 15A-15B, showing a deactivated cutter piston, a nozzle, an activation port and a pressure equalization slot.
Figure 15D:
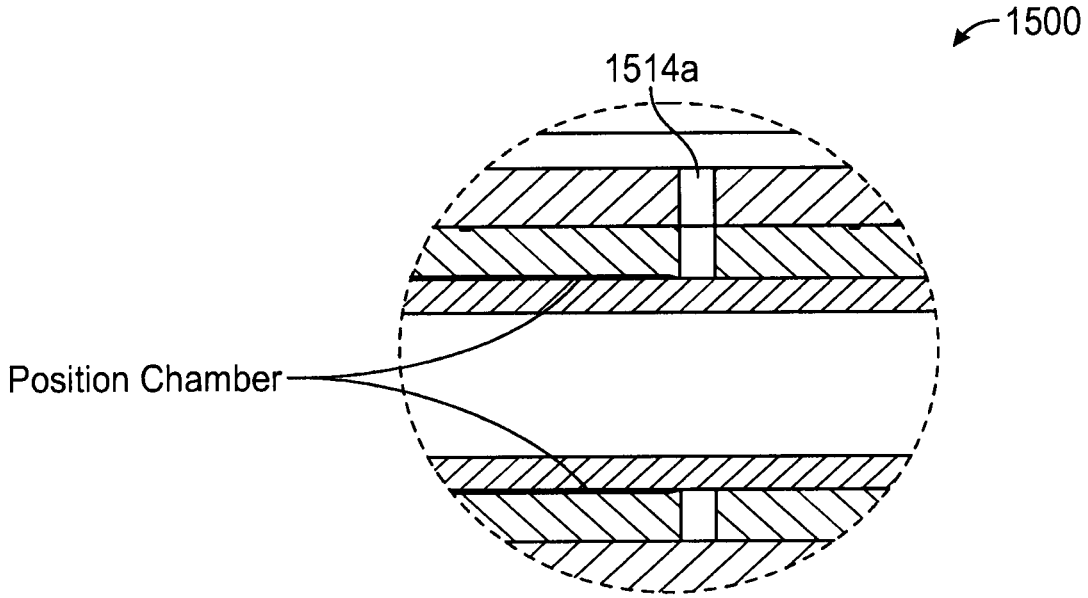
FIG. 15D shows a detailed C view of the selectable hole trimmer of FIG. 15A-15C, showing a hydraulic fluid port.
Figure 15E:
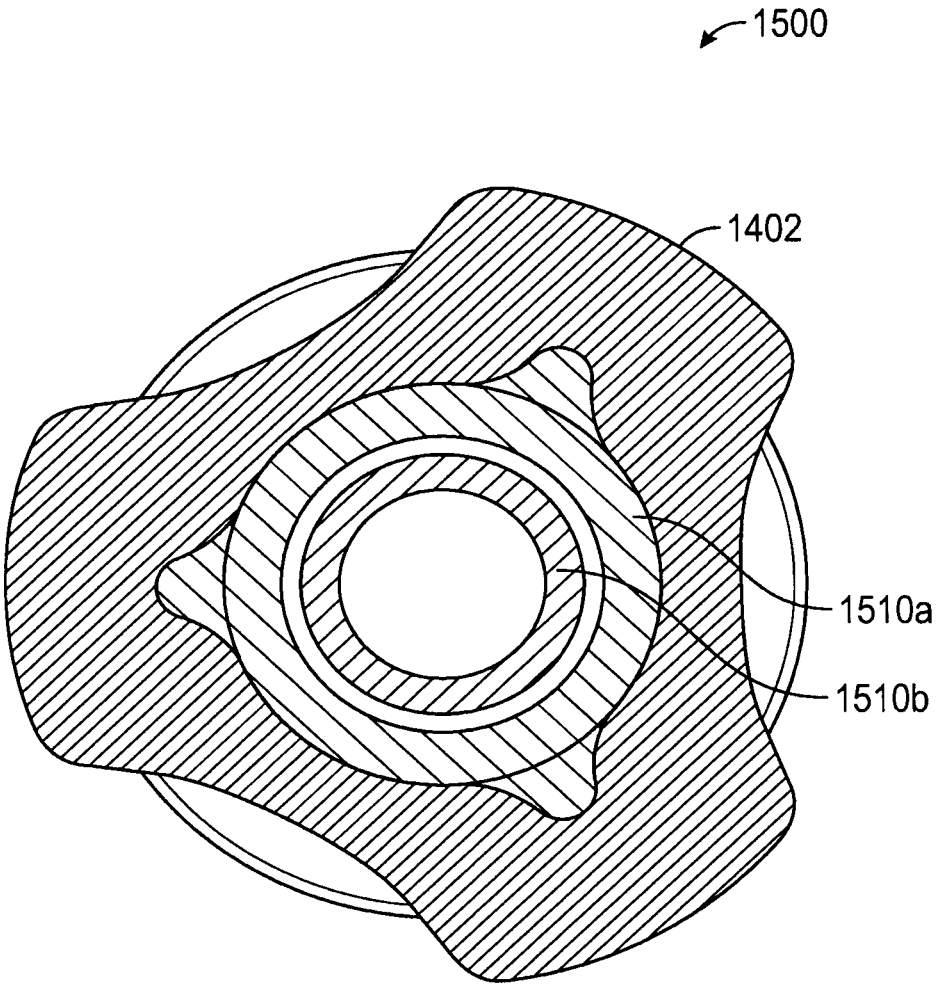
FIG. 15E shows a Section D-D cross-sectional view of the selectable hole trimmer of FIG. 15A-15D, showing a deactivated cutter piston, an intermediate sleeve, and a sliding sleeve.

FIG. 15A shows a view of an exemplary embodiment of the downhole device configured as a selectable hole trimmer 1500, showing a plurality of selectable hole cutters 1401 on the downhole device 1500 in a deactivated position; FIG. 15B shows a Section A-A cross-sectional view of the selectable hole trimmer 1500 of FIG. 15A, showing a deactivated cutter piston 1402, a nozzle 1404, a body 1505, an intermediate sleeve 1510*a*, a sliding sleeve 1510*b*, a pressure equalization slot 1521*a*, and a return spring 1520; FIG. 15C shows a detailed B view of the selectable hole trimmer 1500 of FIG. 15A-15B, showing a deactivated cutter piston 1402, a nozzle 1404, an activation port 1514*b* and a pressure equalization slot 1521*b*; FIG. 15D shows a detailed C view of the selectable hole trimmer 1500 of FIG. 15A-15C, showing a hydraulic fluid port 1514*a*; and FIG. 15E shows a Section D-D cross-sectional view of the selectable hole trimmer 1500 of FIG. 15A-15D, showing a deactivated cutter piston 1402, an intermediate sleeve 1510*a*, and a sliding sleeve 1510*b*.

Figure 16A:
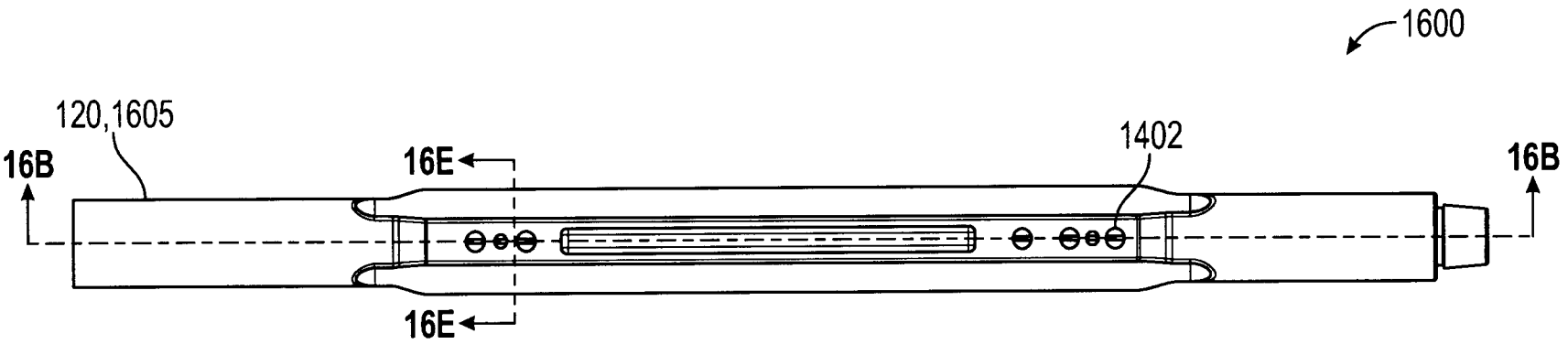
FIG. 16A shows a view of an exemplary embodiment of the downhole device configured as a selectable hole trimmer, showing a selectable hole cutter on the downhole device in an activated position.
Figure 16B:
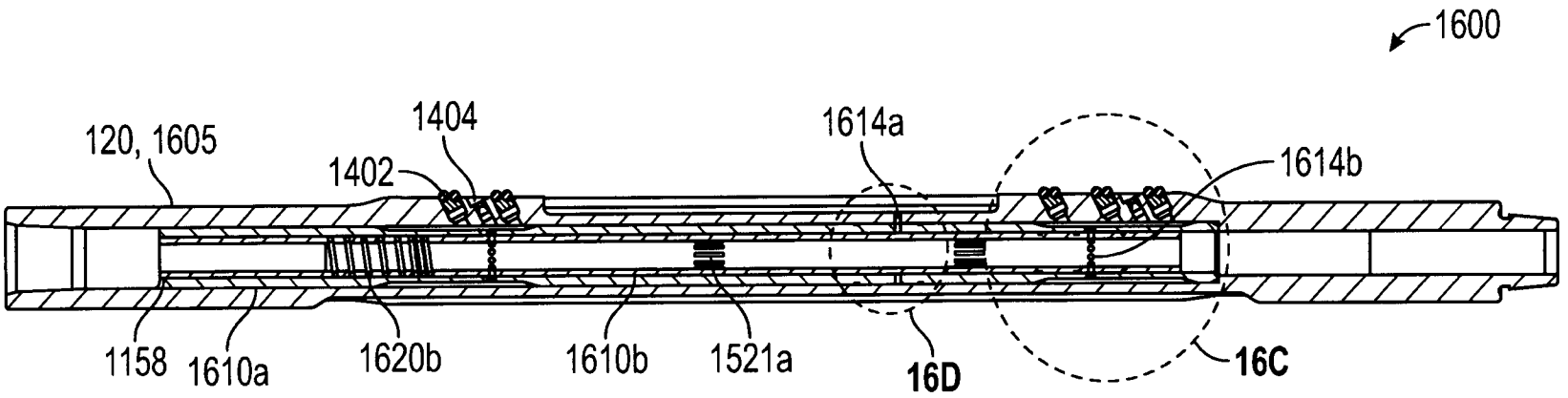
FIG. 16B shows a Section A-A cross-sectional view of the selectable hole trimmer of FIG. 16A, showing an activated cutter piston, a nozzle, a body, an intermediate sleeve, a sliding sleeve, a pressure equalization slot, and a return spring.
Figure 16C:
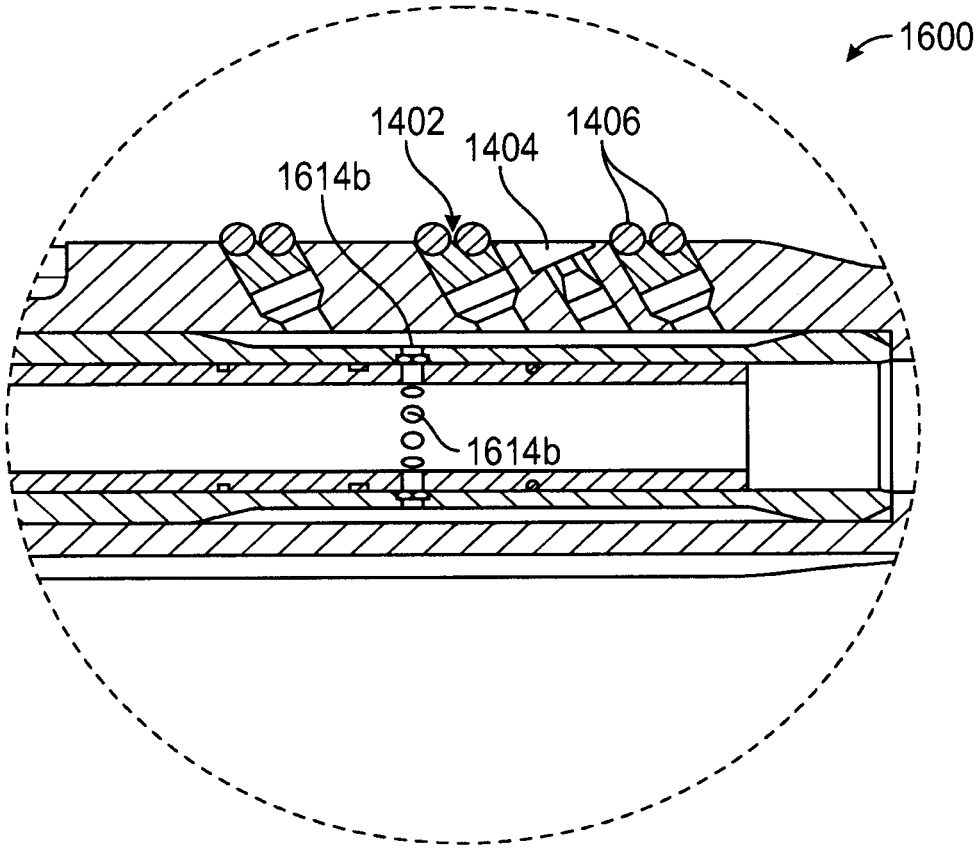
FIG. 16C shows a detailed B view of the selectable hole trimmer of FIG. 16A-16B, showing an activated cutter piston with an extended cutter, a nozzle, and an activation port.
Figure 16D:
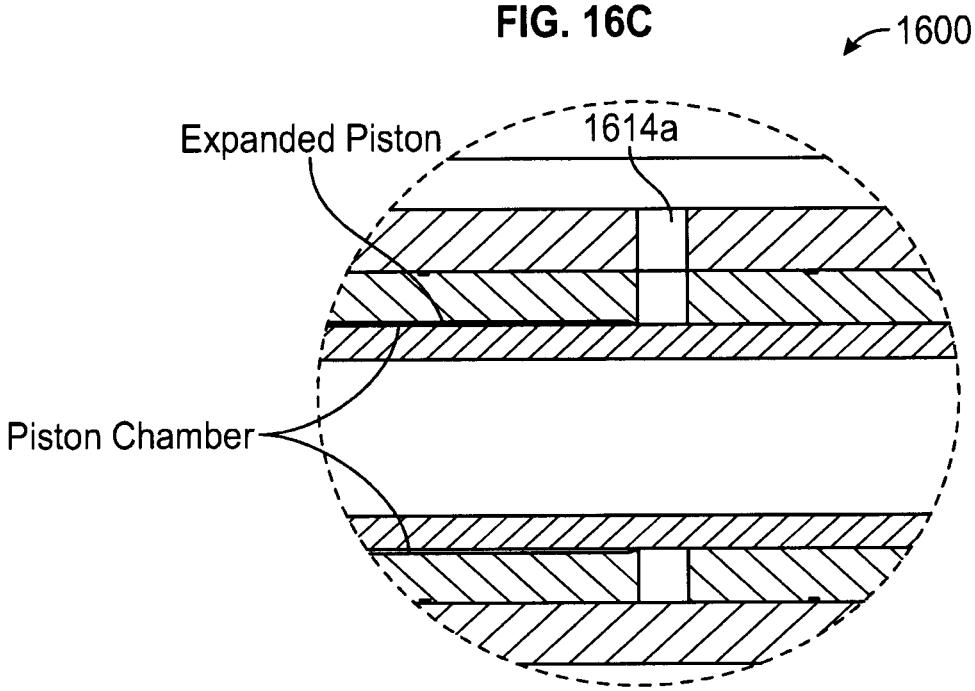
FIG. 16D shows a detailed C view of the selectable hole trimmer of FIG. 16A-16C, showing a hydraulic fluid port.
Figure 16E:
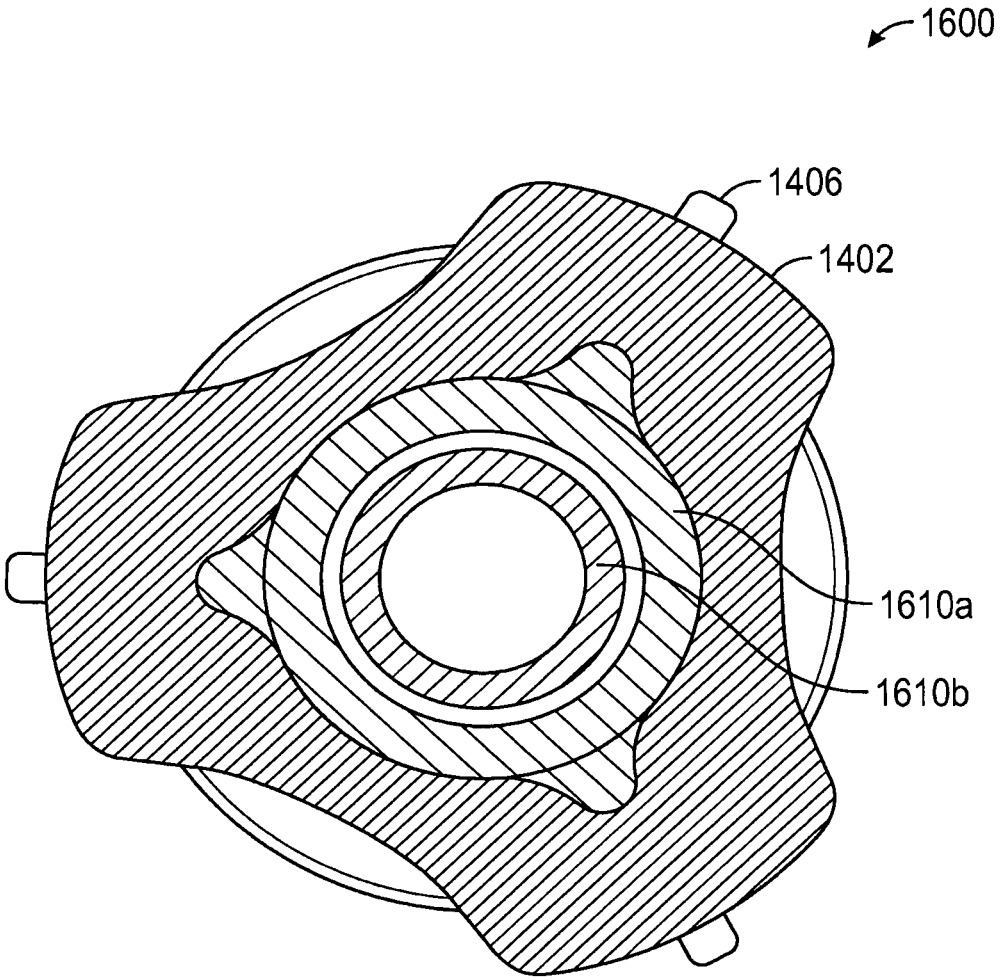
FIG. 16E shows a Section D-D cross-sectional view of the selectable hole trimmer of FIG. 16A-16D, showing an activated cutter piston with extended cutters, an intermediate sleeve, and a sliding sleeve.

FIG. 16A shows a view of an exemplary embodiment of the downhole device configured as a selectable hole trimmer 1600, showing the selectable hole cutter 1401 on the downhole device 1600 in an activated position; FIG. 16B shows a Section A-A cross-sectional view of the selectable hole trimmer 1600 of FIG. 16A, showing an activated cutter piston 1402, a nozzle 1404, a body 120, 1605, an intermediate sleeve 1610*a*, a sliding sleeve 1610*b*, a pressure equalization slot 1621*a*, and a return spring 1620*b*; FIG. 16C shows a detailed B view of the selectable hole trimmer 1600 of FIG. 16A-16B, showing an activated cutter piston 1402 with an extended cutter 1406, a nozzle 1404, and an activation port 1614*b*; FIG. 16D shows a detailed C view of the selectable hole trimmer 1600 of FIG. 16A-16C, showing a hydraulic fluid port 1614*a*; and FIG. 16E shows a Section D-D cross-sectional view of the selectable hole trimmer 1600 of FIG. 16A-16D, showing an activated cutter piston 1402 with extended cutters 1406, an intermediate sleeve 1610*a*, and a sliding sleeve 1610*b*.

Figure 19A:
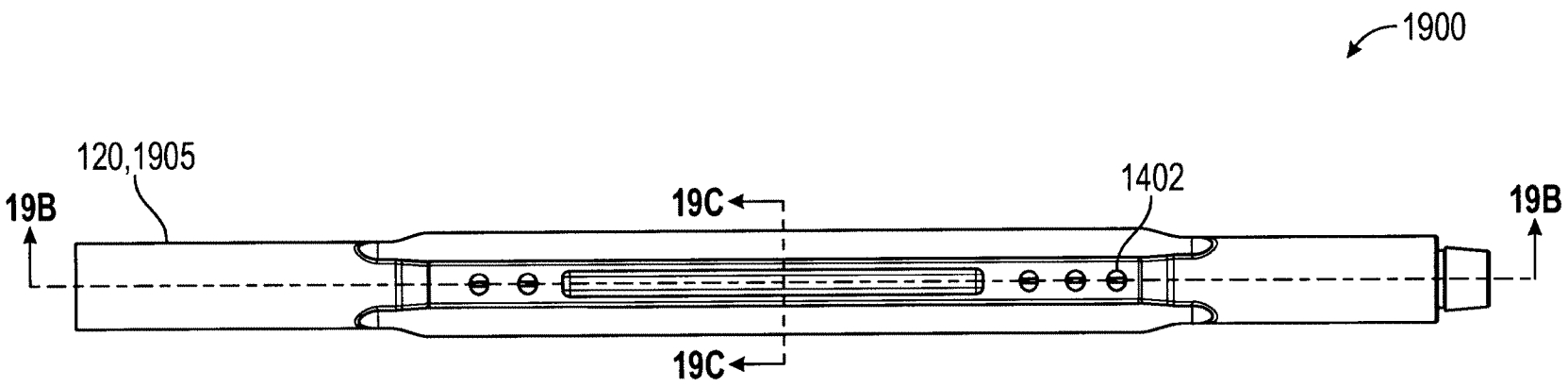
FIG. 19A shows a view of another exemplary embodiment of the downhole device configured as a selectable hole trimmer without any bypass nozzles, showing a selectable hole cutter on the downhole device in a deactivated position.
Figure 19B:
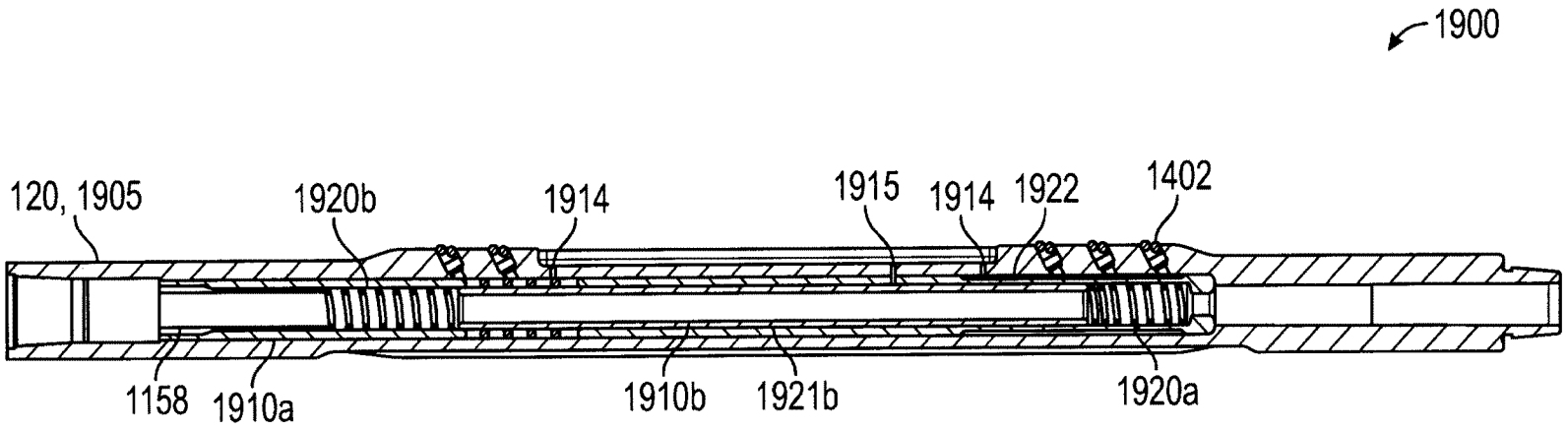
FIG. 19B shows a Section A-A cross-sectional view of the selectable hole trimmer of FIG. 19A, showing a deactivated cutter piston, body, an intermediate sleeve, a sliding sleeve, a hydraulic fluid port, a compensating spring, and a return spring.
Figure 19C:
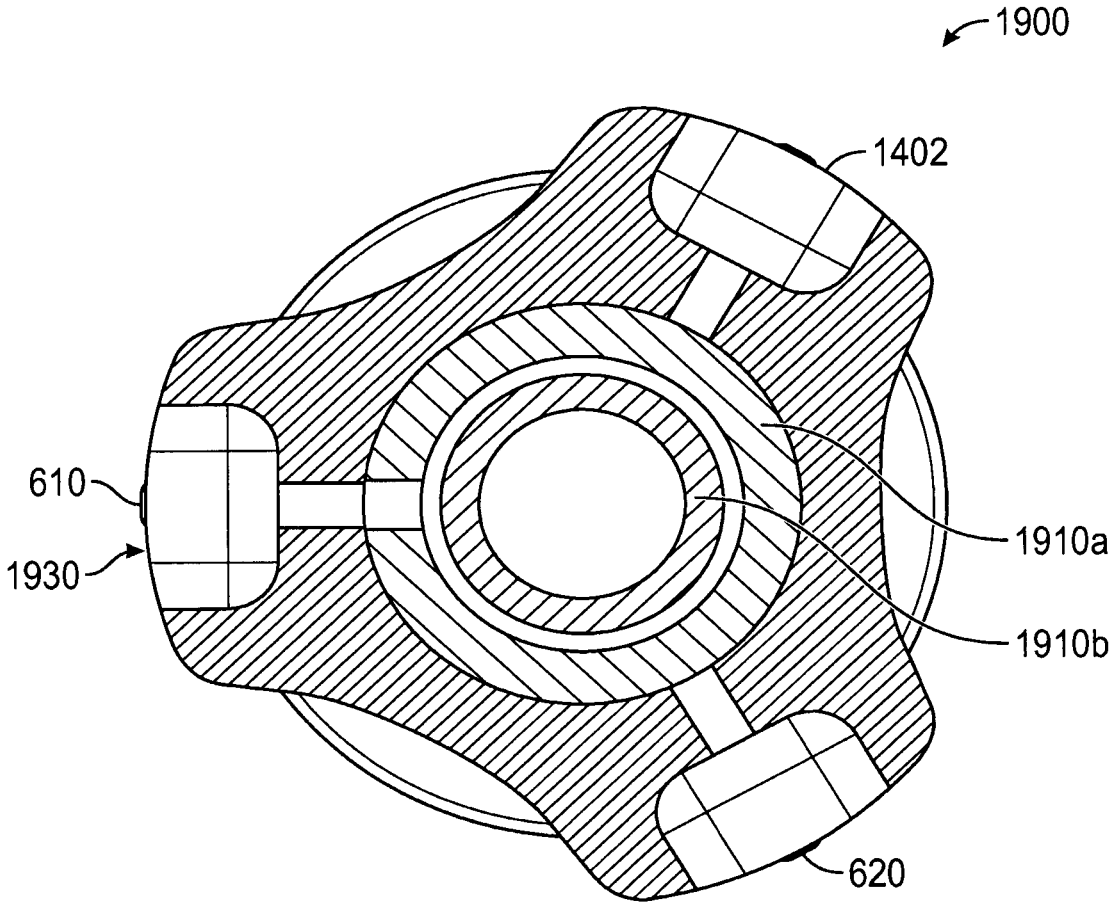
FIG. 19C shows a Section C-C cross-sectional view of the selectable hole trimmer of FIG. 19A-19B, showing an intermediate sleeve, and a sliding sleeve.

FIG. 19A shows a view of another exemplary embodiment of the downhole device configured as a selectable hole trimmer 1900 without any bypass nozzles, showing a selectable hole cutter 1401 on the downhole device 1900 in a deactivated position; FIG. 19B shows a Section A-A cross-sectional view of the selectable hole trimmer 1900 of FIG. 19A, showing a deactivated cutter piston 1402, a body 120, 1905, an intermediate sleeve 1910*a*, a sliding sleeve 1910*b*, a hydraulic fluid port 1914, a compensating spring 1920*a*, and a return spring 1920*b*; FIG. 19C shows a Section C-C cross-sectional view of the selectable hole trimmer 1900 of FIG. 19A-19B, showing an intermediate sleeve 1910*a*, and a sliding sleeve 1910*b*.

Figure 21A:
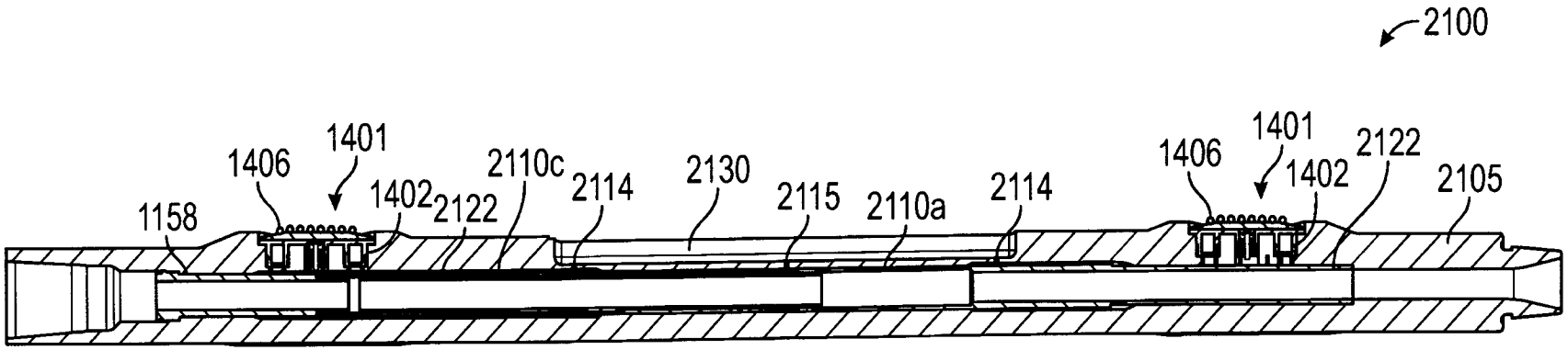
FIG. 21A shows a cross-sectional view of another exemplary embodiment of a downhole device configured as a selectable hole trimer, showing a selectable hole cutter on the downhole device in a deactivated position, an intermediate sleeve, a compensating sleeve, a hydraulic fluid port, a compensating port, and a stop block.
Figure 21B:
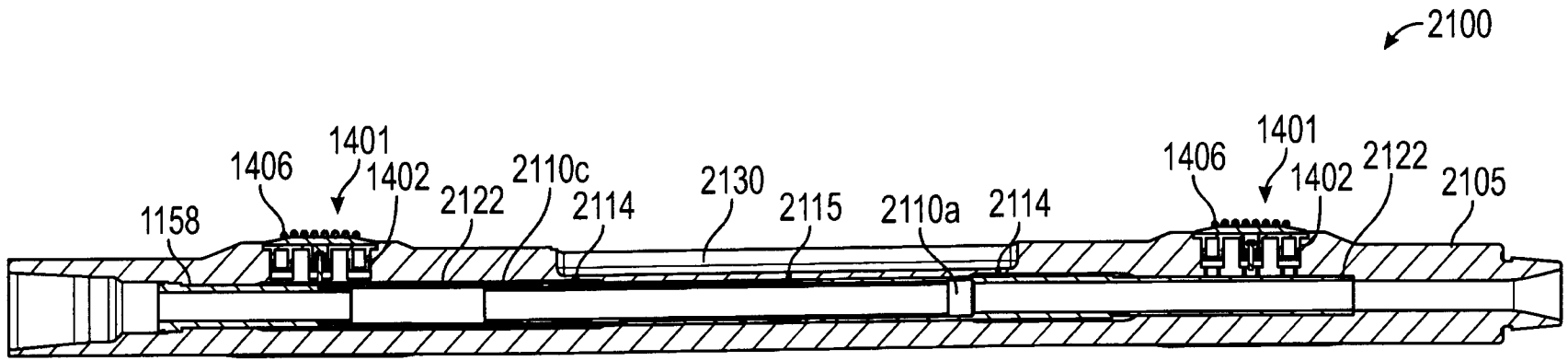
FIG. 21B shows a cross-sectional view of the selectable hole trimmer of FIG. 21A, showing an activated cutter piston with extended cutters, the intermediate sleeve, the compensating sleeve, the hydraulic fluid port, the compensating port, and the stop block.
Figure 21C:
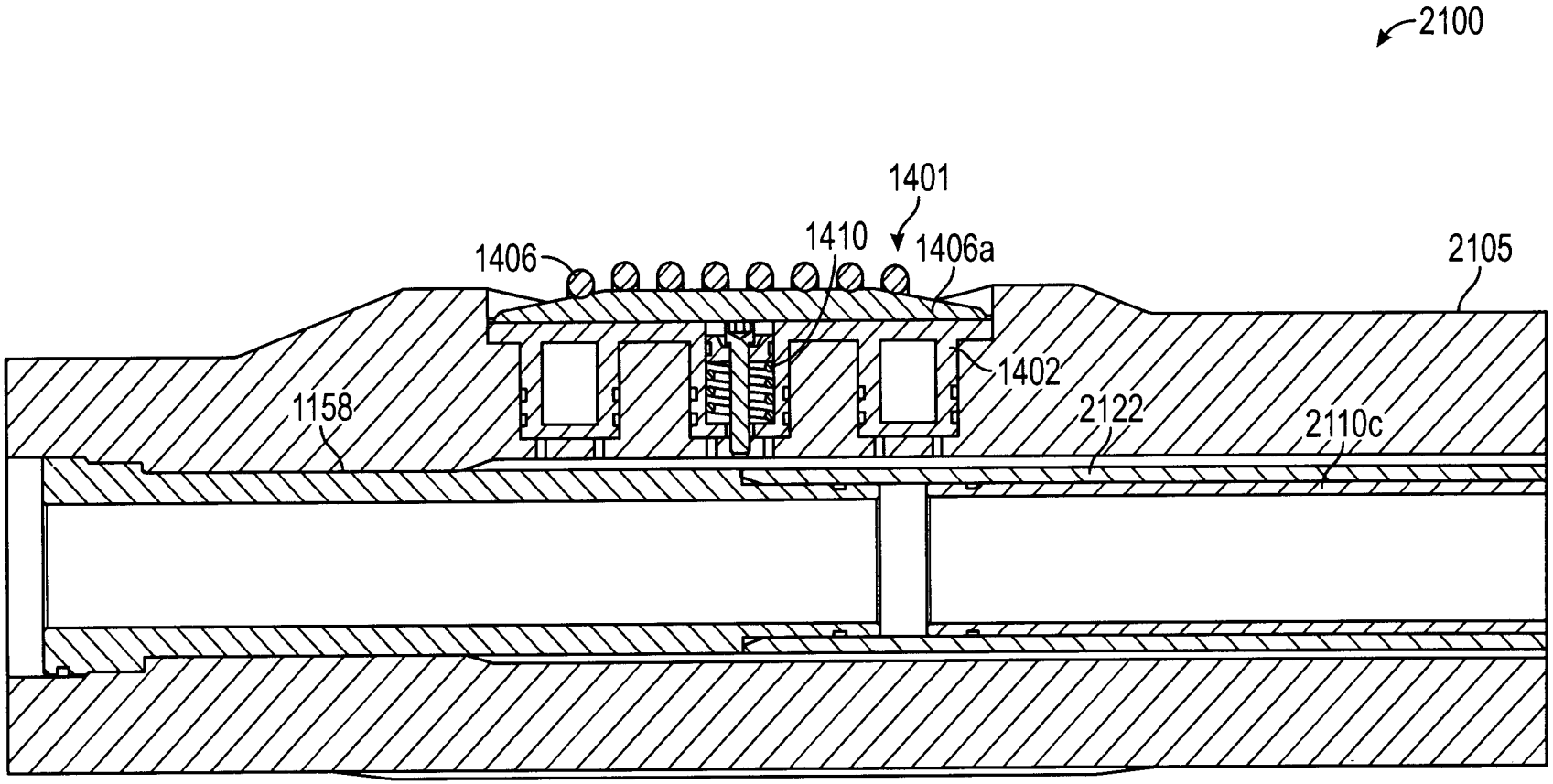
FIG. 21C shows a detailed cross-sectional view of the selectable hole trimmer of FIG. 21A, showing a deactivated cutter piston with retracted cutters, the compensating sleeve and the stop block.
Figure 21D:
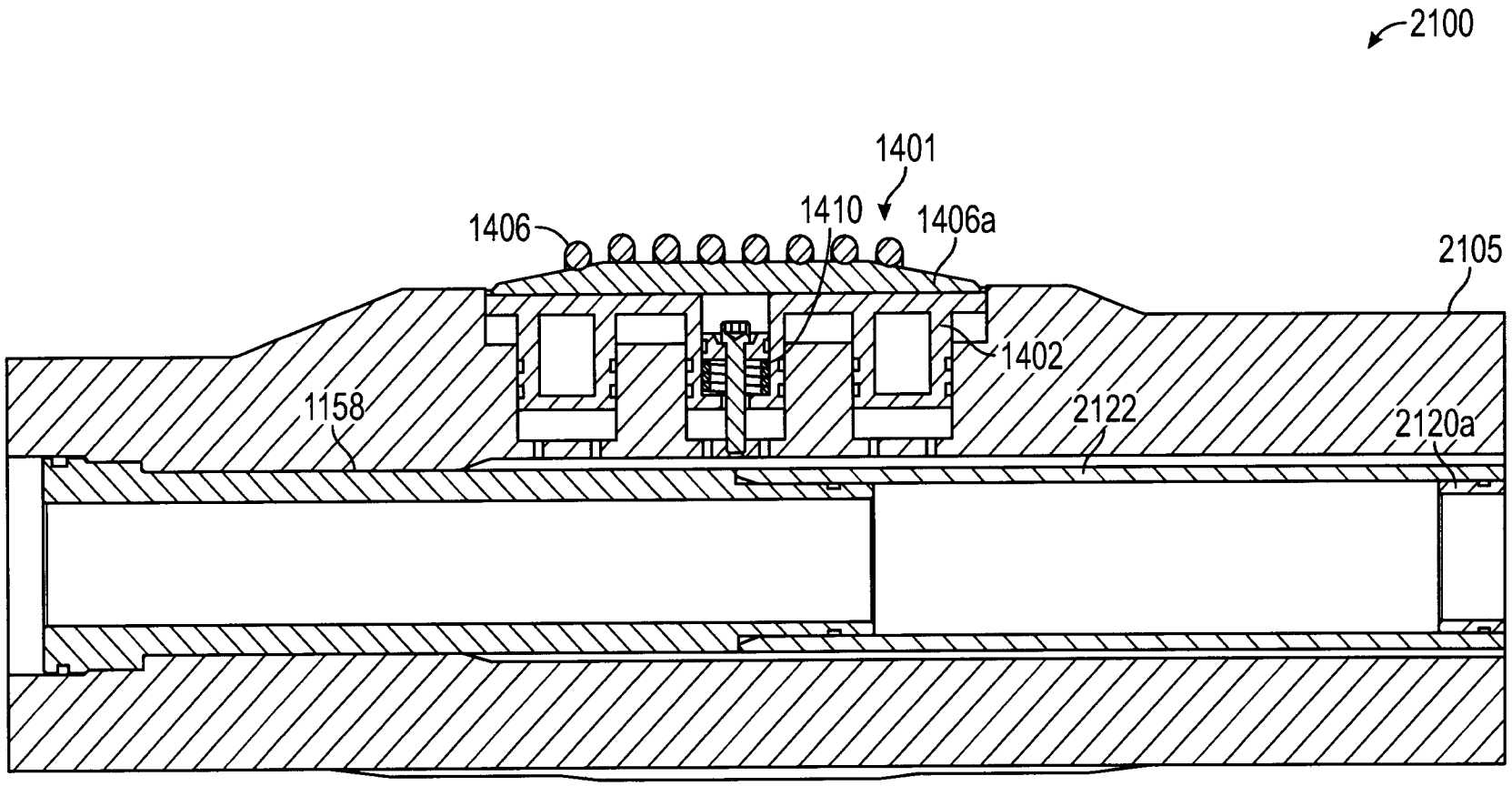
FIG. 21D shows a detailed cross-sectional view of the selectable hole trimmer of FIG. 21B, showing the activated cutter piston with extended cutters.
Figure 21E:
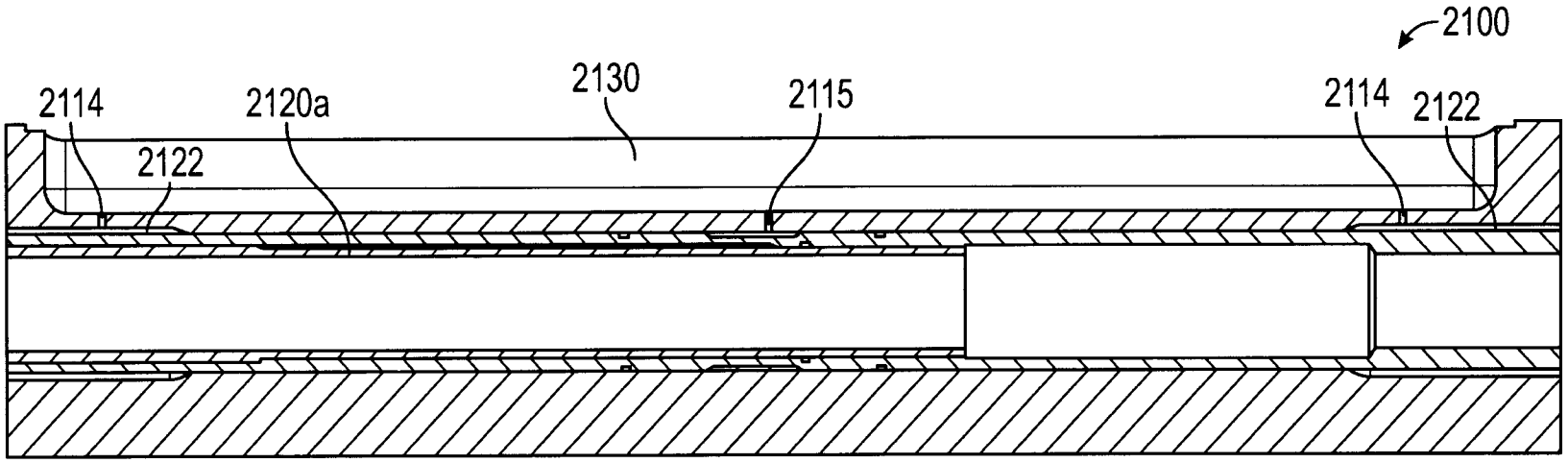
FIG. 21E shows a detailed cross-sectional view of the selectable hole trimmer of FIGS. 21A and 21C.
Figure 21F:
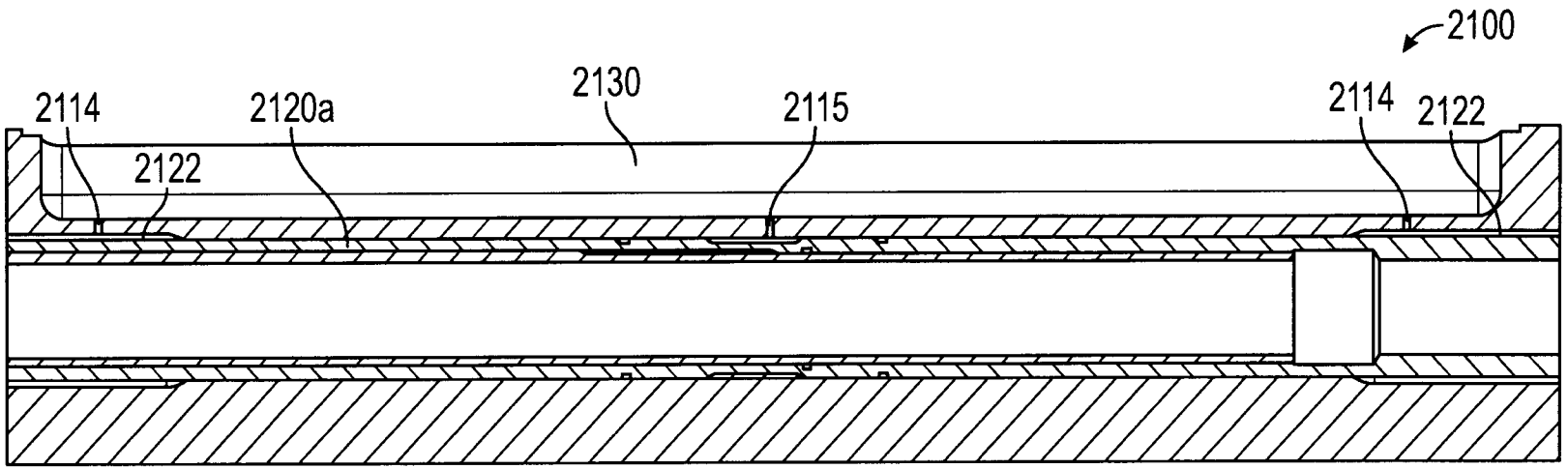
FIG. 21F shows a detailed view of the selectable hole trimmer of FIGS. 21B and 21D.
Figure 21G:
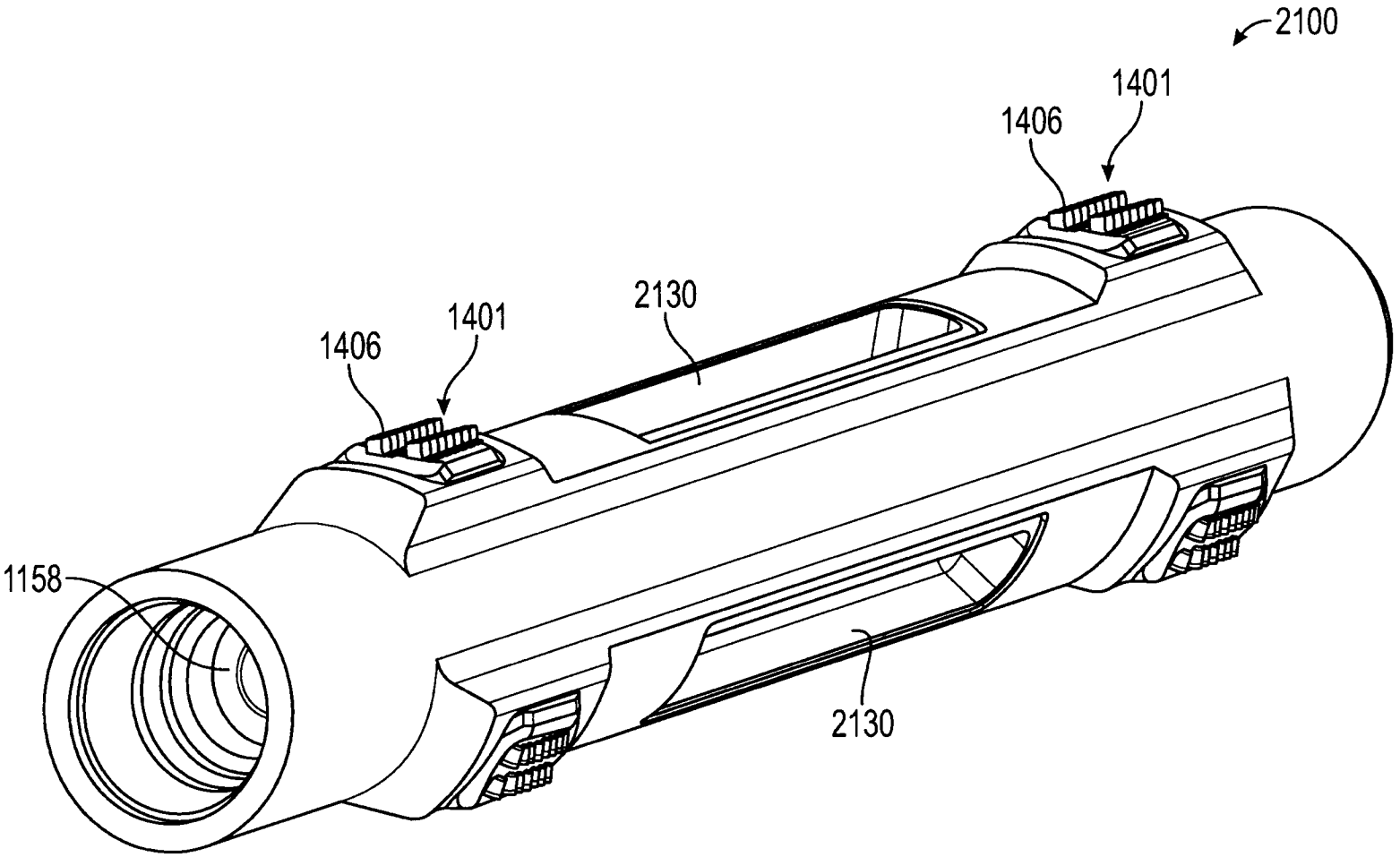
FIG. 21G shows an upper, left perspective view of the selectable hole trimmer of FIGS. 21A-21F, showing the activated cutter piston with extended cutters.

FIG. 21A shows a cross-sectional view of another exemplary embodiment of a downhole device configured as a selectable hole trimmer 2100, showing a selectable hole cutter 1401 on the downhole device 2100 in a deactivated position, an intermediate sleeve 2110*a*, compensating sleeve 2110*c*, a hydraulic fluid port 2114, compensating port 2115, and a stop block 1158; FIG. 21B shows a cross-sectional view of the exemplary selectable hole trimmer 2100 of FIG. 21A, showing an activated cutter piston 1402 with extended cutters 1406, the intermediate sleeve 2110*a*, the compensating sleeve 2110*c*, the hydraulic fluid port 2114, compensating port 2115, and the stop block 1158; FIG. 21C shows a detailed cross-sectional view of the exemplary selectable hole trimmer 2100 of FIG. 21A, showing a deactivated cutter piston 1402 with retracted cutters 1406, the compensating sleeve 2110*c* and the stop block 1158; FIG. 21D shows a detailed cross-sectional view of the exemplary selectable hole trimmer 2100 of FIG. 21B, showing the activated cutter piston 1402 with extended cutters 1406; FIG. 21E shows a detailed cross-sectional view of the exemplary hole trimmer 2100 of FIGS. 21A and 21C; FIG. 21F shows a detailed view of the exemplary hole trimmer 2100 of FIGS. 21B and 21D; and FIG. 21G shows an upper, left perspective view of the exemplary selectable hole trimmer 2100 of FIGS. 21A-21F, showing the activated cutter piston 1402 with extended cutters 1406.

FIGS. 14A, 15B, 16B, 19B and 21A-21B show a cross-sectional side view of an exemplary embodiment of the downhole device configured as a selectable hole trimmer 1400, 1500, 1600, 1900, 2100, showing a selectable hole cutter 1401. The selectable hole trimmer 1400, 1500, 1600, 1900, 2100 may be positioned at a desired location between the drill bit 132 and the ground 102. See e.g., FIG. 1. Other components or downhole devices may be installed or positioned between the selectable hole trimmer 1400, 1500, 1600, 1900, 2100 and the drill bit 132. Id.

In another embodiment, one or more selectable hole trimmers 1400, 1500, 1600, 1900, 2100 may be positioned at a desired locations between the drill bit 132 and the ground 102. See e.g., FIG. 1. Other components or downhole devices may be installed or positioned between the one or more selectable hole trimmers 1400, 1500, 1600, 1900, 2100 and the drill bit 132. Id.

The one or more selectable hole trimmers 1400, 1500, 1600, 1900, 2100 may be any suitable number without limitation. In an embodiment, the one or more selectable hole trimmers 1400, 1500, 1600, 1900, 2100 may be up to about 50 (and any range or value there between). In an embodiment, the one or more selectable hole trimmers 1400, 1500, 1600, 1900, 2200 may be up to about 20. In an embodiment, the one or more selectable hole trimmers 1400, 1500, 1600, 1900, 2100 may be about 10. In an embodiment, the one or more selectable hole trimmers 1400, 1500, 1600, 1900, 2100 may be about 3.

The one or more selectable hole trimmers 1400, 1500, 1600, 1900, 2100 may be separated by any suitable distance without limitation. In an embodiment, the one or more selectable hole trimmers 1400, 1500, 1600, 1900, 2100 may be separated by up to about 100-feet (and any range or value there between). In an embodiment, the one or more selectable hole trimmers 1400, 1500, 1600, 1900, 2100 may be separated by up to about 30-feet. In an embodiment, the one or more selectable hole trimmers 1400, 1500, 1600, 1900, 2100 may be separated by up to about 3-feet. In an embodiment, the one or more selectable hole trimmers 1400, 1500, 1600, 1900, 2100 may be separated by up to about 1-foot. In an embodiment, the one or more selectable hole trimmers 1400, 1500, 1600, 1900, 2100 may be separated by about 0-foot.

As shown in FIG. 14A, the selectable hole trimmer 1400 comprises a body 1405 as part of the drill string 120, a sleeve 310 sealingly slidable inside the body 120, 1405. See also FIGS. 1 & 3. The sleeve 310 may comprise at least one port 314 alignable with a corresponding bypass outlet 312 of the body 120, 1405. The bypass outlet 312 may comprise an erosion resistant nozzle 313. The selectable hole trimmer 1400 further comprises a resilient member 320 (e.g., a spring) biasing the sleeve 310 against the body 120, 1405. The selectable hole trimmer 1400 further comprises a three-way valve with an actuator 340 that is configured to provide a pressure to the sleeve 310. The actuator 340 can actuate the sleeve 310 to move relative to the body 120, 1405, such as to align the bypass outlet 312 with the port 314. The selectable hole trimmer 1400 also comprises a controller (e.g., the controller electronics 620 shown in FIG. 6, or implemented as the computer device 700 of FIG. 7 as discussed below) configured to operate the actuator 340 in response to a change of a monitored operation condition.

In some embodiments, the selectable hole trimmer 1400 would use information, measurements, and other received signals (electric or mechanical, such as pressure signals) to actuate the actuator 340. See also FIGS. 1 & 3. For example, the selectable hole trimmer 1400 may sense or measure the rotation rate in revolutions per minute ("rpm"), weight or pressure signals (e.g., related to well depth, length of drill string 120, and installed components) and control the actuator 340 in response to the measured signals.

Turning to FIG. 14A, the selectable hole trimmer 1400 may have a neutral position where the sleeve 310 is biased away from the bypass outlet 312. See also FIG. 3. As a result, the sleeve 310 forms a volume 322 with the body 120, 1405. Before actuation, the drill string inlet 334 communicates fluid or its pressure (or both) to the volume inlet 336. Since the drill string inlet 334 takes drilling mud from the bore of the drill string 120 and is fluidly connected to the volume inlet 336 via the three-way valve actuator 340, the sliding sleeve volume 322 would have the same fluid pressure as that of the drill string 120. This pressure of the sliding sleeve volume 322 would be equal to the pressure outside of the sleeve 310 and therefore the sleeve 310 is subject only to the spring 320 and in the neutral position.

In the illustrated embodiment, a lock ring 330 may further be used to define the neutral position, for example, to allow the spring 320 to statically push the sleeve 310 against the lock ring 330. See also FIG. 3.

Similar to the previous embodiment, the selectable hole trimmer 1400 comprises a body 1405 as part of the drill string 120, a sleeve 410 sealingly slidable inside the body 120, 1405. See also FIGS. 1 & 4. The sleeve 410 may comprise at least one port 414 alignable with a corresponding bypass outlet 412 of the body 120. The bypass outlet 412 may comprise an erosion resistant nozzle 413. The downhole device 210 further comprises a resilient member 420 (e.g., a spring) biasing the sleeve 410 against the body 120, 1405. The selectable hole trimmer 1400 further comprises a motor driven pump 440 (herein called motor pump) that is configured to provide a pressure to the sleeve 410. The motor pump 440 can actuate the sleeve 410 to move relative to the body 120, 1405, such as to align the bypass outlet 412 with the port 414.

The selectable hole trimmer 1400 may have a neutral position where the sleeve 410 is biased toward the bypass outlet 412 and the bypass port 414 is offset from the bypass outlet 412. The sleeve 410 is pushed by the spring 420 secured at a lock ring 430 toward the bypass outlet, forming a volume 422 with the body 120, 1405. The volume 422 is connected to the motor pump 440 via a motor pump fluid line 436. In this embodiment, the pressure of the drilling fluids in the selectable hole trimmer 1400 bore (or the drill string 120) may communicate with an accumulator/pressure compensation vessel 442 (the "accumulator" 442). The accumulator 442 may actuate the adjacent piston to pressurize the internal oil in its oil chamber to the same pressure as that of the downhole device 210 (i.e., pressure inside the drill string 120). The accumulator 442 and the motor pump 440 may both be housed in a radial housing 450 of the body 120, 1405.

FIG. 14B shows a detailed view of the selectable hole trimmer 1400 of FIG. 14A, showing a selectable hole cutter 1401. As shown in FIG. 14B, the selectable hole cutter 1401 has a cutter piston 1402 disposed within a container 1408 or cutout of a downhole device 1400.

In an embodiment, one or more cutter pistons 1402 may be affixed to the container 1408 or cutout of a downhole device 1400, 1500, 1600, 1900, 2100 via one or more fasteners. See e.g., FIGS. 21A-21D. Fasteners are well known in the art.

In an embodiment, one or more selectable hole cutters 1401 comprises one or more cutter pistons 1402. In an embodiment, the cutter piston 1402 has one or more cutters 1406 affixed to the cutter piston 1402.

In an embodiment, one or more selectable hole cutters 1401 comprises a cutter blade 1406*a* and one or more cutter pistons 1402. In an embodiment, the cutter blade 1406*a* has one or more cutter pistons 1402 affixed to the cutter blade 1406*a*. In an embodiment, the cutter blade 1406*a* has one or more cutters 1406 affixed to the cutter blade 1406*a*.

In an embodiment, the selectable hole trimmer 1400, 1500, 1600, 1900, 2100 may have one or more selectable hole cutters 1401 and one or more nozzles 1404. In an embodiment, the selectable hole trimmer 1400, 1500, 1600, 1900, 2100 may have one or more selectable hole cutters 1401 and one or more nozzles 1404 disposed between the one or more selective hole cutters 1401.

The cutter piston 1402 may be any suitable shape. For example, suitable shapes, include, but are not limited to, shapes having a round (e.g., cylindrical) or elliptical base. In an embodiment, the cutter piston 1402 may be a cylindrical shape having a first end 1402 and a second end 1402*b*. The first end 1402*a* may have a shoulder. The second end 1402*b* may have the one or more cutters 1406.

The cutter piston 1402 may be any suitable size, as space allows. In an embodiment, the cutter piston 1402 may be up to about 4-inches in diameter, and any range or value there between. In an embodiment, the cutter piston 1402 may be from about 1-inches to about 4-inches in diameter. In an embodiment, the cutter piston 1402 may be from about 1.5-inches to about 2-inches in diameter.

The shoulder of the cutter piston 1402 may be any suitable size to retain a compressed spring, as space allows.

The nozzle 1404 may be any suitable nozzle. For example, a suitable nozzle 1404 includes, but is not limited to, a carbide nozzle.

The nozzle 1404 may be any suitable size. In an embodiment, the nozzle 1404 may be up to about 1-inch diameter, and any range or value there between. In an embodiment, the nozzle 1404 may be up to about ½-inch diameter. In an embodiment, the nozzle 1404 may be ¼-inch diameter.

In an embodiment, the selectable hole cutter 1401 has a cutter piston 1402 having a first end 1402*a* and a second end 1402*b*. In an embodiment, the cutter piston 1402 has one or more cutters 1406 affixed to the second end 1402*b* of the cutter piston 1402, wherein the first end 1402*a* of the cutter piston 1402 is disposed within a container 1408 or a cutout of a downhole device 1400, 1500, 1600, 1900, 2100. See e.g., FIGS. 15B-15C, 16B-16C, 19B & 21A-21D.

In an embodiment, the selectable hole cutter 1401 has a cutter piston 1402 having a first end 1402*a* and a second end 1402*b* and one or more cutters 1406 affixed at or near the second end 1402*b* of the cutter piston 1402, wherein the first end 1402*a* of the cutter piston 1402 is disposed within a container 1408 or a cutout of a downhole device 1400, 1500, 1600, 1900, 2100. See e.g., FIGS. 15B-15C, 16B-16C, 19B & 21A-21D.

In an embodiment, one or more cutters 1406 may be affixed to the second end 1402*a* of the cutter piston 1402. In an embodiment, one or more cutters 1406 may be affixed at or near the second end 1402*a* of the cutter piston 1402.

The cutters 1406 may be any suitable cutter capable of and oriented to contact, and cut or gouge a side surface of a drilled hole 130. For example, suitable cutters 1406, include, but are not limited to, polycrystalline diamond compact (PDC) cutters, welded pads with tungsten carbide chunks, welded pads with tungsten carbide discs, and combinations thereof.

In an embodiment, the selectable hole cutter 1401 has a cutter piston 1402 having a first end 1402*a* and a second end 1402*b*, one or more cutters 1406 and one or more non-aggressive elements affixed at or near the second end 1402*b* of the cutter piston 1402, wherein the first end 1402*a* of the cutter piston 1402 is disposed within a container 1408 or a cutout of a downhole device 1400, 1500, 1600, 1900, 2100. See e.g., FIGS. 15B-15C, 16B-16C, 19B & 21A-21D.

In an embodiment, one or more cutters 1406 and one or more non-aggressive elements may be affixed to the second end 1402*a* of the cutter piston 1402. See e.g., FIGS. 15B-15C, 16B-16C and 19B. In an embodiment, one or more cutters 1406 and one or more non-aggressive elements may be affixed at or near the second end 1402*a* of the cutter piston 1402. Id.

In an embodiment, one or more cutters 1406 and one or more non-aggressive elements may be affixed to the second end 1402*a* of one or more cutter pistons 1402. See e.g., FIGS. 21A-21D. In an embodiment, one or more cutters 1406 and one or more non-aggressive elements may be affixed at or near the second end 1402*a* of one or more cutter pistons 1402. Id. In an embodiment, the one or more cutters 1406 and, in some embodiments, the one or more non-aggressive elements may be affixed to the second end of the one or more cutter pistons 1402 via fasteners, welds or other means. Id. Fasteners and welds are well known in the art.

The cutters 1406 may be any suitable cutter capable of and oriented to contact, and cut or gouge a side surface of a drilled hole 130. For example, suitable cutters 1406, include, but are not limited to, polycrystalline diamond compact (PDC) cutters, welded pads with tungsten carbide chunks, welded pads with tungsten carbide discs, and combinations thereof.

The non-aggressive elements may be any suitable elements capable of and oriented to contact, but not cut or gouge a side surface of the drilled hole 130. For example, suitable non-aggressive elements include, but are not limited to, PDC or carbide ovoids, welded and ground hardfacing, ground smooth carbide pads, welded smooth carbide pads, PDC cutters oriented parallel to the side surface of the drilled hole 130 to contact but not cut or gouge the surface, and combinations thereof.

The container 1408 or cutout of the selectable hole trimmer 1400, 1500, 1600, 1900, 2100 may be any suitable shape. For example, suitable shapes include, but are not limited to, shapes having a round (e.g., cylindrical) or elliptical base. In an embodiment, the container 1408 may be a cylindrical shape having a first end 1408*a* and a second end 1408*b*. The first end 1408*a* may be open. The second end 1408*b* may have an opening.

In an embodiment, a spring 1410 and a spacer 1412 are disposed between the cutter piston 1402 and the container 1408 or cutout.

In an embodiment, the spring 1410 may be any suitable spring capable of being disposed between the cutter piston 1402 and the container 1408 or cutout.

In an embodiment, the spacer 1412 may be any suitable shape capable of being disposed between the cutter piston 1402 and the container 1408 or cutout. For example, suitable shapes include, but are not limited to, shapes having a round (e.g., cylindrical) or elliptical base. In an embodiment, the spacer 1412 may be cylindrical shape having a first end 11412*a* and a second end 1412*b*. The first end 1412*a* may be open. The second end 1412*b* may be open.

In an embodiment, the spring 1410 is compressed against the shoulder of the cutter piston 1402 and held in a compressed position by a lock ring and a snap ring 1414.

In an embodiment, the lock ring and the snap ring 1414 may be any suitable lock ring and snap ring capable of holding the spring 1410 in a compressed position against a shoulder of the cutter piston 1402.

When one or more cutter pistons 1402 are deactivated, one or more springs 1410 retracts the one or more cutter pistons 1402 into one or more containers 1408 or cutouts. See e.g., FIG. 21A-21D.

When the one or more cutter pistons 1402 are activated, one or more spacers 1412 limit extension/travel of the one or more cutter pistons 1402 (and the one or more cutters 1406) out of the one or more containers 1408 or cutouts. See e.g., FIGS. 21A-21D.

When the one or more cutter pistons 1402 are activated, the one or more cutters 1406 may extend out of the one or more containers 1408 or cutouts, and contact, and cut or gouge a side surface of a drilled hole 130. See e.g., FIGS. 21A-21D.

When the one or more cutter pistons 1402 are activated, the one or more cutters 1406 and the one or more non-aggressive elements (not shown) may extend out of the one or more containers 1408 or cutouts, and contact, but not cut or gouge a side surface of the drilled hole 130. See e.g., FIGS. 21A-21D.

When the one or more cutter pistons 1402 are fully activated, the one or more cutters 1406 may extend or travel any suitable distance 1420 out of the one or more containers 1408 or cutouts. See e.g., FIGS. 21A-21D. When the one or more cutter pistons 1402 are fully activated, the one or more cutters 1406 may extend or travel any suitable distance 1420 out of the one or more containers 1408 or cutouts, as aggressiveness requires and space allows. In an embodiment, the one or more cutters 1406 may extend or travel up to about ½-inch. In an embodiment, the one or more cutters 1406 may extend or travel up to about ¼-inch. In an embodiment, the one or more cutters 1406 may extend or travel such that their diameter is about ¼-inch larger that the drill bit size.

When the one or more cutter pistons 1402 are fully activated, the one or more cutters 1406 and one or more non-aggressive elements may extend or travel any suitable distance 1420 out of the one or more containers 1408 or cutouts. See e.g., FIGS. 15B-15C, 16B-16C, 19B & 21A-21D. When the one or more cutter pistons 1402 are fully activated, the one or more cutters 1406 and one or more non-aggressive elements may extend or travel any suitable distance 1420 out of the one or more containers 1408 or cutouts, as aggressiveness requires and space allows. Id. In an embodiment, the one or more cutters 1406 and one or more non-aggressive elements may extend or travel up to about 1-inch, and any range or value there between. In an embodiment, the one or more cutters 1406 and one or more non-aggressive elements (not shown) may extend or travel up to about ½-inch. In an embodiment, the one or more cutters 1406 and one or more elements (not shown) may extend or travel such that their diameter is about ¼-inch larger that the drill bit size.

When the one or more cutter pistons 1402 are deactivated, one or more springs 1410 retract the one or more cutter pistons 1402 (and one or more cutters 1406) into the one or more containers 1408 or cutouts away from the side surface of the drilled hole 130. See e.g., FIGS. 15B-15C, 16B-16C, 19B & 21A-21D.

When the one or more cutter pistons 1402 are deactivated, the one or more springs 1410 retract the one or more cutter pistons 1402 (and one or more cutters 1406 and the one or more non-aggressive elements (not shown)) into the one or more containers 1408 or cutouts away from the side surface of the drilled hole 130. See e.g., FIGS. 15B-15C, 16B-16C, 19B & 21A-21D.

FIG. 14C shows a Section A cross-sectional view of the selectable hole trimmer 1400 of FIG. 14A, showing a plurality of selectable hole cutters 1401 and a plurality of nozzles 1404. See e.g., FIGS. 15B-15C, 16B-16C, 19B & 21A-21D. As shown in FIG. 14C, the selectable hole cutter 1401 may have a cutter piston 1402 disposed within a container 1408 or cutout of the downhole device 1400.

In these embodiments, the selectable hole trimmer 1400 comprises a selectable hole cutter 1401 and a nozzle 1404. See e.g., FIGS. 14A-14C.

In an embodiment, the selectable hole trimmer 1400, 1500, 1600, 1900, 2100 may have any suitable number of selectable hole cutters 1401, as space allows. In an embodiment, the selectable hole trimmer 1400, 1500, 1600, 1900, 2100 may have up to about 30 selectable hole cutters 1401, and any range or value there between. In an embodiment, the selectable hole trimmer 1400, 1500, 1600, 1900, 2100 may have up to about 20 selectable hole cutters 1401. In an embodiment, the selectable hole trimmer 1400, 1500, 1600, 1900, 2100 may have up to about 10 selectable hole cutters 1401. In an embodiment, the selectable hole trimmer 1400, 1500, 1600, 1900, 2100 may have up to about 3 selectable hole cutters 1401.

In an embodiment, the selectable hole trimmer 1400, 1500, 1600, 1900, 2100 may have any suitable number of nozzles 1404, as space allows. In an embodiment, the selectable hole trimmer 1400, 1500, 1600, 1900, 2100 may have up to about 30 nozzles 1404, and an range or value there between. In an embodiment, the selectable hole trimmer 1400, 1500, 1600, 1900, 2100 may have up to about 20 nozzles 1404. In an embodiment, the selectable hole trimmer 1400, 1500, 1600, 1900, 2100 may have up to about 10 nozzles 1404. In an embodiment, the selectable hole trimmer 1400, 1500, 1600, 1900, 2100 may have up to about 3 nozzles 1404.

In an embodiment, the selectable hole trimmer 1400, 1500, 1600, 1900, 2100 comprises a first plurality of selectable hole cutters 1401*a* separated by any suitable radial distance 1416*a*. In an embodiment, the first plurality of selectable hole cutters 1401*a* may be separated by any suitable radial distance 1416*a* around a circumference of the selectable hole trimmer 1400, 1500, 1600, 1900, 2100, as space allows. In an embodiment, the first plurality of selectable hole cutters 1401*a* may be separated by an approximately equal radial distance 1416*a* around a circumference of the selectable hole trimmer 1400, 1500, 1600, 1900, 2100, as space allows. For example, if the first plurality of selectable hole cutters 1401*a* is 3 selectable hole cutters 1401, the 3 selectable hole cutters 1401 may be separated by about 120 degrees around the circumference of the selectable hole trimmer 1400, 1500, 1600, 1900, 2100.

In an embodiment, the selectable hole trimmer 1400, 1500, 1600, 1900, 2100 comprises a second plurality of selectable hole cutters 1401*b* separated by a longitudinal distance 1718*a*, 1618*a* along an axial length of the selectable hole trimmer 1400, 1500, 1600, 1900, 2100. See e.g., FIG. 17-18. In an embodiment, the second plurality of selectable hole cutters 1401*b* may be separated by any suitable longitudinal distance 1718*a*, 1618*a* along an axial length of the selectable hole trimmer 1400, 1500, 1600, 1900, 2100, as space allows. Id. In an embodiment, the second plurality of selectable hole cutters 1401*b* may be separated by up to about 30-inches, and any range or value there between. In an embodiment, the second plurality of selectable hole cutters 1401*b* may be separated by up to about 20-inches. In an embodiment, the second plurality of selectable hole cutters 1401*b* may be separated by up to about 10-inches. In an embodiment, the second plurality of selectable hole cutters 1401*b* may be separated by up to about 6-inches.

In an embodiment, the selectable hole trimmer 1400, 1500, 1600, 1900, 2100 comprises a first plurality of nozzles 1404*a*, 1704*a*, 1804*a* separated by any suitable radial distance 1416*b*. See e.g., FIGS. 17-18. In an embodiment, the first plurality of nozzles 1404*a*, 1704*a*, 1804*a* may be separated by any suitable radial distance 1716*a* around a circumference of the selectable hole trimmer 1400, 1500, 1600, 1900, 2100, as space allows. Id. In an embodiment, the first plurality of nozzles 1404*a*, 1704*a*, 1804*a* may be separated by an approximately equal radial distance 1716*a* around a circumference of the selectable hole trimmer 1400, 1500, 1600, 1900, 2100. Id. For example, if the first plurality of nozzles 1404*a*, 1704*a*, 1804*a* is 3 nozzles 1704, 1804, the 3 nozzles 1704, 1804 may be separated by about 120 degrees around the circumference of the selectable hole trimmer 1400, 1500, 1600, 1900, 2100. Id.

In an embodiment, the selectable hole trimmer 1400, 1500, 1600, 1900, 2100 comprises a second plurality of nozzles 1404*b* separated by a longitudinal distance 1718*b*, 1618*b* along an axial length of the selectable hole trimmer 1400, 1500, 1600, 1900, 2100. See e.g., FIGS. 17-18. In an embodiment, the second plurality of nozzles 1404*b* may be separated by any suitable longitudinal distance 1718*b*, 1618*b* along an axial length of the selectable hole trimmer 1400, 1500, 1600, 1900, 2100, as space allows. Id. In an embodiment, the second plurality of nozzles 1404*b* may be separated by up to about 30-inches, and any range or value there between. In an embodiment, the second plurality of nozzles 1404*b* may be separated by up to about 20-inches. In an embodiment, the second plurality of nozzles 1404*b* may be separated by up to about 10-inches. In an embodiment, the second plurality of nozzles 1404*b* may be separated by up to about 6-inches.

Figure 17:
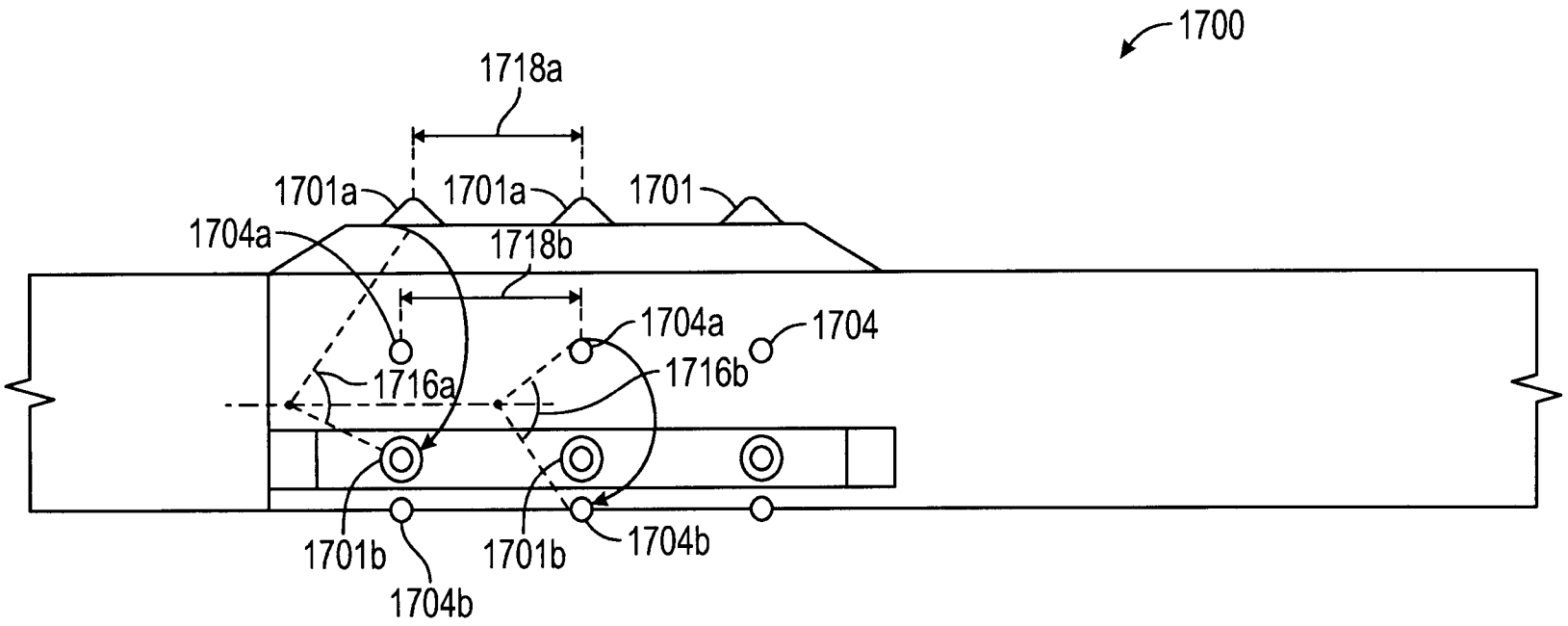
FIG. 17 shows a view of an exemplary embodiment of a selectable hole trimmer configured as a linear optimizing tool, showing a linear configuration.

FIG. 17 shows a view of an exemplary selectable hole trimmer 1400, 1500, 1600, 1900, 2100 configured as a linear optimizer tool 1700, showing a linear configuration. As shown in FIG. 17, the linear optimizer tool 1700 has a plurality of selectable hole cutters 1401, 1701 and a plurality of nozzles 1404, 1704.

In an embodiment, the linear optimizer tool 1700 may have any suitable number of selectable hole cutters 1401, 1701 in a linear configuration, as space allows. In an embodiment, the linear optimizer tool 1700 may have up to about 30 selectable hole cutters 1401, 1701 in a linear configuration, and any range or value there between. In an embodiment, the linear optimizer tool 1700 may have up to about 20 selectable hole cutters 1401, 1701 in a linear configuration. In an embodiment, the linear optimizer tool 1700 may have up to about 10 selectable hole cutters 1401, 1701 in a linear configuration. In an embodiment, the linear optimizer tool 1700 may have up to about 3 selectable hole cutters 1401, 1701 in a linear configuration. See e.g., FIG. 17.

In an embodiment, the linear optimizer tool 1700 may have any suitable number of nozzles 1404, 1704 in a linear configuration, as space allows. In an embodiment, the linear optimizer tool 1700 may have up to about 30 nozzles 1404, 1704 in a linear configuration, and any range or value there between. In an embodiment, the linear optimizer tool 1700 may have up to about 20 nozzles 1404, 1704 in a linear configuration, and any range or value there between. In an embodiment, the linear optimizer tool 1700 may have up to about 10 nozzles 1404, 1704 in a linear configuration. In an embodiment, the linear optimizer tool 1700 may have up to about 3 nozzles 1404, 1704 in a linear configuration. See e.g., FIG. 17.

In an embodiment, the linear optimizer tool 1700 comprises a first plurality of selectable hole cutters 1401*a*, 1701*a* separated by any suitable radial distance 1416*a*, 1716*a*. In an embodiment, the first plurality of selectable hole cutters 1401*a*, 1701*a* may be separated by any suitable radial distance 1416*a*, 1716*a* around a circumference of the linear optimizer tool 1700, as space allows. In an embodiment, the first plurality of selectable hole cutters 1401*a*, 1701*a* may be separated by an approximately equal radial distance 1416*a*, 1716*a* around a circumference of the linear optimizer tool 1700. For example, if the first plurality of selectable hole cutters 1401*a*, 1701*a* is 3 selectable hole cutters 1401, 1701, the 3 selectable hole cutters 1401, 1701 may be separated by about 120 degrees around the circumference of the linear optimizer tool 1700.

In an embodiment, the linear optimizer tool 1700 comprises a second plurality of selectable hole cutters 1401*b*, 1701*b* separated by a longitudinal distance 1718*a* along an axial length of the linear optimizer tool 1700 in a linear configuration. In an embodiment, the second plurality of selectable hole cutters 1401*b*, 1701*b* may be separated by any suitable longitudinal distance 1718*a* along an axial length of the linear optimizer tool 1700 in a linear configuration, as space allows. In an embodiment, the second plurality of selectable hole cutters 1401*b*, 1701*b* may be separated by up to about 30-inches in a linear configuration, and any range or value there between. In an embodiment, the second plurality of selectable hole cutters 1401*b*, 1701*b* may be separated by up to about 20-inches in a linear configuration. In an embodiment, the second plurality of selectable hole cutters 1401*b*, 1701*b* may be separated from about 10-inches in a linear configuration. In an embodiment, the second plurality of selectable hole cutters 1401*b*, 1701*b* may be separated by about 6-inches in a linear configuration.

In an embodiment, the linear optimizer tool 1700 comprises a first plurality of nozzles 1404*a*, 1704*a* separated by any suitable radial distance 1416*b*, 1716*b*. In an embodiment, the first plurality of nozzles 1404*a*, 1704*a* may be separated by any suitable radial distance 1416*a*, 1716*a* around a circumference of the linear optimizer tool 1700, as space allows. In an embodiment, the first plurality of nozzles 1404*a*, 1704*a* may be separated by an approximately equal radial distance 1416*a*, 1716*a* around a circumference of the linear optimizer tool 1700. For example, if the first plurality of nozzles 1404*a*, 1704*a* is three nozzles 1404, 1704, the three nozzles 1404, 1704 may be separated by about 120 degrees around the circumference of the linear optimizer tool 1700.

In an embodiment, the linear optimizer tool 1700 comprises a second plurality of nozzles 1404*b*, 1704*b* separated by a longitudinal distance 1718*b* along an axial length of the linear optimizer tool 1700 in a linear configuration. In an embodiment, the second plurality of nozzles 1404*b*, 1704*b* may be separated by any suitable longitudinal distance 1718*b* along an axial length of the linear optimizer tool 1700 in a linear configuration, as space allows. In an embodiment, the second plurality of nozzles 1404*b*, 1704*b* may be separated by up to about 30-inches in a linear configuration, and range or value there between. In an embodiment, the second plurality of nozzles 1404*b*, 1704*b* may be separated by up to about 20-inches in a linear configuration. In an embodiment, the second plurality of nozzles 1404*b*, 1704*b* may be separated by up to about 10-inches in a linear configuration. In an embodiment, the second plurality of nozzles 1404*b*, 1704*b* may be separated by up to about 6-inches in a linear configuration.

Figure 18:
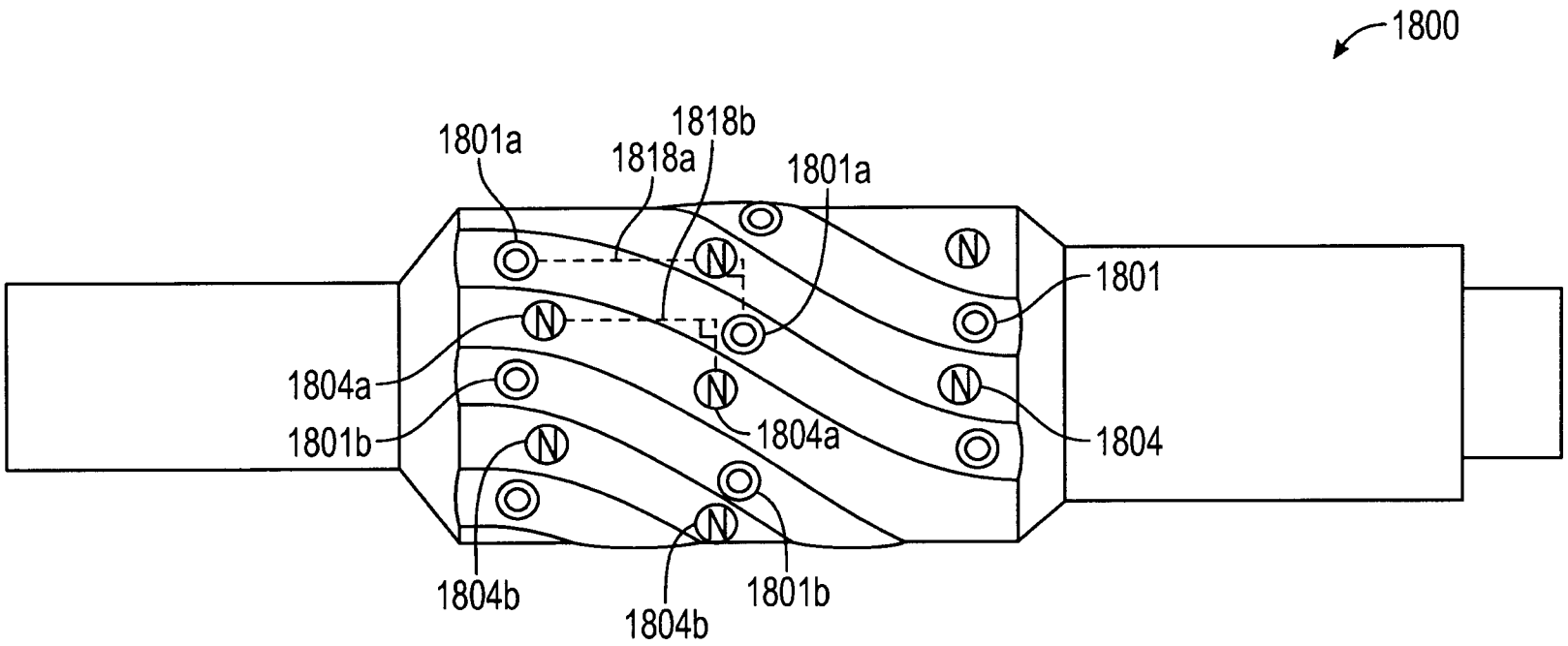
FIG. 18 shows a view of an exemplary embodiment of a selectable hole trimmer configured as a spiral optimizing tool, showing a spiral configuration.

FIG. 18 shows a view of an exemplary selectable hole trimmer 1400, 1500, 1600, 1900, 2100 configured as a spiral optimizer tool 1800, showing a spiral configuration. As shown in FIG. 18, the spiral optimizer tool 1800 has a plurality of selectable hole cutters 1401, 1801 and a plurality of nozzles 1404, 1804.

In an embodiment, the spiral optimizer tool 1800 may have any suitable number of selectable hole cutters 1401, 1801 in a spiral configuration, as space allows. In an embodiment, the spiral optimizer tool 1800 may have up to about 30 selectable hole cutters 1401, 1801 in a spiral configuration, and any range or value there between. In an embodiment, the spiral optimizer tool 1800 may have up to about 20 selectable hole cutters 1401, 1801 in a spiral configuration. In an embodiment, the spiral optimizer tool 1800 may have up to about 10 selectable hole cutters 1401, 1801 in a spiral configuration. In an embodiment, the spiral optimizer tool 1800 may have up to about 3 selectable hole cutters 1401, 1801 in a spiral configuration. See e.g., FIG. 18.

In an embodiment, the spiral optimizer tool 1800 may have any suitable number of nozzles 1404, 1804 in a spiral configuration, as space allows. In an embodiment, the spiral optimizer tool 1800 may have up to about 30 nozzles 1404, 1804 in a spiral configuration, and any range or value there between. In an embodiment, the spiral optimizer tool 1800 may have up to about 20 nozzles 1404, 1804 in a spiral configuration. In an embodiment, the spiral optimizer tool 1800 may have up to about 10 nozzles 1404, 1804 in a spiral configuration. In an embodiment, the spiral optimizer tool 1800 may have up to about 3 nozzles 1404, 1804 in a spiral configuration. See e.g., FIG. 18.

In an embodiment, the spiral optimizer tool 1800 comprises a first plurality of selectable hole cutters 1401*a*, 1801*a* separated by any suitable radial distance 1416*a*, 1716*a*. In an embodiment, the first plurality of selectable hole cutters 1401*a*, 1801*a* may be separated by any suitable radial distance 1416*a*, 1716*a* around a circumference of the spiral optimizer tool 1800, as space allows. In an embodiment, the first plurality of selectable hole cutters 1401*a*, 1801*a* may be separated by an approximately equal radial distance 1416*a*, 1716*a* around a circumference of the spiral optimizer tool 1800. For example, if the first plurality of selectable hole cutters 1401*a*, 1801*a* is three selectable hole cutters 1401, 1801, the three selectable hole cutters 1401, 1801 may be separated by about 120 degrees around the circumference of the spiral optimizer tool 1800.

In an embodiment, the spiral optimizer tool 1800 comprises a second plurality of selectable hole cutters 1401*b*, 1801*b* separated by a longitudinal distance 1818*a* along an axial length of the spiral optimizer tool 1800 in a spiral configuration. In an embodiment, the second plurality of selectable hole cutters 1401*b*, 1801*b* may be separated by any suitable longitudinal distance 1818*a* along an axial length of the spiral optimizer tool 1800 in a spiral configuration, as space allows. In an embodiment, the second plurality of selectable hole cutters 1401*b*, 1801*b* may be separated by up to about 30-inches in a spiral configuration, and any range or value there between. In an embodiment, the second plurality of selectable hole cutters 1401*b*, 1801*b* may be separated by up to about 20-inches in a spiral configuration. In an embodiment, the second plurality of selectable hole cutters 1401*b*, 1801*b* may be separated by up to about 10-inches in a spiral configuration. In an embodiment, the second plurality of selectable hole cutters 1401*b*, 1801*b* may be separated by up to about 6-inches in a spiral configuration.

In an embodiment, the spiral optimizer tool 1800 comprises a first plurality of nozzles 1404*a*, 1804*a* separated by any suitable radial distance 1416*b*, 1716*b*. In an embodiment, the first plurality of nozzles 1404*a*, 1804*a* may be separated by any suitable radial distance 1416*a*, 1716*a* around a circumference of the spiral optimizer tool 1800, as space allows. In an embodiment, the first plurality of nozzles 1404*a*, 1804*a* may be separated by an approximately equal radial distance 1416*a*, 1716*a* around a circumference of the spiral optimizer tool 1800. For example, if the first plurality of nozzles 1404*a*, 1804*a* is three nozzles 1404, 1804, the three nozzles 1404, 1804 may be separated by about 120 degrees around the circumference of the spiral optimizer tool 1800.

In an embodiment, the spiral optimizer tool 1800 comprises a second plurality of nozzles 1404*b*, 1804*b* separated by a longitudinal distance 1818*b* along an axial length of the spiral optimizer tool 1800 in a spiral configuration. In an embodiment, the second plurality of nozzles 1404*b*, 1804*b* may be separated by any suitable longitudinal distance 1818*b* along an axial length of the spiral optimizer tool 1800 in a spiral configuration, as space allows. In an embodiment, the second plurality of nozzles 1404*b*, 1804*b* may be separated by up to about 30-inches in a spiral configuration, and any range or value there between. In an embodiment, the second plurality of nozzles 1404*b*, 1804*b* may be separated by up to about 20-inches in a spiral configuration. In an embodiment, the second plurality of nozzles 1404*b*, 1804*b* may be separated by up to about 10-inches in a spiral configuration. In an embodiment, the second plurality of nozzles 1404*b*, 1804*b* may be separated by up to about 6-inches in a spiral configuration.

Method of Assembling Downhole Device

Figure 13:
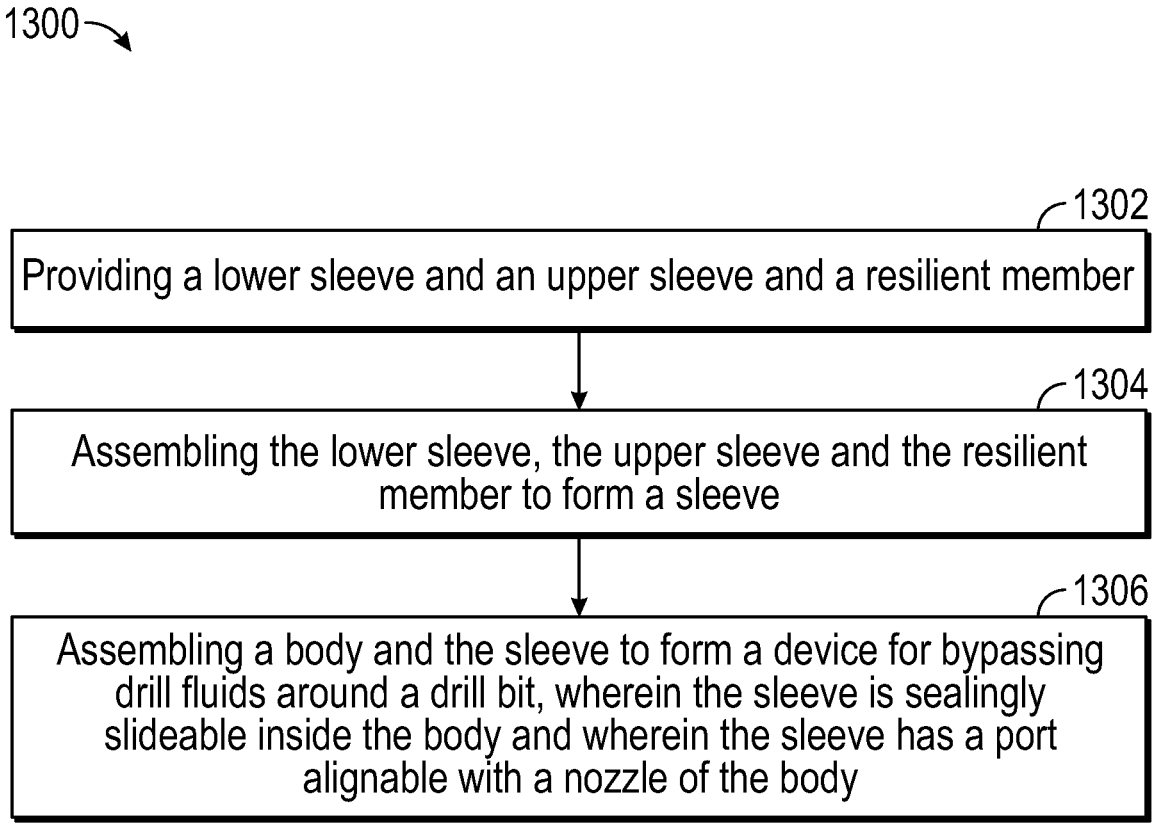
FIG. 13 shows a method of assembling the downhole device.

FIG. 13 shows a method of assembling the downhole device 1300. As shown in FIG. 13, a method of assembling a device for bypassing fluids around a drill bit 1300 may include: providing a lower sleeve, an upper sleeve and a resilient member 1302 (see e.g., FIGS. 11A-11B); assembling the lower sleeve, the upper sleeve and the resilient member to form a sleeve 1304 (see e.g., FIGS. 11C-1 & 11C-2); and assembling a body and the sleeve to form the device for bypassing drill fluids around the drill bit 1306 (see e.g., FIGS. 11D-11E). In an embodiment, the sleeve 310, 410 and 510 may be sealingly slideable inside the body 1105. Id. In an embodiment, the sleeve 310, 410 and 510 has a bypass port 314, 414 and 514 alignable with an erosion resistant nozzle 313, 413 and 513 of the body 1105. Id.

In some embodiments, the resilient member comprises a spring 320, 420 and 520.

Figure 11A:
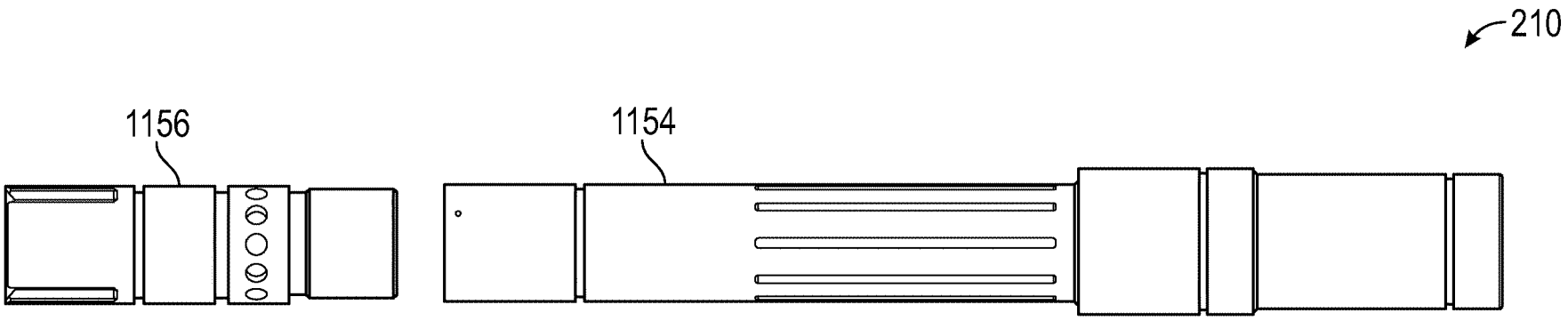
FIG. 11A shows a top view of a lower sleeve and an upper sleeve of an alternative exemplary embodiment of the downhole device shown in FIGS. 10A-10C prior to a first step of assembly.
Figure 11B:
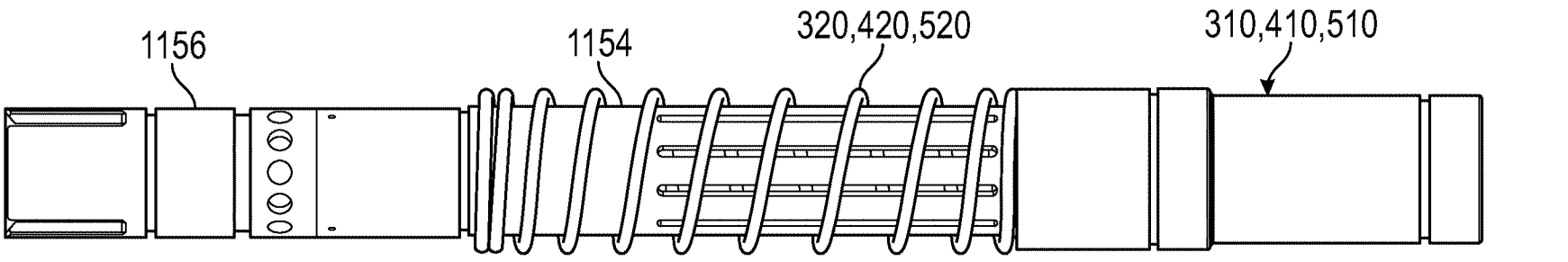
FIG. 11B shows a top view of the lower sleeve, the upper sleeve and a spring of the exemplary embodiment of the downhole device shown in FIG. 11A after the first step of assembly.

FIG. 11A shows a side view of a lower sleeve and an upper sleeve of an alternative exemplary embodiment of the downhole device 210 having carved structures 1110 and 1120 for regulating fluid flow prior to a first step of assembly. See e.g., FIGS. 11D-11E: 1110 & 1120. FIG. 11B shows a side view of the lower sleeve, the upper sleeve and a spring of the downhole device 210 shown in FIG. 11A after the first step of assembly.

As shown in FIGS. 11A-11B, the sleeve 310, 410 and 510 of the downhole device 210 includes: a lower sleeve 1154, an upper sleeve 1156 and a resilient member. In some embodiments, the resilient member comprises a spring 320, 420 and 520.

In some embodiments, the lower sleeve 1154 and the upper sleeve 1156 are attached via a connection. See e.g., FIG. 11A. In some embodiments, the lower sleeve 1154 and the upper sleeve 1156 are removably attached via a threaded connection. Id. In some embodiments, the lower sleeve 1154 and the upper sleeve 1156 are removably attached via a threaded connection and a set screw. Id.

Figures 1, 11C:
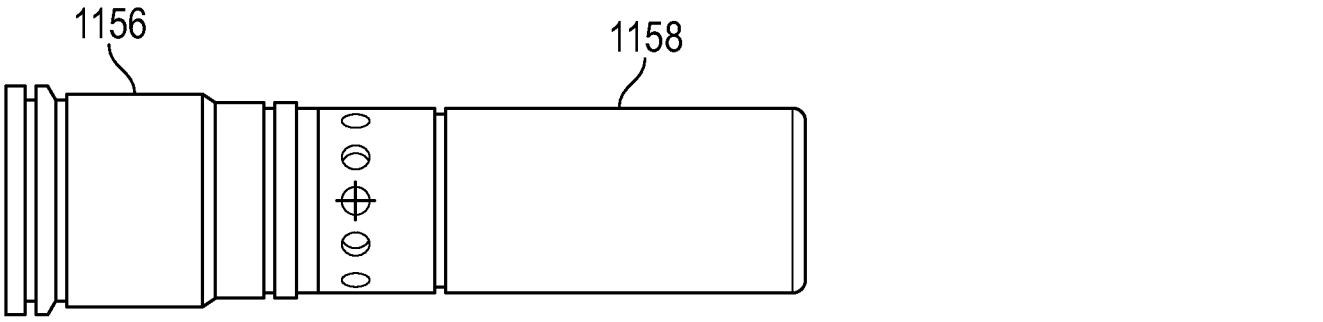
Figures 2, 11C:
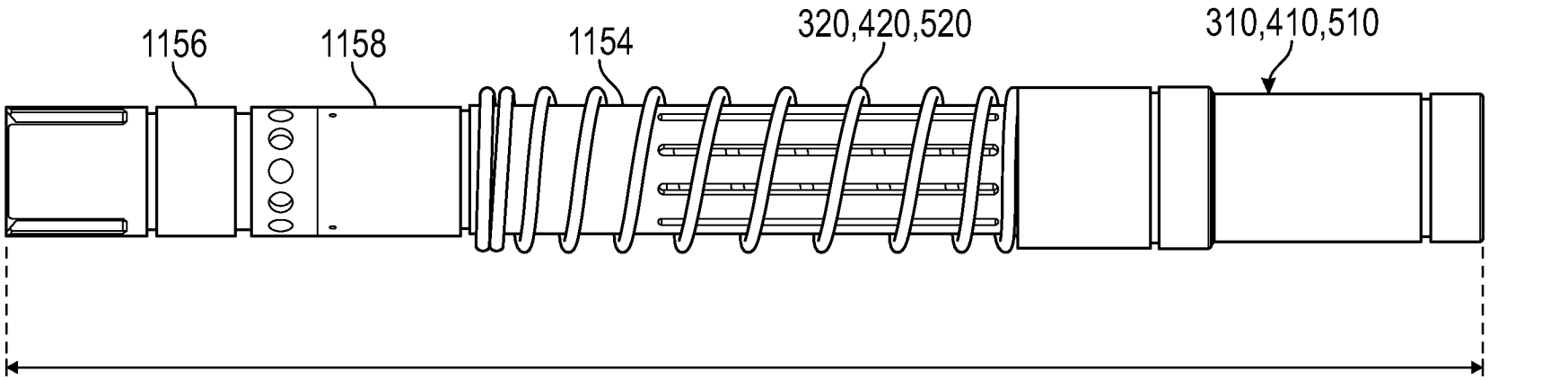
Figure 11D:
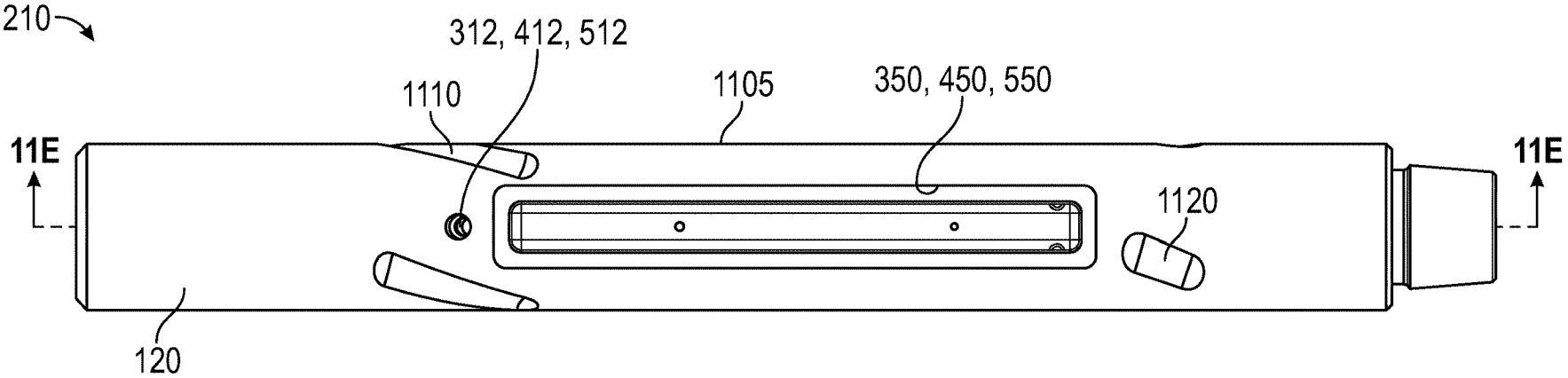
FIG. 11D shows a side view of a body of the exemplary embodiment of the downhole device prior to a second step of assembly.
Figure 11E:
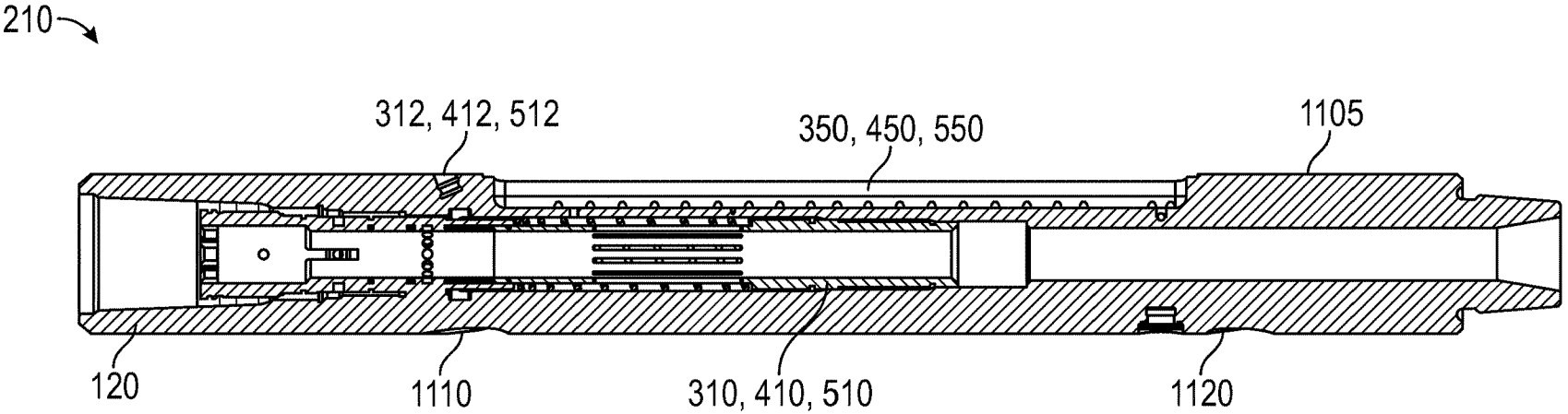
FIG. 11E shows a cross-sectional view of the body and the sleeve of the exemplary embodiment of the downhole device of FIGS. 11A-11D after the second step of assembly.

FIG. 11C-1 shows a side view of a stop block of the downhole device 210 shown in FIGS. 11A-11B; FIG. 11C-2 shows a side view of the assembled sleeve of the exemplary embodiment of the downhole device 210 shown in FIG. 11B; and FIG. 11D shows a side view of a body and the sleeve of the downhole device 210 prior to a second step of assembly. FIG. 11E shows a cross-sectional view of the body and the sleeve of the downhole device 210 of FIGS. 11A-11D after the second step of assembly.

As shown in FIGS. 11C-1 and 11C-2, the sleeve 310, 410 and 510 of the downhole device 210 includes: a lower sleeve 1154, an upper sleeve 1156 and a resilient member. In some embodiments, the resilient member comprises a spring 320, 420 and 520. See e.g., FIG. 11C-2.

In some embodiments, the upper sleeve 1156 comprises a stop block 1158. In some embodiments, the upper sleeve 1156 comprises a stop block 1158 for the spring 320, 420 and 520.

As shown in FIGS. 11D-11E, the downhole device 210 comprises a body 1105 and the sleeve 310, 410 and 510. In some embodiment, the downhole device 210 comprises a body 1158 (see FIGS. 11C-1 & 11C-2: 1158) having carved structures 1110 and 1120. See e.g., FIGS. 11D-11E: 1110 & 1120.

In an embodiment, the downhole device 210 further comprises a bypass outlet 312, 412 and 512 and a radial housing 350, 450 and 550.

As shown in FIG. 11E, the body 1105 and the sleeve 310, 410 and 510 are attached via a connection. See e.g., FIG. 11D. In some embodiment, the body 1105 and the sleeve 310, 410, 510 are attached via a threaded connection. Id.

Figure 11F:
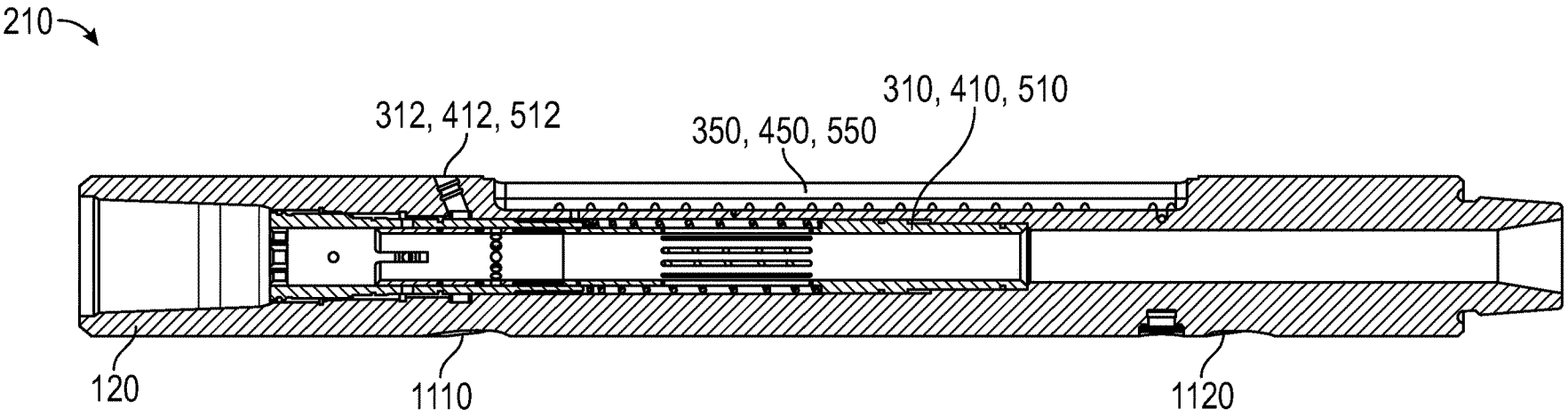
FIG. 11F shows a cross-sectional view of the body and the sleeve of the exemplary embodiment of the downhole device shown in FIG. 11E prior to a third step of assembly.
Figure 11G:
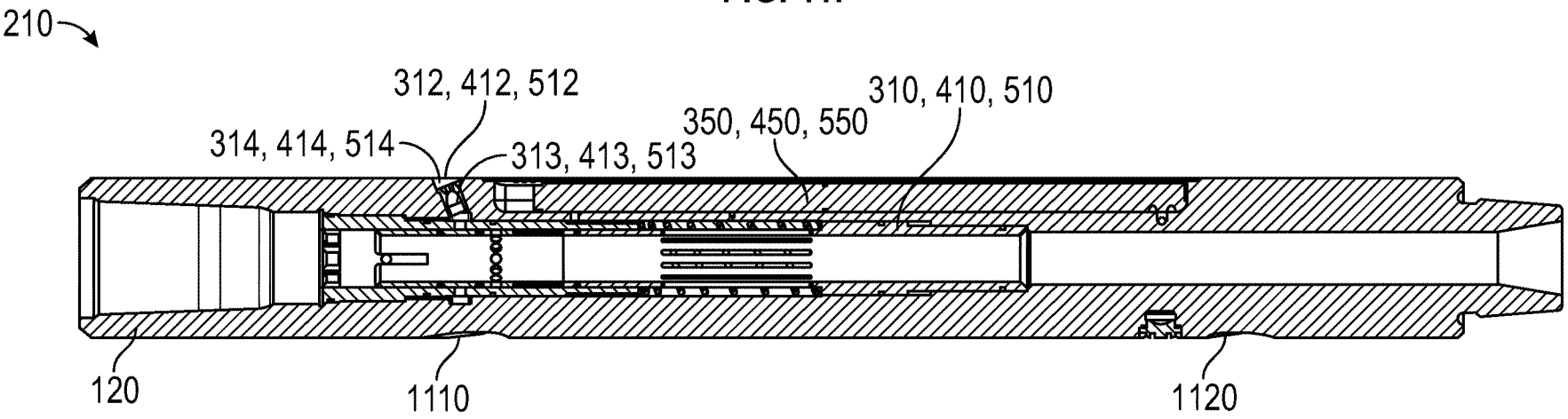
FIG. 11G shows a cross-sectional view of the exemplary embodiment of the downhole device of FIGS. 11A-11F after the third step of assembly.

FIG. 11F shows a cross-sectional view of the body 1105 and the sleeve 310, 410 and 510 of the downhole device 210 shown in FIG. 11E prior to a third step of assembly. FIG. 11G shows a cross-sectional view of the downhole device 210 of FIGS. 11A-11F after the third step of assembly.

As shown in FIGS. 11F and 11G, the body 1105 and the sleeve 310, 410 and 510 are attached via a connection. See e.g., FIGS. 11D-11E: 1105. In some embodiment, the body 1105 and the sleeve 310, 410, 510 are attached via a threaded connection. Id. In some embodiments, the body 1105 and the sleeve 310, 410 and 510 are attached via threaded connection and a snap ring. See e.g., FIG. 11G.

Alternative Downhole Device Configured as Selectable Hole Trimmer

As discussed above, FIG. 19A shows a view of another exemplary embodiment of the downhole device configured as a selectable hole trimmer 1900 without any bypass nozzles, showing a selectable hole cutter 1401 on the downhole device 1900 in a deactivated position; FIG. 19B shows a Section A-A cross-sectional view of the selectable hole trimmer 1900 of FIG. 19A, showing a deactivated cutter piston 1402, a body 120, 1905, an intermediate sleeve 1910*a*, a sliding sleeve 1910*b*, a hydraulic fluid port 1914, a compensating spring 1920*a*, and a return spring 1920*b*; FIG. 19C shows a Section C-C cross-sectional view of the selectable hole trimmer 1900 of FIG. 19A-19B, showing an intermediate sleeve 1910*a*, and a sliding sleeve 1910*b*.

As also discussed above, FIG. 21A shows a cross-sectional view of another exemplary embodiment of a downhole device configured as a selectable hole trimer 2100, showing a selectable hole cutter 1401 on the downhole device 2100 in a deactivated position, an intermediate sleeve 2110*a*, compensating sleeve 2110*c*, a hydraulic fluid port 2114 and a stop block 1158; FIG. 21B shows a cross-sectional view of the exemplary selectable hole trimmer 2100 of FIG. 21A, showing an activated cutter piston 1402 with extended cutters 1406, the intermediate sleeve 2110*a*, the compensating sleeve 2110*c*, the hydraulic fluid port 2114 and the stop block 1158; FIG. 21C shows a detailed cross-sectional view of the exemplary selectable hole trimmer 2100 of FIG. 21A, showing a deactivated cutter piston 1402 with retracted cutters 1406, the intermediate sleeve 2110*a*, the compensating sleeve 2110*c*, the hydraulic fluid port 2114 and the stop block 1158; FIG. 21D shows a detailed cross-sectional view of the exemplary selectable hole trimmer 2100 of FIG. 21B, showing the activated cutter piston 1402 with extended cutters 1406; FIG. 21E shows a detailed cross-sectional view of the exemplary hole trimmer 2100 of FIGS. 21A and 21C; FIG. 21F shows a detailed view of the exemplary hole trimmer 2100 of FIGS. 21B and 21D; and FIG. 21G shows an upper, left perspective view of the exemplary selectable hole trimmer 2100 of FIGS. 21A-21F, showing the activated cutter piston 1402 with extended cutters 1406.

As shown in FIGS. 19A-19C and 21A-21G, a downhole device 1900, 2100 comprises an intermediate sleeve 1910*a*, 2110*a*, a sliding sleeve/pressure compensating piston 1910*b* or a sliding sleeve 2110*b*, a hydraulic fluid port 1914, 2114, a compensating port 1915, 2115, a volume 1921*b* (between the intermediate sleeve 1910*a* and the sliding sleeve/pressure compensating piston 1910*b*) or a compensating sleeve 2110*c*, a volume 1922, 2122 (between the intermediate sleeve 1910*a*, 2110*a* and the body 1905, 2105) and one or more selectable hole cutters 1401.

In an embodiment, the one or more selectable hole cutters 1401 comprises one or more cutter pistons 1402. In an embodiment, the cutter piston 1402 has one or more cutters 1406 affixed to the cutter piston 1402. In an embodiment, the cutter piston 1402 has one or more cutters 1406 affixed to the cutter piston 1402.

In an embodiment, the one or more selectable hole cutters 1401 comprises a cutter blade 1406*a* and one or more cutter pistons 1402. In an embodiment, the cutter blade 1406*a* has one or more cutter pistons 1402 affixed to the cutter blade 1406*a*. In an embodiment, the cutter blade 1406*a* has one or more cutters 1406 affixed to the cutter blade 1406*a*.

When the downhole device 1900, 2100 is sliding or tripping into or out of a borehole, the downhole device 1900, 2100, namely the one or more selectable hole cutters 1401 are in a deactivated position. The one or more cutter pistons 1402 are in a deactivated position with the one or more cutters 1406 also the deactivated position.

The body 1905, 2105 of the selectable hole trimmer 1900, 2100 is attached to the intermediate sleeve 1910*a*, 2110*a* via the stop block 1158.

As the downhole device 1900 is lowered in the borehole, the hydrostatic pressure pushes a sliding sleeve/pressure compensating piston 1910*b* down (to the right in FIG. 19B), which compresses hydraulic fluid in a pressurized volume 1922 (i.e., a hydraulic fluid chamber) as the sliding sleeve/pressure compensating piston 1910*b* slides over the intermediate sleeve 1910*a*.

Similarly, as the downhole device 2100 is lowered in the borehole, the hydrostatic pressure pushes a compensating sleeve 2110*c* down (to the right in FIG. 21A), which compresses hydraulic fluid in a pressurized volume 2122 (i.e., a hydraulic fluid chamber) as the compensating sleeve 2110*c* slides over the intermediate sleeve 2110*a*.

Until the downhole device 1900, 2100 is signaled to activate, the one or more selectable hole cutters 1401 will remain in the deactivated position. In other words, the one or more cutter pistons 1402 will remain in the deactivated position with the one or more cutters 1406 also in the deactivated position.

When the downhole device 1900, 2100 is sliding or tripping into or out of the borehole, the one or more selectable hole cutters 1401 are designed to be in a deactivated position. In other words, the one or more cutter pistons 1402 are in a deactivated position with the one or more cutters 1406 also in the deactivated position.

When the drill string 120 is rotating, the one or more selectable hole cutters 1401 are designed to be in an activated position. In other words, the one or more cutter pistons 1402 are in the activated position with one or more cutters 1406 also in the activated position.

As shown in FIGS. 19A, 19C and 21A-21B, a downhole device 1900, 2100 comprises the battery 610, the controller/electronics 620, 700, and the motor pump 440.

As discussed above, the downhole device 1900, 2100 may activated automatically by rpm, by pressure or by other means by the controller/electronics 620, 700 in pockets 1930.

In an embodiment, a two-way valve 2250 is part of the controller/electronics 620, 700 located in the pockets 1930. When the downhole device 1900, 2100 receives a signal by rpm or by other means to activate the one or more selectable hole cutters 1401, then a pre-pressurized hydraulic fluid passes from the compensating sleeve 2110*c* through a compensating port 1915, 2115 to open the two-way valve 2250, 2150*a*. The open two-way valve 2250, 2250*a* allows the pressured hydraulic fluid to pass through one or more hydraulic fluid ports 1914, 2114 to pressurize a volume 1922, 2122 (i.e., hydraulic fluid chamber) and to activate one or more selectable hole cutters 1401.

In an embodiment, the one or more of the hydraulic fluid ports 1914, 2114 may be located at each end of the downhole tool 1900, 2100 radially inward of the one or more cutter pistons 1402.

This pressurized hydraulic fluid activates the one or more cutter pistons 1402 of the selectable hole cutters 1401, which extends the one or more cutter pistons 1402 and the one or more cutters 1406 outward radially to engage and cut a side surface of the drilled hole 130.

Until the downhole device 1900, 2100 is signaled to deactivate, the one or more selectable hole cutters 1401 will remain in the activated position. In other words, the one or more cutter pistons 1402 will remain in the activated position with one or more cutters 1406 also in the activated position. The signal to deactivate may be by stopping rpm or by manual means from an operator.

When the downhole device 1900, 2100 receives the signal to deactivate, a pump 340, 440, 2240 in the pocket 1930 begins operating. The pump 340, 440, 2240 along with one or more springs 1410 forces the pressured hydraulic fluid away from the one or more cutter pistons 1402 and the two-way valve 2250*b* is closed.

As such, the one or more selectable hole cutters 1401 are deactivated, returning the one or more cutter pistons 1402 back to the deactivated position via a spring 1410 and returning the pressurized hydraulic fluid back to the compensating sleeve 2110*c* into the pressurized volume 2122 (i.e., pressurized hydraulic fluid chamber).

The downhole device 1900, 2100 is ready to operate and to activate the one or more selectable hole cutters 1401 again on demand or automatically when rotation resumes.

Figure 22:
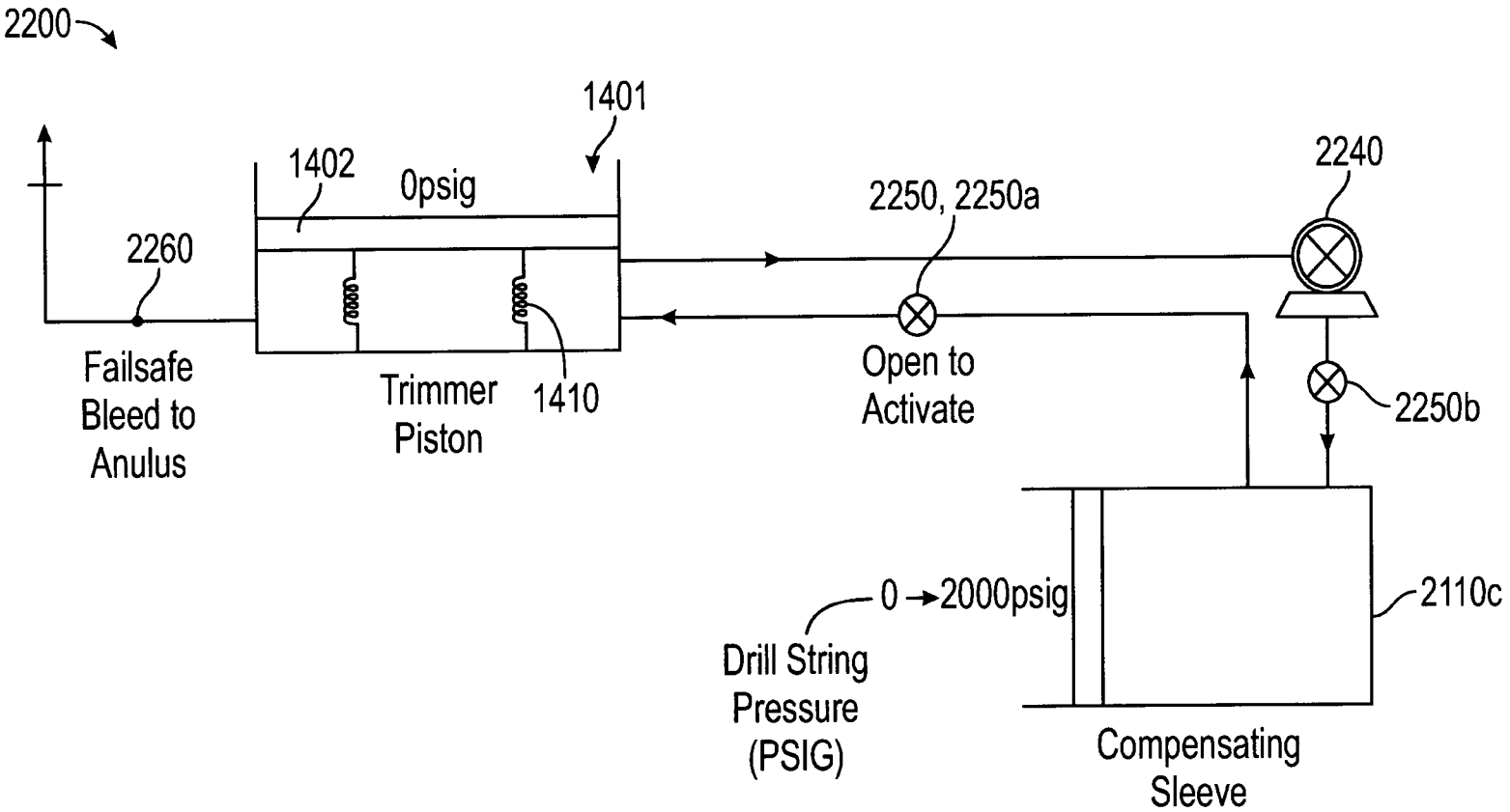
FIG. 22 shows a hydraulic schematic of an exemplary embodiment of a downhole device configured as a selectable hole trimmer.

FIG. 22 shows a hydraulic schematic of an exemplary embodiment of a downhole device configured as a selectable hole trimmer 1900, 2100, showing a hydraulic fluid system 2200.

As shown in FIG. 22, the hydraulic fluid system 2200 comprises a sliding sleeve/compensating piston 1910*b* or a compensating sleeve 2110*c*, a two-way valve 2250, 2250*a*, 2250*b*, a selectable hole cutter 1401, and a pump 2240.

In an embodiment, the downhole device 1900, 2100 may be activated by opening a first two-way valve 2250*a* and deactivated by closing a second two-way valve 2250*b*.

In an embodiment, the selectable hole cutter 1401 has a cutter piston 1402. In an embodiment, the cutter piston 1402 has one or more cutters 1406 affixed to the cutter piston

1402. In an embodiment, a spring 1410 and a spacer 1412 are disposed between the cutter piston 1402 and the container 1408 or cutout.

In an embodiment, the hydraulic fluid system 2200 may further comprise a fail-safe solenoid valve 2260. In an embodiment, the fail-safe solenoid valve 2260 may be in a normally open position.

In an event of a power failure, a hydraulic fluid leak, a temperate spike or other adverse situation, the fail-safe solenoid valve 2260 automatically switches to the normally open position to vent pressurized hydraulic fluid out of the downhole device 1900, 2100 to deactivate the one or more selectable hole cutters 1401. In other words, the one or more springs 1410 return the one or more cutter pistons 1402 to a deactivated position with one or more cutters 1406 also in the deactivated position. The downhole device 1900, 2100 may be retrieved from the borehole without any interference from the one or more selectable hole cutters 1401.

Method for Bypassing Drilling Fluids Using the Downhole Device

Figure 9:
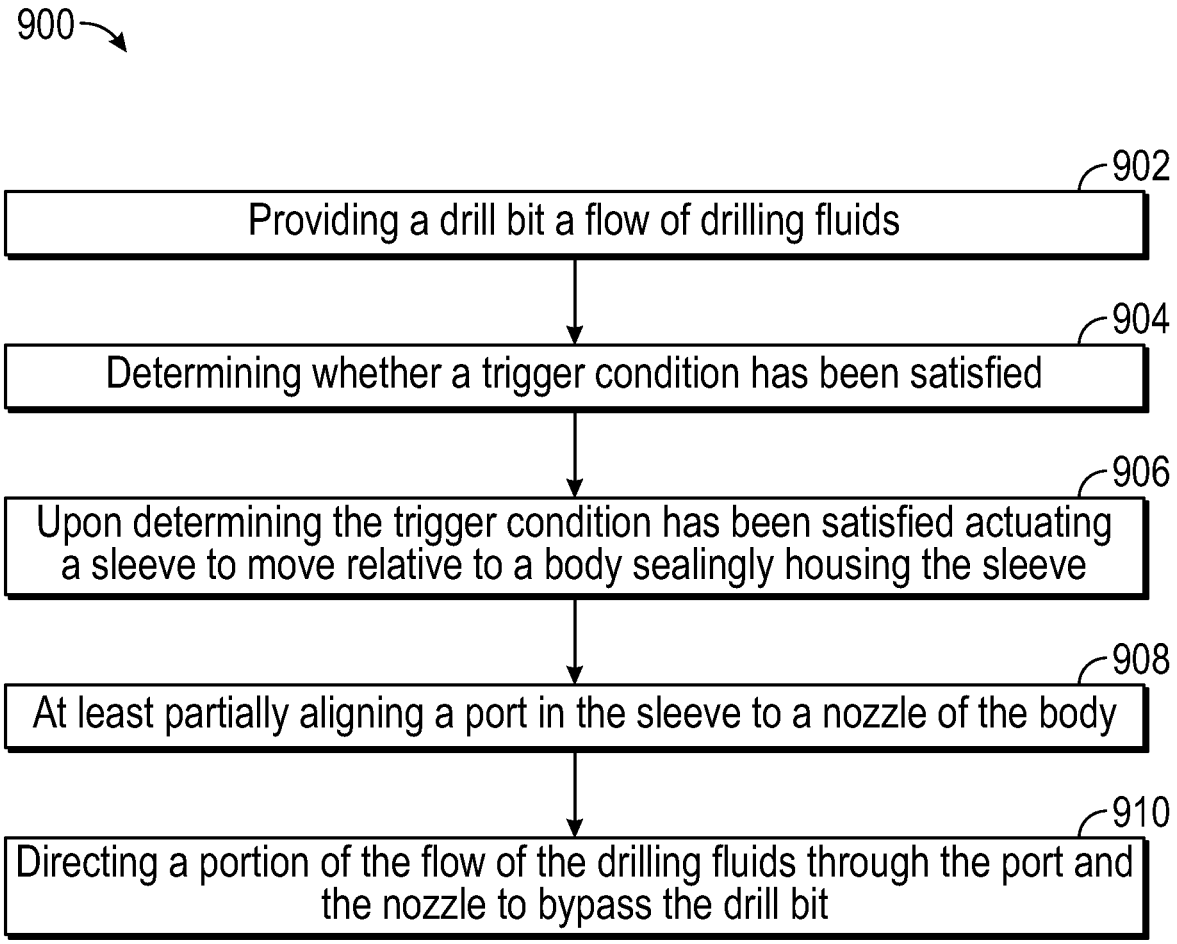
FIG. 9 shows a flow diagram of a method for bypassing drilling fluids from a downhole drill bit.

FIG. 9 shows a flow diagram of a method for bypassing drilling fluids from a downhole drill bit 900. As shown in FIG. 9, the method for bypassing drilling fluids from a downhole drill bit 900 may include: providing a drill bit a flow of drilling fluids 902; determining whether a trigger condition has been satisfied 904; upon determining the trigger condition has been satisfied, actuating a sleeve to move relative to a body sealingly housing the sleeve 906; at least partially aligning a port in the sleeve to a nozzle of the body 908; and directing a portion of the flow of drilling fluids through the port and the nozzle to bypass the drill bit 910. In an embodiment, the flow of drilling fluids returns in an annulus.

In some embodiments, determining the satisfaction of the trigger condition 904 may include measuring a value related to a rotation speed of the downhole drill bit or a pressure of the drilling fluids or weight and comparing the measured value to a reference value.

In some other embodiments, determining the satisfaction of the trigger condition 904 may include receiving a control signal from a controller. For example, the control signal may be provided in response to a rotation protocol. In other instances, the control signal may also be determined based on depth, user input, or other operation feedbacks.

In some embodiments, determining the satisfaction of the trigger condition 904 may include comparing a pressure of the drilling fluids inside the drill string and a pressure of the drilling fluids in the annulus outside the drill string to ascertain a pressure difference and in some embodiments, actuating the sleeve to move relative to the body includes actuating a three-way valve in response to the pressure difference between the drilling fluids inside the drill string and the drilling fluids in the annulus.

In some other embodiments, comparing the pressure of the drill fluids inside the drill string and the pressure of the drilling fluids in the annulus outside the drill string may include receiving the drilling fluids inside the drill string in an accumulator or pressure compensator and receiving the drilling fluids in the annulus in another accumulator or pressure compensator.

In some embodiments, actuating the sleeve to move relative to the body 906 comprises actuating a three-way valve in response to the pressure difference between the drilling fluids inside the drill string and the drilling fluids in the annulus.

In some embodiments, actuating the sleeve to move relative to the body 906 may include sliding the sleeve inside the body, or rotating the sleeve inside the body, or both.

In some embodiments, the method further includes biasing the sleeve against the body to close the port from the nozzle upon determining the trigger condition has not been satisfied.

In some other embodiments, biasing the sleeve against the body to close the port from the nozzle may include offsetting the port from the nozzle using a spring.

Method for Bypassing Drilling Fluids Using Alternative Downhole Device

Figure 12:
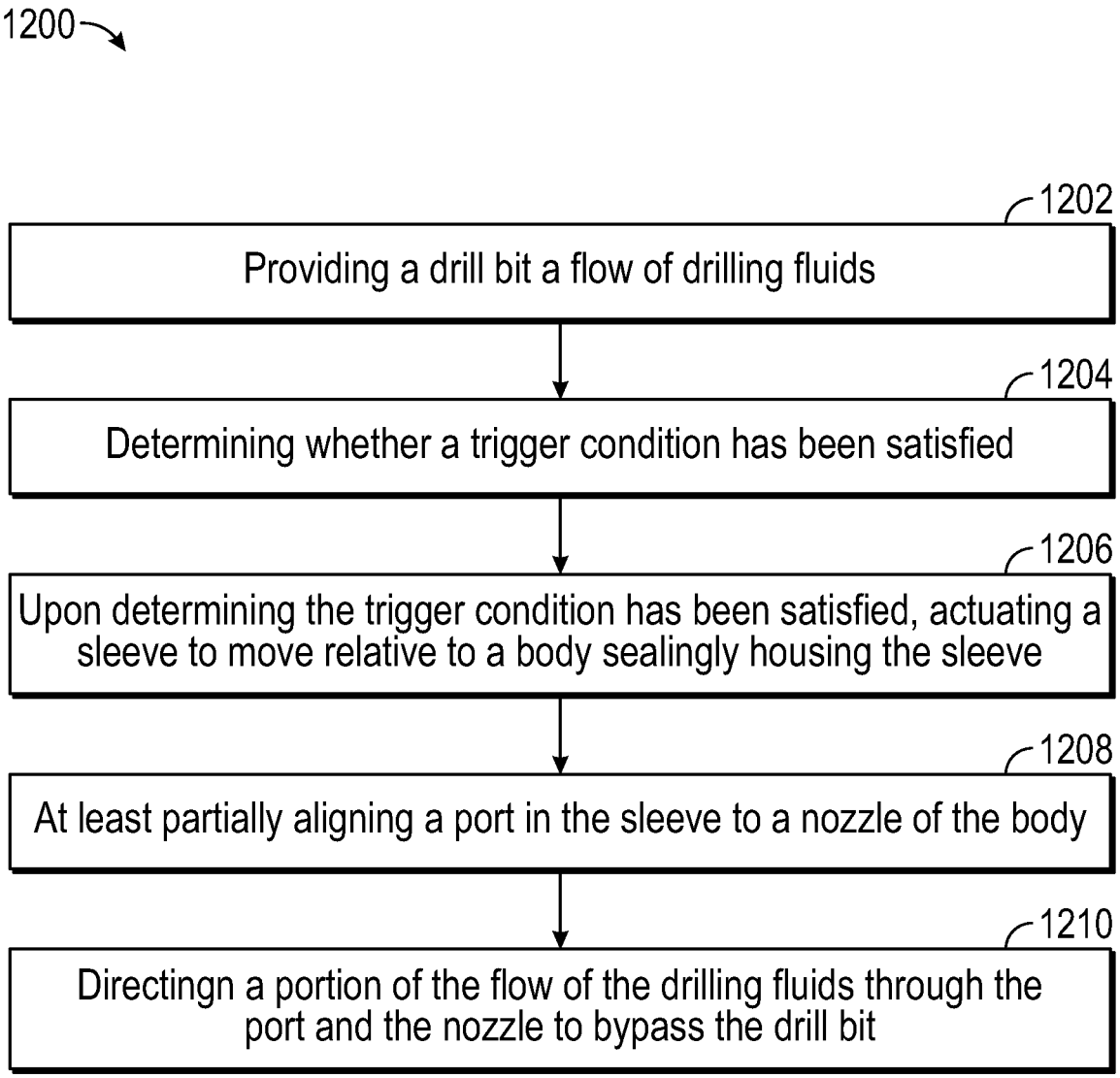
FIG. 12 shows a flow diagram of a method for bypassing drilling fluids from a downhole drill bit.

FIG. 12 shows a flow diagram of a method for bypassing drilling fluids from a downhole drill bit 1200. As shown in FIG. 12, the method for bypassing drilling fluids from a downhole drill bit 1200 may include: providing a drill bit a flow of drilling fluids 1202; determining whether a trigger condition has been satisfied 1204; upon determining the trigger condition has been satisfied, actuating a sleeve to move relative to a body sealingly housing the sleeve 1206, and at least partially aligning a port in the sleeve to a nozzle of the body 1208; and directing a portion of the flow of drilling fluids through the port and the nozzle to bypass the drill bit 1210. In an embodiment, the flow of drilling fluids returns in an annulus. In an embodiment, a resilient member comprises a spring providing a biasing force corresponding to a threshold trigger pressure.

In some embodiments, determining the satisfaction of the trigger condition 1204 may include measuring a value related to a rotation speed of the downhole drill bit or a pressure of the drilling fluids or weight and comparing the measured value to a reference value.

In some other embodiments, determining the satisfaction of the trigger condition 1204 may include receiving a control signal from a controller. For example, the control signal may be provided in response to a rotation protocol. In other instances, the control signal may also be determined based on depth, user input, or other operation feedbacks.

In some embodiments, determining the satisfaction of the trigger condition 1204 may include comparing a pressure of the drilling fluids inside the drill string and a pressure of the drilling fluids in the annulus outside the drill string to ascertain a pressure difference and in some embodiments, actuating the sleeve to move relative to the body includes actuating a three-way valve in response to the pressure difference between the drilling fluids inside the drill string and the drilling fluids in the annulus.

In some other embodiments, comparing the pressure of the drill fluids inside the drill string and the pressure of the drilling fluids in the annulus outside the drill string may include receiving the drilling fluids inside the drill string in an accumulator or pressure compensator and receiving the drilling fluids in the annulus in another accumulator or pressure compensator.

In some embodiments, actuating the sleeve to move relative to the body 1206 comprises actuating a three-way valve in response to the pressure difference between the drilling fluids inside the drill string and the drilling fluids in the annulus.

In some embodiments, actuating the sleeve to move relative to the body 1206 may include sliding the sleeve inside the body, or rotating the sleeve inside the body, or both.

In some embodiments, the method further includes biasing the sleeve against the body to close the port from the nozzle upon determining the trigger condition has not been satisfied.

In some other embodiments, biasing the sleeve against the body to close the port from the nozzle may include offsetting the port from the nozzle using a coil spring.

Method of Using Downhole Device Configured as Selectable Hole Trimmer

Figure 20:
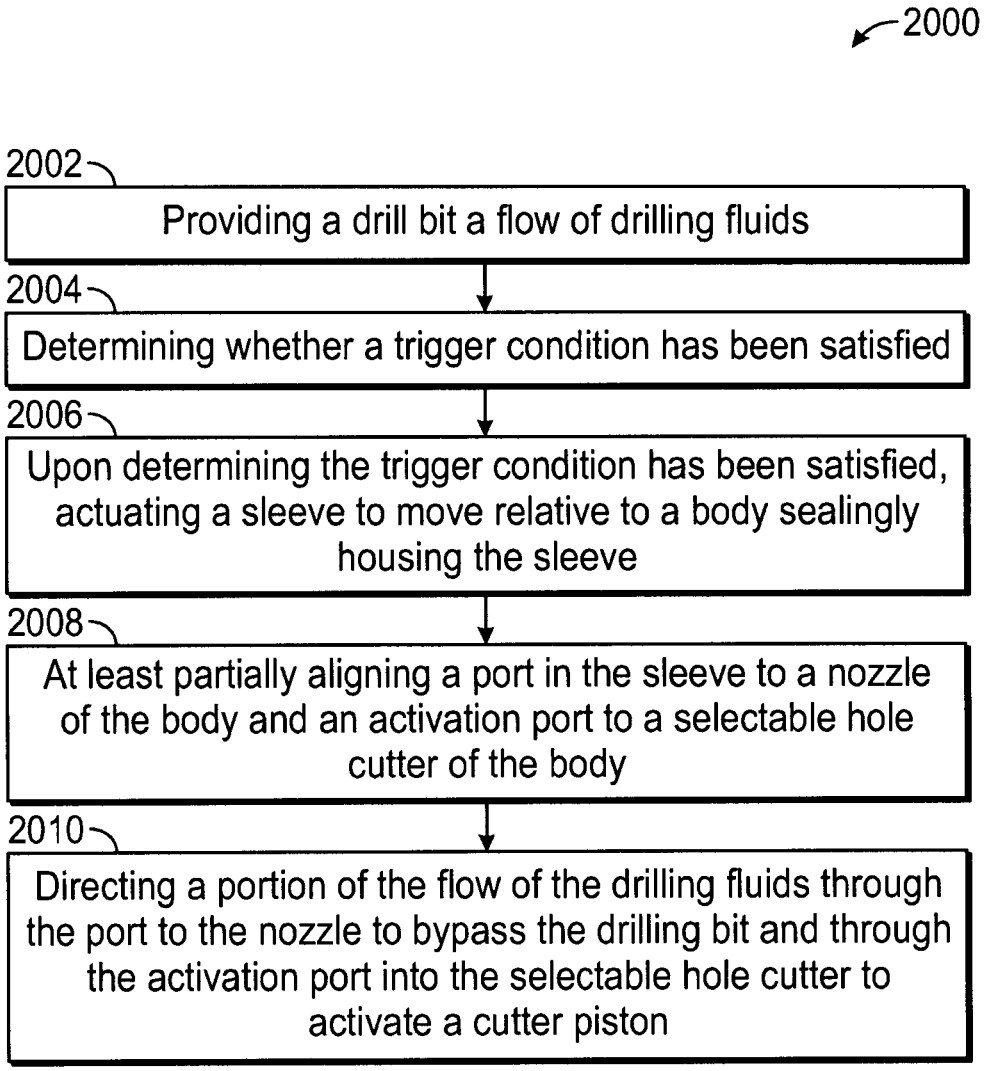
FIG. 20 shows a flow diagram of a method of using a downhole device configured as a selectable hole trimmer.

FIG. 20 shows a flow diagram of a method of using a downhole device configured as a selectable hole trimmer 2000. As shown in FIG. 20, a method of using a downhole device as a selectable hole trimmer 2000 may include: providing a drill bit a flow of drilling fluids 2002; determining whether a trigger condition has been satisfied 2004; upon determining the trigger condition has been satisfied, actuating a sleeve to move relative to a body sealingly housing the sleeve 2006; at least partially aligning a port in the sleeve to a nozzle and an activation port in the sleeve to a selectable hole cutter 2008; and directing a portion of the flow of drilling fluids through the port to the nozzle to bypass the drill bit and through the activation port to the selectable hole cutter to activate a cutter piston 2010.

In an embodiment, the flow of drilling fluids returns in an annulus. In an embodiment, a resilient member comprises a spring providing a biasing force corresponding to a threshold trigger pressure.

In some embodiments, determining the satisfaction of the trigger condition 2004 may include measuring a value related to a rotation speed of the downhole drill bit or a pressure of the drilling fluids or weight and comparing the measured value to a reference value.

In some other embodiments, determining the satisfaction of the trigger condition 2004 may include receiving a control signal from a controller. For example, the control signal may be provided in response to a rotation protocol. In other instances, the control signal may also be determined based on depth, user input, or other operation feedbacks.

In some embodiments, determining the satisfaction of the trigger condition 2004 may include comparing a pressure of the drilling fluids inside the drill string and a pressure of the drilling fluids in the annulus outside the drill string to ascertain a pressure difference and in some embodiments, actuating the sleeve to move relative to the body includes actuating a three-way valve in response to the pressure difference between the drilling fluids inside the drill string and the drilling fluids in the annulus.

In some other embodiments, comparing the pressure of the drill fluids inside the drill string and the pressure of the drilling fluids in the annulus outside the drill string may include receiving the drilling fluids inside the drill string in an accumulator or pressure compensator and receiving the drilling fluids in the annulus in another accumulator or pressure compensator.

In some embodiments, actuating the sleeve to move relative to the body 2006 comprises actuating a three-way valve in response to the pressure difference between the drilling fluids inside the drill string and the drilling fluids in the annulus.

In some embodiments, actuating the sleeve to move relative to the body 2006 may include sliding the sleeve inside the body, or rotating the sleeve inside the body, or both.

In some embodiments, the method further includes biasing the sleeve against the body to close the port from the nozzle and the activation port from the selectable hole cutter upon determining the trigger condition has not been satisfied.

In some other embodiments, biasing the sleeve against the body to close the port from the nozzle and the activation port from selectable hole cutter may include offsetting the port from the nozzle and the activation port from the selectable hole cutter using a coil spring.

In some other embodiments, the method further comprises increasing a diameter of a borehole using the activated selectable hole cutter.

Figure 23A:
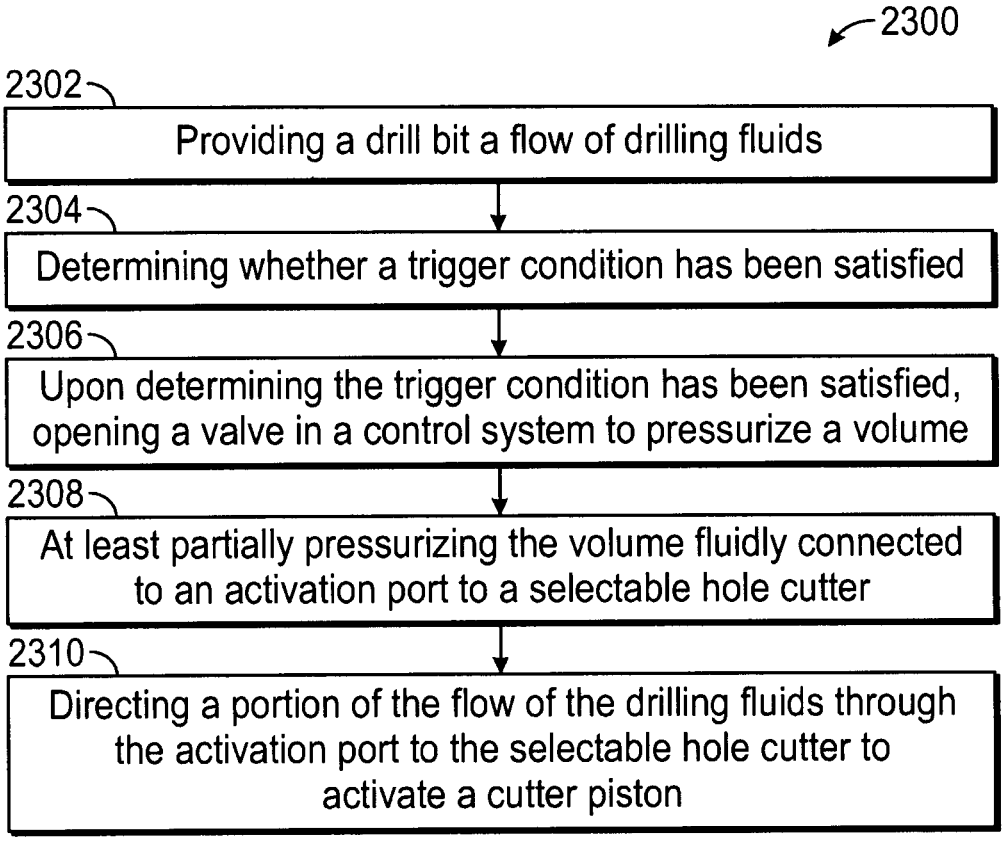
FIG. 23A shows a flow diagram of another method of using a downhole device configured as a selectable hole trimmer.
Figure 23B:
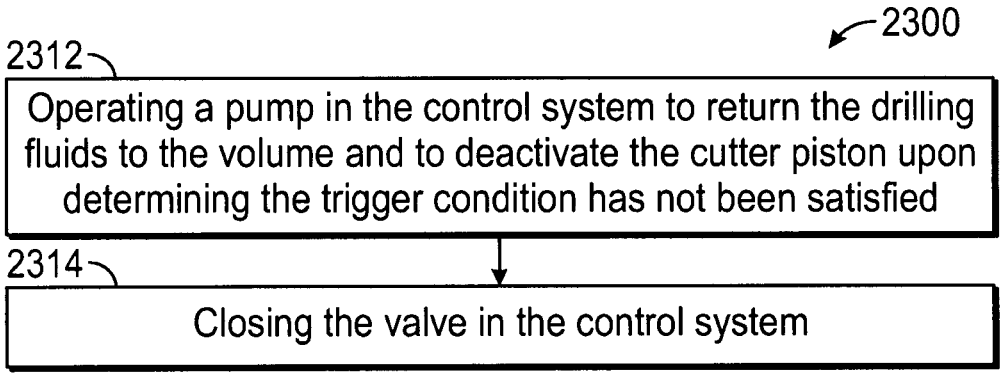
FIG. 23B shows a flow diagram of additional steps for the method of FIG. 23A.

Method of Using Alternative Downhole Device Configured as Selectable Hole Trimmer FIG. 23A shows a flow diagram of another method of using a downhole device configured as a selectable hole trimmer; FIG. 23B shows a flow diagram of additional steps for the method of FIG. 23A; and FIG. 23C shows a flow diagram of additional steps for the method of FIGS. 23A-23B.

In an embodiment, a method of using a downhole device as a selectable hole trimmer 2300 may include: providing a drill bit a flow of drilling fluids 2302; determining whether a trigger condition has been satisfied 2304; upon determining the trigger condition has been satisfied, opening a valve in a control system to pressurize a volume 2306; at least partially pressurizing an activation port to a selectable hole cutter of the body 2308; and directing a portion of the flow of drilling fluids through the activation port to the selectable hole cutter to activate the cutter piston 2310.

As shown in FIG. 23B, the method 2300 may further include: determining whether a second trigger condition has been satisfied 2312; upon determining the second trigger condition has been satisfied, operating a pump in the control system to return the drilling fluids to the volume and to deactivate the cutter piston 2314; and closing the valve in the control system 2316.

Figure 23C:
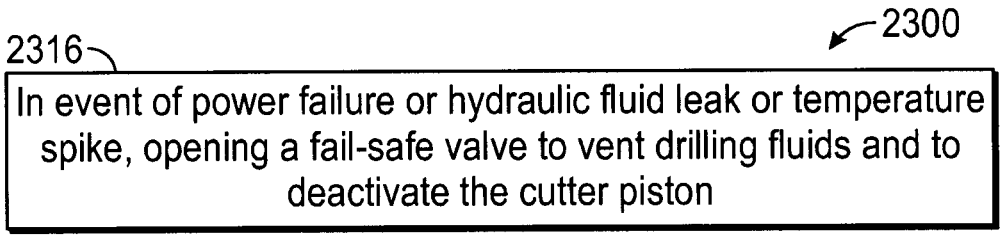
FIG. 23C shows a flow diagram of additional steps for the method of FIGS. 23A-23B.

As shown in FIG. 23C, the method may further include: in an event of a power failure, a hydraulic fluid leak or a temperature spike, opening a fail-safe valve to vent drilling fluids and to deactivate the cutter piston 2318.

In an embodiment, the flow of drilling fluids returns in an annulus.

In some embodiments, determining the satisfaction of the trigger condition 2004 may include measuring a value related to a rotation speed of the downhole drill bit or a pressure of the drilling fluids or weight and comparing the measured value to a reference value.

In some other embodiments, determining the satisfaction of the trigger condition 2304 may include receiving a control signal from a controller. For example, the control signal may be provided in response to a rotation protocol. In other instances, the control signal may also be determined based on depth, user input, or other operation feedbacks.

In some embodiments, determining the satisfaction of the trigger condition 2304 may include comparing a pressure of the drilling fluids inside the drill string and a pressure of the drilling fluids in the annulus outside the drill string to ascertain a pressure difference.

In some other embodiments, comparing the pressure of the drill fluids inside the drill string and the pressure of the drilling fluids in the annulus outside the drill string may include receiving the drilling fluids inside the drill string in an accumulator or pressure compensator and receiving the drilling fluids in the annulus in another accumulator or pressure compensator.

In some other embodiments, the method further comprises increasing a diameter of a borehole using the activated cutter piston.

Second Alternative Downhole Device Configured as Selectable Hole Trimmer

Figure 24:
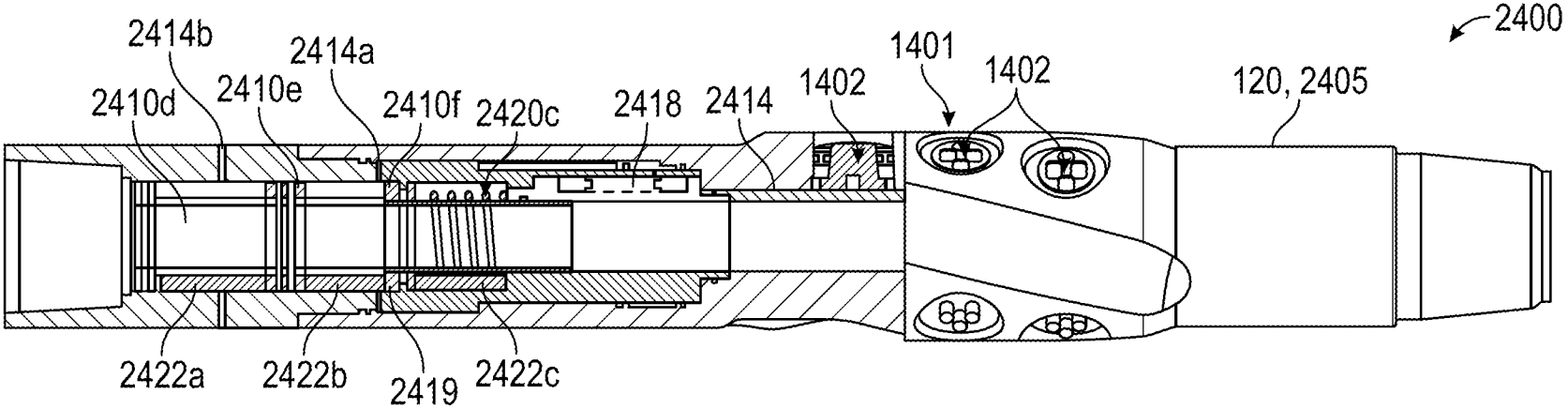
FIG. 24 shows a partial cross-sectional view of an exemplary embodiment of a downhole device configured as a selectable hole trimmer, showing a selectable hole cutter on the downhole device in a deactivated position, a dual solenoid compensating sleeve, an annular compensating ring, a volume/waste ring, a hydraulic fluid port and a hydraulic fluid waste port 2414*a*.

FIG. 24 shows a partial cross-sectional view of an exemplary embodiment of a downhole device configured as a selectable hole trimmer 2400, showing a selectable hole cutter 1401 on the downhole device 2400 in a deactivated position, a dual solenoid compensating sleeve 2410*d*, an annular compensating ring 2410*e*, a volume/waste ring 2410*f*, a hydraulic fluid port 2414 and a hydraulic fluid waste port 2414*a*. As shown in FIG. 24, the selectable hole trimmer 2400 comprises a dual solenoid compensating sleeve 2410*d*, an annular compensating ring 2410*e*, a volume/waste ring 2410*f*, a hydraulic fluid port 2414, a hydraulic fluid waste port 2414*a*, a dual solenoid valve 2418, a drilling mud volume 2422*a*, a waste volume 2422*b*, a pressurized volume 2422*c* and one or more selectable cutters 1401.

In an embodiment, the selectable hole trimmer further comprises a drilling mud port 2414*b*, a one-way valve 2419 and a hydraulic fluid return spring 2420*c*.

In an embodiment, the one or more selectable hole cutters 1401 comprises one or more cutter pistons 1402. In an embodiment, the cutter piston 1402 has one or more cutters 1406 affixed to the cutter piston 1402. In an embodiment, the cutter piston 1402 has one or more cutters 1406 affixed to the cutter piston 1402.

In an embodiment, the one or more selectable hole cutters 1401 comprises a cutter blade 1406*a* and one or more cutter pistons 1402. In an embodiment, the cutter blade 1406*a* has one or more cutter pistons 1402 affixed to the cutter blade 1406*a*. In an embodiment, the cutter blade 1406*a* has one or more cutters 1406 affixed to the cutter blade 1406*a*.

When the downhole device 2400 is sliding or tripping into or out of a borehole, the downhole device 2400, namely the one or more selectable hole cutters 1401 are in a deactivated position. The one or more cutter pistons 1402 are in a deactivated position with the one or more cutters 1406 also the deactivated position.

The body 2405 of the selectable hole trimmer 2400 may be attached to the dual solenoid compensating sleeve 2410*d* via a connection. In an embodiment, the body 2405 of the selectable hole trimmer 2400 may be attached to the dual solenoid compensating sleeve 2410*d* via a threaded connection (e.g., threaded nut). In some embodiments, the dual solenoid compensating sleeve 2410*d* is held in place with a hydraulic fluid return spring 2420*c* at a lower end and a snap ring (not shown) at an upper end.

As the downhole device 2400 is lowered in the borehole, the hydrostatic pressure in a drilling mud volume 2422*a* pushes an annular compensating ring 2410*e* downward (to the right in FIG. 24), which compresses hydraulic fluid in a pressurized waste volume 2422*b* (i.e., a hydraulic fluid chamber).

Similarly, the hydrostatic pressure in the pressurized waste volume 2422*b* pushes a volume/waste ring 2410*f* downward (to the right in FIG. 24), which compresses hydraulic fluid in a pressurized volume 2422*c* (i.e., a hydraulic fluid chamber).

Until the downhole device 2400 is signaled to activate, the one or more selectable hole cutters 1401 will remain in the deactivated position. In other words, the one or more cutter pistons 1402 will remain in the deactivated position with the one or more cutters 1406 also in the deactivated position.

When the downhole device 2400 is sliding or tripping into or out of a borehole, the downhole device 2400, namely the one or more selectable hole cutters 1401 are in a deactivated position. The one or more cutter pistons 1402 are in a deactivated position with the one or more cutters 1406 also the deactivated position.

As the downhole device 2400 is lowered in the borehole, the hydrostatic pressure of the drilling mud between inside the downhole device 2400 and outside annulus 122 by way of typical pressure drops through drill string components below the selectable hole trimmer 2400. In an embodiment, a pressure differential (between the inside pressure and the outside annulus pressure) may be greater than or equal to about 100 psi, and any range or value there between. In an embodiment, the pressure differential may be greater than or equal to about 1,000 psi.

As the downhole device 2400 is lowered in the borehole, the hydrostatic pressure in a drilling mud volume 2422*a* pushes an annular compensating ring 2410*e* downward (to the right in FIG. 24), which compresses hydraulic fluid in a pressurized waste volume 2422*b* (i.e., a hydraulic fluid chamber).

Similarly, the hydrostatic pressure in the pressurized waste volume 2422*b* pushes a volume/waste ring 2410*f* downward (to the right in FIG. 24), which compresses hydraulic fluid in a pressurized volume 2422*c* (i.e., a hydraulic fluid chamber).

Until the downhole device 2400 is signaled to activate, the one or more selectable hole cutters 1401 will remain in the deactivated position. In other words, the one or more cutter pistons 1402 will remain in the deactivated position with the one or more cutters 1406 also in the deactivated position.

When the downhole device 2400 is sliding or tripping into or out of the borehole, the one or more selectable hole cutters 1401 are designed to be in a deactivated position. In other words, the one or more cutter pistons 1402 are in a deactivated position with the one or more cutters 1406 also in the deactivated position.

When the drill string 120 is rotating, the one or more selectable hole cutters 1401 are designed to be in an activated position. In other words, the one or more cutter pistons 1402 are in the activated position with one or more cutters 1406 also in the activated position.

As shown in FIGS. 19A, 19C and 21A-21B, a downhole device 1900, 2100, 2400 comprises the battery 610, the controller/electronics 620, 700, and the motor pump 440. However, the downhole device 2400 does not require a motor pump 440.

As discussed above, the downhole device 1900, 2100, 2400 may activated automatically by rpm, by pressure or by other means by the controller/electronics 620, 700 in pockets 1930.

In an embodiment, the dual solenoid valve 2418 is part of the controller/electronics 620, 700 located in the pockets 1930. When the downhole device 1900, 2400 receives a signal by rpm or by other means to activate the one or more selectable hole cutters 1401, the dual solenoid valve 2418 is switched to an open position. The open dual solenoid valve 2418 allows the pressured hydraulic fluid to pass through one or more hydraulic fluid ports 2414 to activate one or more selectable hole cutters 1401.

In an embodiment, the one or more of the hydraulic fluid ports 2414 may be located at each end of the downhole tool 2400 radially inward of the one or more cutter pistons 1402.

This pressurized hydraulic fluid activates the one or more cutter pistons 1402 of the selectable hole cutters 1401, which extends the one or more cutter pistons 1402 and the one or more cutters 1406 outward radially to engage and cut a side surface of the drilled hole 130.

Until the downhole device 2400 is signaled to deactivate, the one or more selectable hole cutters 1401 will remain in the activated position. In other words, the one or more cutter pistons 1402 will remain in the activated position with one or more cutters 1406 also in the activated position. The signal to deactivate may be by stopping rpm or by manual means from an operator.

When the downhole device 2400 receives the signal to deactivate, the dual solenoid valve 2418 is switched to a closed position. The closed dual solenoid valve 2418 allows the pressurized hydraulic fluid to pass through the hydraulic fluid waste port 2414*a* into the waste volume 2422*b*. The annular compensating ring 2410*e* moves slightly upward (to the left in FIG. 24) to make room for the hydraulic fluid waste and forces pressurized drilling mud out of the downhole device 2400 through the drilling mud port 2414*b*.

As such, the one or more selectable hole cutters 1401 are deactivated, returning the one or more cutter pistons 1402 back to the deactivated position via a spring 1410.

The downhole device 2400 is ready to operate and to activate the one or more selectable hole cutters 1401 again on demand or automatically when rotation resumes.

In an embodiment, the downhole device 2400 may be activated by opening a dual solenoid valve 2418 and deactivated by closing the dual solenoid valve 2418.

In an embodiment, the selectable hole cutter 1401 has a cutter piston 1402. In an embodiment, the cutter piston 1402 has one or more cutters 1406 affixed to the cutter piston 1402. In an embodiment, a spring 1410 and a spacer 1412 are disposed between the cutter piston 1402 and the container 1408 or cutout.

When the flow of drilling mud stops (e.g., drilling rig pumps are shut-off), the one or more selectable hole cutters 1401 will be in a deactivated position. The pressure differential across the volume/waste ring is negligible. The hydraulic fluid return spring 2420*c* decompresses and moves the volume/waste ring upward (to left in FIG. 24).

As a result, hydraulic fluid waste in the waste volume 2422*b* is forced through the one-way valve 2419 in the volume/waste ring 2410*f* into the pressurized volume 2422*c*. This recharges the pressurized volume 2422*c* so that it does not run out of hydraulic fluid as the downhole device cycles.

The downhole device 2400 is ready to operate and to activate the one or more selectable hole cutters 1401 again on demand or automatically when rotation resumes.

In an embodiment, the downhole device 2400 may be activated by opening a dual solenoid valve 2418 and deactivated by closing the dual solenoid valve 2418.

In an embodiment, the hydraulic fluid system 2200 may further comprise a fail-safe solenoid valve 2260. In an embodiment, the fail-safe solenoid valve 2260 may be in a normally open position.

In an event of a power failure, a hydraulic fluid leak, a temperate spike or other adverse situation, the fail-safe solenoid valve 2260 automatically switches to the normally open position to vent pressurized hydraulic fluid out of the downhole device 2400 to deactivate the one or more selectable hole cutters 1401. In other words, the one or more springs 1410 return the one or more cutter pistons 1402 to a deactivated position with one or more cutters 1406 also in the deactivated position. The downhole device 2400 may be retrieved from the borehole without any interference from the one or more selectable hole cutters 1401.

Third Alternative Downhole Device Configured as Selectable Hole Trimmer

Figure 25A:
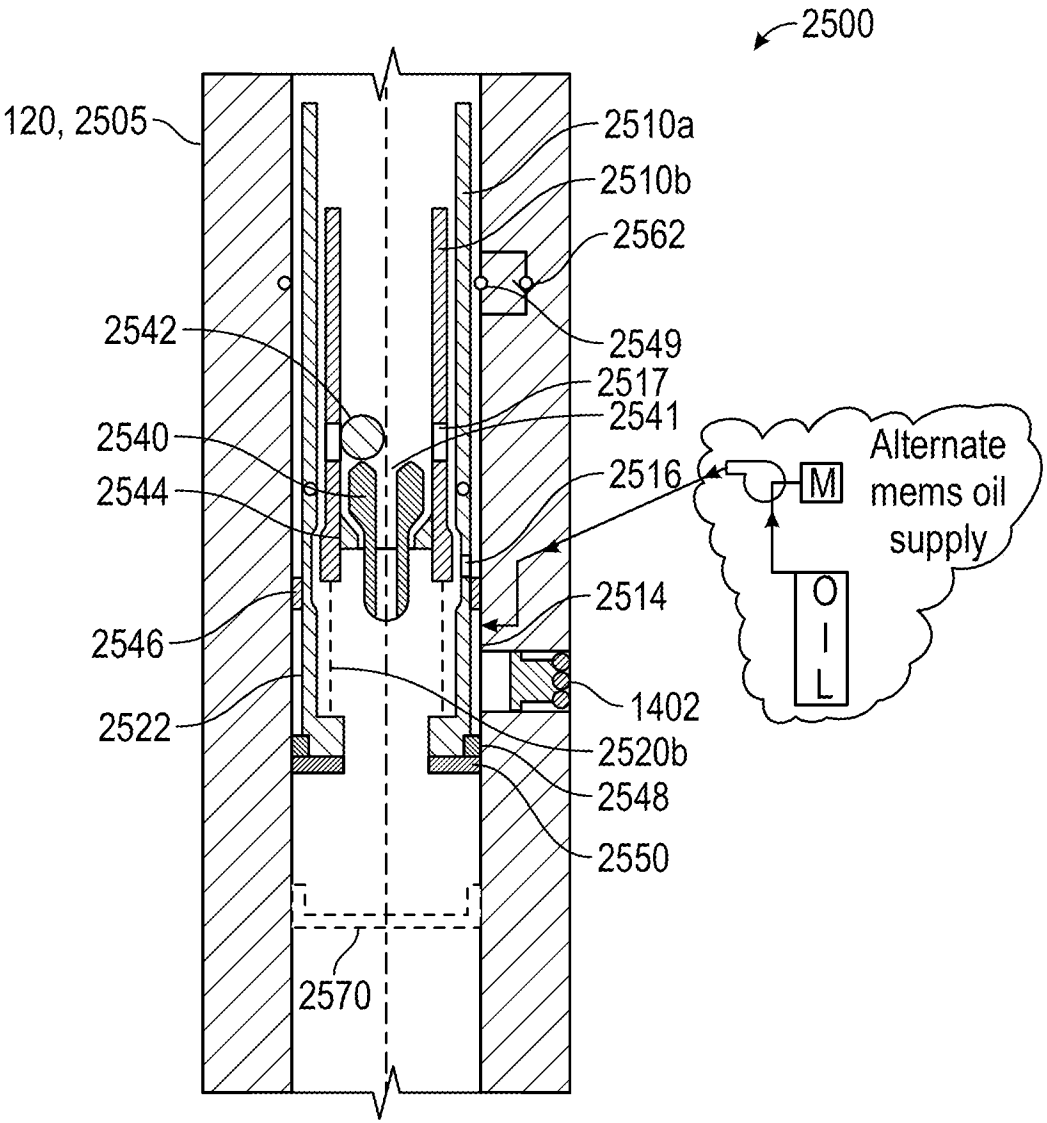
FIG. 25A shows a cross-sectional view of an exemplary embodiment of a downhole device configured as a selectable hole trimmer, showing a selectable hole cutter in a deactivated position, an intermediate sleeve, a sliding sleeve, a hydraulic fluid port, an activation dart, a seat, a hydraulic fluid port and a stop lock.
Figure 25B:
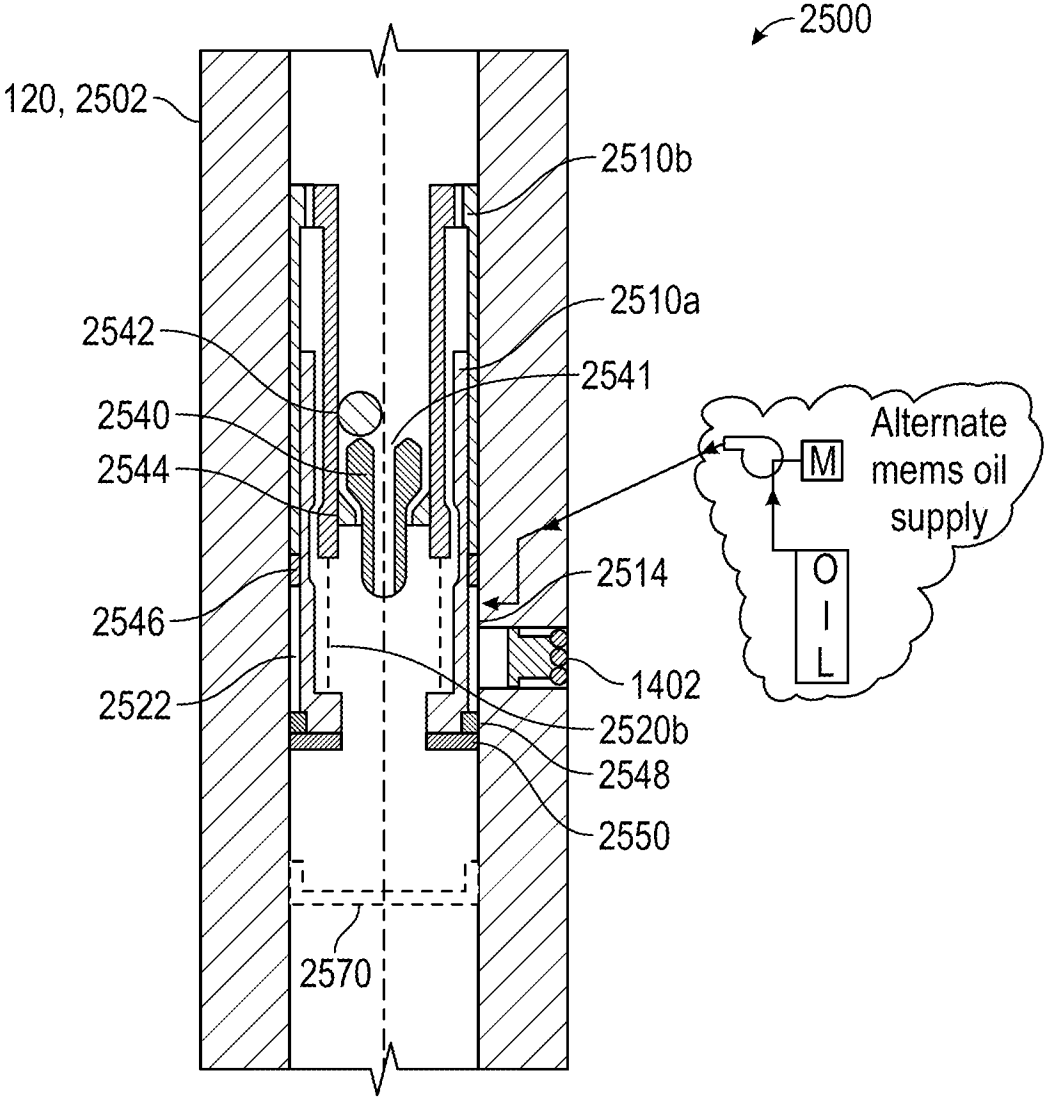
FIG. 25B shows a cross-sectional view of the selectable hole trimmer of FIG. 25B, showing an alternative sliding sleeve.

FIG. 25A shows a cross-sectional view of an exemplary embodiment of a downhole device configured as a selectable hole trimmer 2500, showing a selectable hole cutter 1401 in a deactivated position, an intermediate sleeve 2510*a*, a sliding sleeve 2510*b*, a hydraulic fluid port 2514, an activation dart 2540, a seat 2544, a hydraulic fluid port 2514 and a stop lock 2550; and FIG. 25B shows a cross-sectional view of the selectable hole trimmer 2500 of FIG. 25B, showing an alternative sliding sleeve 2510*b*. As shown in FIGS. 25A and 25B, the selectable hole trimmer 2500 comprises an intermediate sleeve 2510*a*, a sliding sleeve 2510*b*, a hydraulic fluid port 2514, a lower port 2516, an upper port 2517, a volume 2522 (between the intermediate sleeve 2510*a* and the body 2505) and one or more selectable hole cutters 1401.

In an embodiment, the one or more selectable hole cutters 1401 comprises one or more cutter pistons 1402. In an embodiment, the cutter piston 1402 has one or more cutters 1406 affixed to the cutter piston 1402. In an embodiment, the cutter piston 1402 has one or more cutters 1406 affixed to the cutter piston 1402.

In an embodiment, the one or more selectable hole cutters 1401 comprises a cutter blade 1406*a* and one or more cutter pistons 1402. In an embodiment, the cutter blade 1406*a* has one or more cutter pistons 1402 affixed to the cutter blade 1406*a*. In an embodiment, the cutter blade 1406*a* has one or more cutters 1406 affixed to the cutter blade 1406*a*.

When the downhole device 2500 is sliding or tripping into or out of a borehole, the downhole device 2500, namely the one or more selectable hole cutters 1401 are in a deactivated position. The one or more cutter pistons 1402 are in a deactivated position with the one or more cutters 1406 also the deactivated position.

The body 2505 of the selectable hole trimmer 2500 is attached to the intermediate sleeve 2510*a* via a stop lock 2550.

After the downhole device 2500 is lowered in the borehole and an activation dart 2540 is dropped to seal a seat 2544 in the sliding sleeve 2510*b*, the hydrostatic pressure of the drilling mud on the activation dart 2640 in the seat 2644 forces the sliding sleeve 2610*h* to move down and to align the lower port 2516 and the upper port 2517, which compresses a return spring 2520*b* and moves the sliding sleeve 2510*b* downward. See e.g., 25A.

In an embodiment, an upper port 2517 in the sliding sleeve 2510*b* aligns with a lower port 2516 in the intermediate sleeve 2510*a* to pressurize a top of a divider seal ring 2546 with drilling mud. See e.g., FIG. 25A.

Alternatively, the sliding sleeve 2510*b* moves downward and presses on the top of the divider seal ring 2546. See e.g., FIG. 25B.

The divider seal ring 2546 moves downward and forces pressurized hydraulic fluid to pass through one or more hydraulic fluid ports 2514 to pressurize a volume 2522 (i.e., hydraulic fluid chamber) and to activate one or more selectable hole cutters 1401. Id.

This pressurized hydraulic fluid activates the one or more cutter pistons 1402 of the selectable hole cutters 1401, which extends the one or more cutter pistons 1402 and the one or more cutters 1406 outward radially to engage and cut a side surface of the drilled hole 130.

The activation dart 2540 may be made of any suitable material to seal a seat 2544 in the sliding sleeve 2510*b*. For example, a suitable material includes, but is not limited to, a metal, a polymer, a rubber or other similar material. In an embodiment, the activation dart 2540 is made of a metal. In an embodiment, the activation dart 2540 is made of a polymer.

The deactivation ball 2542 may be any suitable size to seal a port 2541 in the activation dart 2540. For example, a suitable size includes, but is not limited to from about 1 inch to about 2.75 inch diameter and any range or value therebetween.

The seat 2544 in the sliding sleeve 2510*b* may be made of any suitable material. For example, a suitable material includes, but is not limited to, a polymer, a rubber or other similar material. In an embodiment, the seat 2544 is made of a polymer. In an embodiment, the seat 2544 is made of a polyurethane.

Until the downhole device 2500 is manually signaled to activate, the one or more selectable hole cutters 1401 will remain in the deactivated position. In other words, the one or more cutter pistons 1402 will remain in the deactivated position with the one or more cutters 1406 also in the deactivated position.

When the downhole device 2500 is sliding or tripping into or out of the borehole, the one or more selectable hole cutters 1401 are designed to be in a deactivated position. In other words, the one or more cutter pistons 1402 are in a deactivated position with the one or more cutters 1406 also in the deactivated position. The signal to activate may be by manual means from an operator.

Manual Actuation

When the downhole device 2500 is sliding or tripping into or out of a borehole, the downhole device 2500, namely the one or more selectable hole cutters 1401 are in a deactivated position. The one or more cutter pistons 1402 are in a deactivated position with the one or more cutters 1406 also the deactivated position.

The body 2505 of the selectable hole trimmer 2500 is attached to the intermediate sleeve 2510*a* via the stop lock 2550.

As the downhole device 2500 is lowered in the borehole, the hydrostatic pressure pushes a sliding sleeve 2510*b* downward, which compresses hydraulic fluid in a pressurized volume 2522 (i.e., a hydraulic fluid chamber) as the sliding sleeve 2510*b* slides over the intermediate sleeve 2510*a*.

Until the downhole device 2500 is manually signaled to activate, the one or more selectable hole cutters 1401 will remain in the deactivated position. In other words, the one or more cutter pistons 1402 will remain in the deactivated position with the one or more cutters 1406 also in the deactivated position.

When the downhole device 2500 is sliding or tripping into or out of the borehole, the one or more selectable hole cutters 1401 are designed to be in a deactivated position. In other words, the one or more cutter pistons 1402 are in a deactivated position with the one or more cutters 1406 also in the deactivated position. The signal to activate may be by manual means from an operator.

When the downhole device 2500 is manually signaled to activate, an activation dart 2540 is dropped to seal a seat 2544 in the sliding sleeve 2510*b*, to increase the pressure of the drilling mud above the sealed dart 2540 and to provide by-pass flow of the drilling mud to the drill bit 132. The pressure of the drilling mud compresses the return spring 2520*b* and moves the sliding sleeve 2510*b* downward.

In an embodiment, an upper port 2517 in the sliding sleeve 2510*b* aligns with a lower port 2516 in the intermediate sleeve 2510*a* to pressurize a top of a divider seal ring 2546 with drilling mud. See e.g., FIG. 25A.

Alternatively, the sliding sleeve 2510*b* moves downward and presses on the top of the divider sear ring 2546 with drilling mud. See e.g., FIG. 25B.

The divider seal ring 2546 moves downward and forces pressurized hydraulic fluid to pass through one or more hydraulic fluid ports 2514 to pressurize a volume 2522 (i.e., hydraulic fluid chamber) and to activate one or more selectable hole cutters 1401. Id.

In an embodiment, the one or more of the hydraulic fluid ports 2514 may be located at each end of the downhole tool 2500 radially inward of the one or more cutter pistons 1402.

This pressurized hydraulic fluid activates the one or more cutter pistons 1402 of the selectable hole cutters 1401, which extends the one or more cutter pistons 1402 and the one or more cutters 1406 outward radially to engage and cut a side surface of the drilled hole 130.

When the flow of drilling mud stops (e.g., drilling rig pumps are shut-off), the one or more selectable hole cutters 1401 will be in a deactivated position. This activation/deactivation of the one or more cutters 1406 is automatic for as long as the dart 2540 remains sealed in the seat 2544.

In an embodiment, the pressurized hydraulic fluid pushes the divider seal ring 2546 upwards and forces the drilling mud to flow through a check valve 2562, which bypasses an upper seal 2549. See e.g., FIG. 25A. The one or more cutter pistons 1402 are in a deactivated position with the one or more cutters 1406 also the deactivated position.

Alternatively, the pressurized hydraulic fluid and return spring 2520*b* forces the divider seal ring 2546 upwards. See e.g., FIG. 25B. The one or more cutter pistons 1402 are in a deactivated position with the one or more cutters 1406 also the deactivated position.

Until the downhole device 2500 is manually signaled to deactivate (or until the flow of the drilling mud stops), the one or more selectable hole cutters 1401 will remain in the activated position. In other words, the one or more cutter pistons 1402 will remain in the activated position with one or more cutters 1406 also in the activated position. The signal to deactivate may be by manual means from an operator.

When the downhole device 2500 receives the signal to deactivate, a deactivation ball 2542 is dropped to seal a port 2541 through the activation dart 2540 and to stop the bypass flow of drilling mud to the drill bit 132. The pressure difference across the activation dart 2540 forces the activation dart 2540 through the seat 2544 along with the deactivation ball 2542 into a catcher basket 2570.

As such, the one or more selectable hole cutters 1401 are deactivated, returning the one or more cutter pistons 1402 back to the deactivated position via a spring 1410 and returning the pressurized hydraulic fluid back into the pressurized volume 2522 (i.e., pressurized hydraulic fluid chamber).

The downhole device 2500 is ready to operate and to activate the one or more selectable hole cutters 1401 again when another activation dart 2540 is dropped.

In an embodiment, the downhole device 2500 may be activated by dropping an activation dart 2540 and deactivated by dropping a deactivation ball 2542.

In an embodiment, the selectable hole cutter 1401 has a cutter piston 1402. In an embodiment, the cutter piston 1402 has one or more cutters 1406 affixed to the cutter piston 1402. In an embodiment, a spring 1410 and a spacer 1412 are disposed between the cutter piston 1402 and the container 1408 or cutout.

Automatic Actuation

As shown in FIGS. 19A, 19C and 21A-21B, a downhole device 1900, 2100, 2500 comprises the battery 610, the controller/electronics 620, 700, and the motor pump 440.

As discussed above, the downhole device 1900, 2100, 2500 may activated automatically by rpm, by pressure or by other means by the controller/electronics 620, 700 in pockets 1930.

For example, downhole device 2500 may include an alternative, controller/electronic controlled hydraulic fluid supply. See e.g., FIGS. 25A-25B.

In an embodiment, the hydraulic fluid system 2200 may further comprise a fail-safe solenoid valve 2260. In an embodiment, the fail-safe solenoid valve 2260 may be in a normally open position.

In an event of a power failure, a hydraulic fluid leak, a temperate spike or other adverse situation, the fail-safe solenoid valve 2260 automatically switches to the normally open position to vent pressurized hydraulic fluid out of the downhole device 2500 to deactivate the one or more selectable hole cutters 1401. In other words, the one or more springs 1410 return the one or more cutter pistons 1402 to a deactivated position with one or more cutters 1406 also in the deactivated position. The downhole device 2500 may be retrieved from the borehole without any interference from the one or more selectable hole cutters 1401.

Fourth Alternative Downhole Device Configured as Selectable Hole Trimmer

Figure 26A:
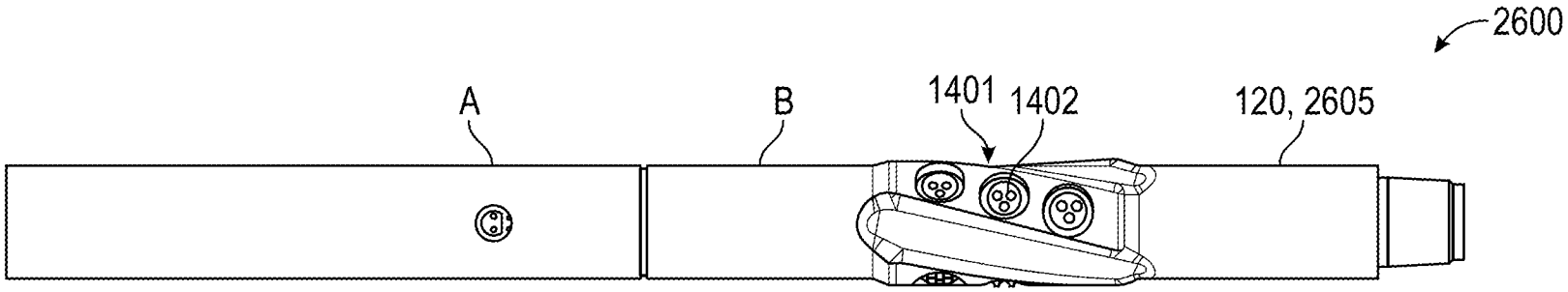
FIG. 26A shows a side view of an exemplary embodiment of a downhole device configured as a selectable hole trimmer, showing a charge subassembly A and a trimmer subassembly B having a selectable hole cutter in a deactivated position.
Figure 26B:
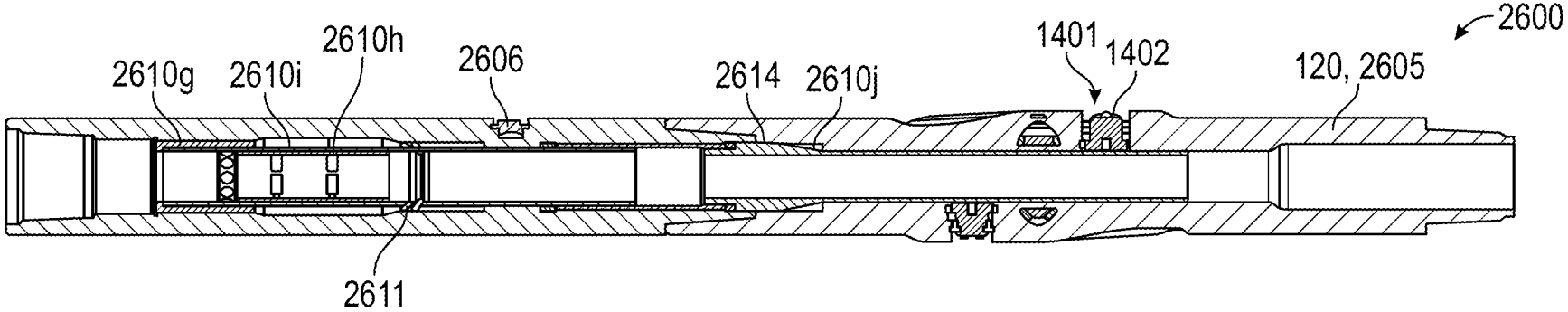
FIG. 26B shows a cross-sectional view of the selectable hole trimmer of FIG. 26A, showing the selectable hole cutter in a deactivated position.
Figure 26C:
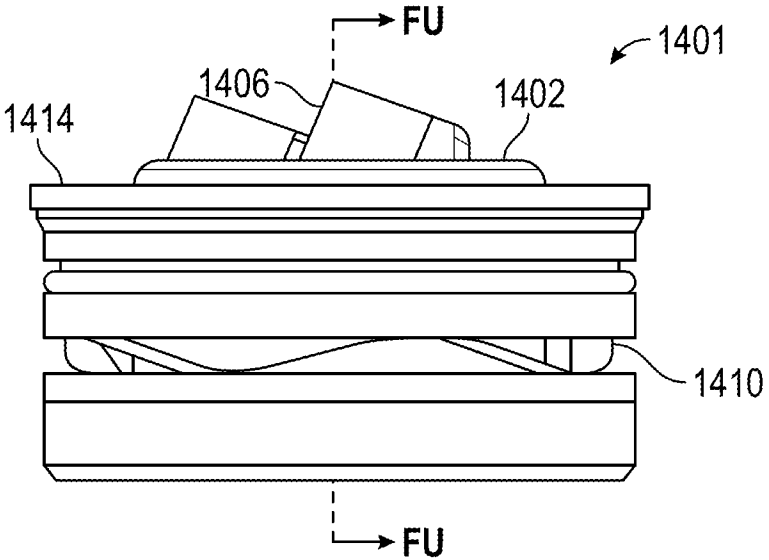
FIG. 26C shows a detailed view of the selectable hole cutter of the selectable hole trimmer of FIGS. 26A-26B, showing a cutter piston, a cutter, a spring and a retaining ring.
Figure 26D:
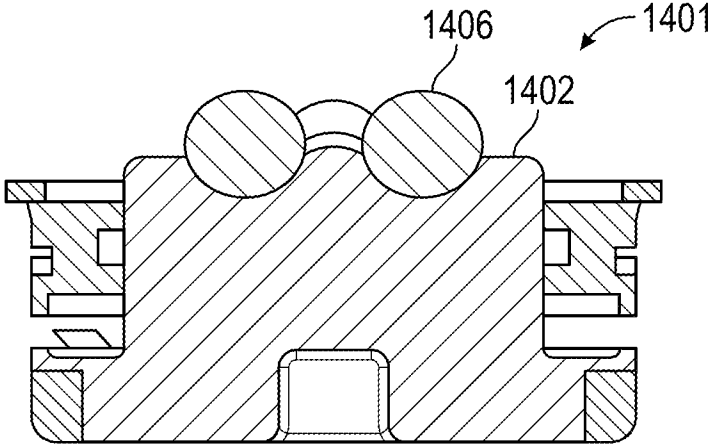
FIG. 26D shows a cross-sectional view of the selectable hole cutter of FIG. 26C, showing the cutter piston and the cutter.

FIG. 26A shows a side view of an exemplary embodiment of a downhole device configured as a selectable hole trimmer 2600, showing a charge subassembly A and a trimmer subassembly B having a selectable hole cutter 1401 in a deactivated position; FIG. 26B shows a cross-sectional view of the selectable hole trimmer of FIG. 26A, showing the selectable hole cutter 1401 in a deactivated position; FIG. 26C shows a detailed view of the selectable hole cutter 1401 of the selectable hole trimmer of FIGS. 26A-26B, showing a cutter piston 1402, a cutter 1406, a spring 1410 and a retaining ring 1414; and FIG. 26D shows a cross-sectional view of the selectable hole cutter 1401 of FIG. 26C, showing the cutter piston 1402 and the cutter 1406. As shown in FIGS. 26A and 26B, the selectable hole trimer 2600 comprises an upper sleeve 2610*g*, a charge sleeve 2610*h*, a catch sleeve 2610*i*, a transfer sleeve 2610*j*.

Figure 26E:
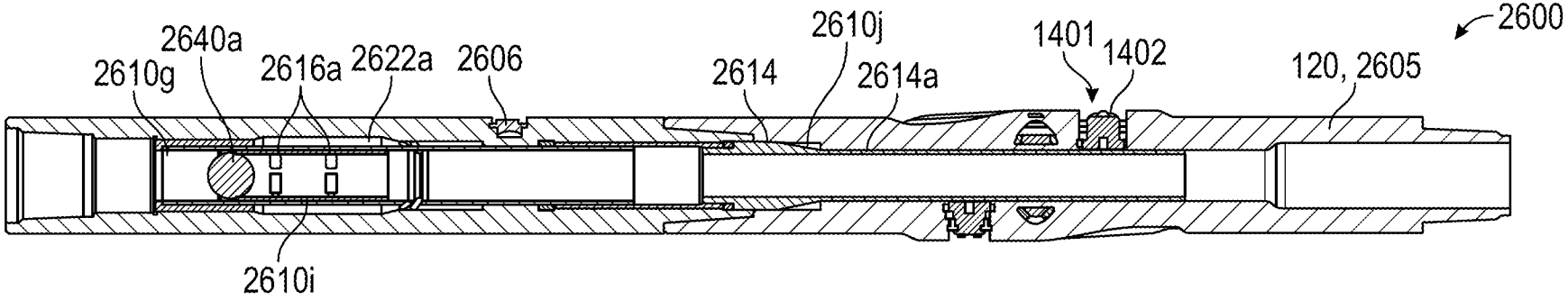
FIG. 26E shows a cross-sectional view of selectable hole trimmer of FIGS. 26A-26D, showing the selectable hole trimmer being activated with an activation ball and a catch sleeve being lowered downward to a lower position.
Figure 26F:
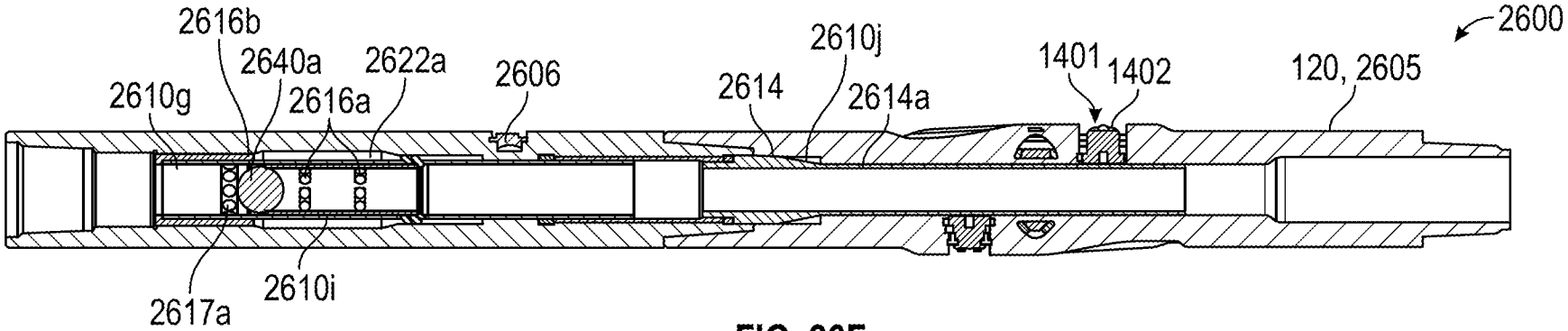
FIG. 26F shows a cross-sectional view of selectable hole trimmer of FIGS. 26A-26D, showing the selectable hole trimmer in a deactivated position with an activation ball in a seat of a catch sleeve and with a charge sleeve and the catch sleeve in an upper position.
Figure 26G:
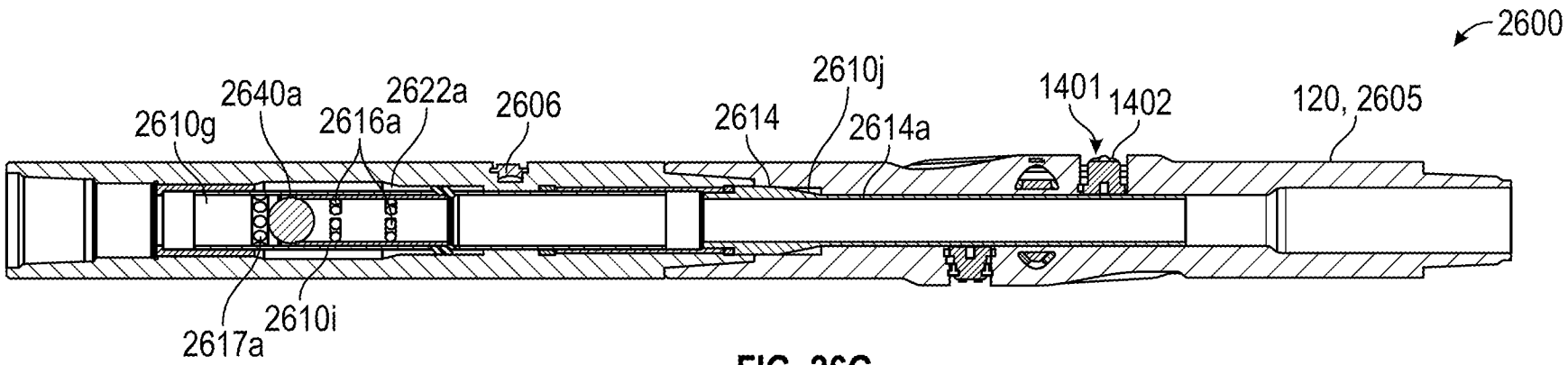
FIG. 26G shows a cross-sectional view of selectable hole trimmer of FIGS. 26A-26D, showing the selectable hole trimer in an activated position with an activation ball in a seat of a catch sleeve and with a charge sleeve and the catch sleeve in a lower position.
Figure 26H:
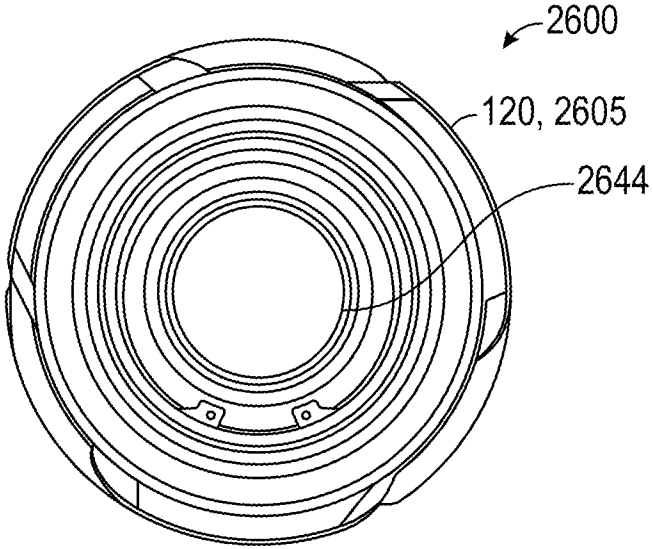
FIG. 26H shows a detailed view of an upper end of the selectable hole trimmer of FIG. 26A-26B, showing the selectable hole trimmer in a deactivated position and a seat in the catch sleeve.
Figure 26I:
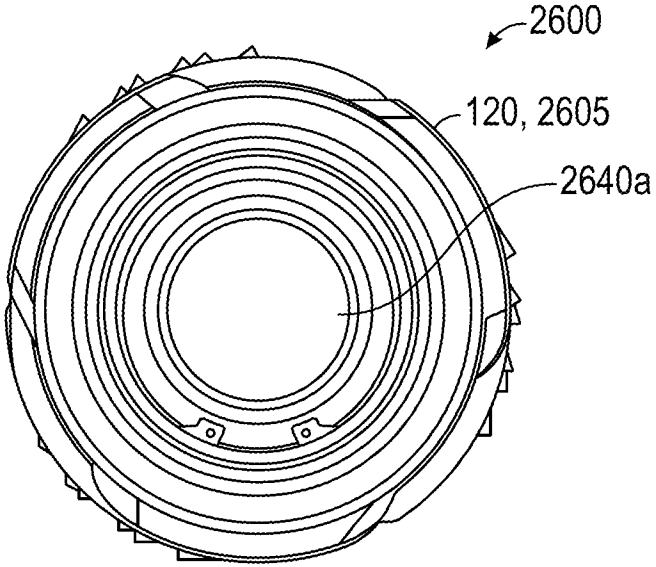
FIG. 26I shows a detailed view of the upper end of the selectable hole trimmer of FIGS. 26E-26G, showing the selectable hole trimmer in an activated position and an activation ball in a seat in the catch sleeve.

FIG. 26E shows a cross-sectional view of selectable hole trimmer of FIGS. 26A-26D, showing the selectable hole trimmer 2600 being activated with an activation ball 2640*a* and a catch sleeve 2610*i* being lowered downward to a lower position; FIG. 26F shows a cross-sectional view of selectable hole trimmer of FIGS. 26A-26D, showing the selectable hole trimmer 2600 in a deactivated position with an activation ball 2640*a* in a seat 2644 in a catch sleeve 2610*j* and with a charge sleeve 2610*h* and the catch sleeve 2610*j* in an upper position; FIG. 26G shows a cross-sectional view of selectable hole trimmer of FIGS. 26A-26D, showing the selectable hole trimer 2600 in an activated position with an activation ball 2640*a* in a seat 2644 of the catch sleeve 2510*j* and with a charge sleeve 2610*h* and the catch sleeve 2610*i* in a lower position; FIG. 26H shows a detailed view of an upper end of the selectable hole trimmer 2600 of FIG. 26A-26B, showing the selectable hole trimmer 2600 in a deactivated position and a seat 2644 in the catch sleeve 2610*j*; FIG. 26I shows a detailed view of the upper end of the selectable hole trimmer 2600 of FIGS. 26E-26G, showing the selectable hole trimmer 2600 in an activated position and an activation ball 2640*a* in a seat 2644 in the catch sleeve 2610*j*.

In an embodiment, the one or more selectable hole cutters 1401 comprises one or more cutter pistons 1402. In an embodiment, the cutter piston 1402 has one or more cutters 1406 affixed to the cutter piston 1402. In an embodiment, the cutter piston 1402 has one or more cutters 1406 affixed to the cutter piston 1402.

In an embodiment, the one or more selectable hole cutters 1401 comprises a cutter blade 1406*a* and one or more cutter pistons 1402. In an embodiment, the cutter blade 1406*a* has one or more cutter pistons 1402 affixed to the cutter blade 1406*a*. In an embodiment, the cutter blade 1406*a* has one or more cutters 1406 affixed to the cutter blade 1406*a*.

When the downhole device 2600 is sliding or tripping into or out of a borehole, the downhole device 2600, namely the one or more selectable hole cutters 1401 are in a deactivated position. The one or more cutter pistons 1402 are in a deactivated position with the one or more cutters 1406 also the deactivated position.

The body 2605 of the selectable hole trimmer 2600 may be attached to the upper sleeve 2610*g* via a connection. In an embodiment, the body 2605 of the selectable hole trimmer 2600 may be attached to the upper sleeve 2610*g* via a threaded connection (e.g., threaded nut).

In an embodiment, the upper sleeve is held in place with a snap ring (not shown) at an upper end. In an embodiment, the snap ring (not shown) may act as a stop.

In an embodiment, the upper sleeve 2610*g* is held in place with a stop (not shown) at a lower end and a snap ring (not shown) at an upper end.

The upper sleeve 2610*g* provides a radial spacer such that the cross-sectional area of the charge sleeve 2610*h* is the same at a lower end and an upper end so that the charge sleeve 2610*h* is not moved downward or upward due to hydrostatic pressure.

The upper sleeve 2610*g* acts as an upper stop for the charge sleeve 2610*h*.

After the downhole device 2600 is lowered in the borehole and the activation ball 2640 is dropped to seal a seat 2644 in the catch sleeve 2610*i*, the hydrostatic pressure of the drilling mud on the activation ball 2640 in the seat 2644 disengages a detent ring 2611 (between the charge sleeve 2610*h* and the catch sleeve 2610*i*) and allows the catch sleeve 2610*i* to move slightly downward to a lower position (to the right in FIG. 26E) within the charge sleeve 2610*h*.

The activation ball 2640*a* may be made of any suitable material to seal a seat 2644 in the catch sleeve 2610*i*. For example, a suitable material includes, but is not limited to, a metal, a polymer, rubber or other similar material. In an embodiment, the activation ball 2640*a* is made of metal. In an embodiment, the activation ball 2640*a* is made of a polymer. In an embodiment, the activation ball 2640*a* is made of a rubber.

The activation ball 2640*a* may be any suitable size to seal the seat 2644 in the catch sleeve 2610*i*. For example, a suitable size includes, but is not limited to from about 2.25 inch to about 2.75 inch diameter and any range or value therebetween. In an embodiment, the activation ball 2640*a* is about 2.375 inches in diameter. In an embodiment, the activation ball 2640*a* is about 2.5-inches in diameter.

The detent ring 2611 may be made from any suitable material. For example, a suitable material includes, but is not limited to a metal, a polymer, a rubber or other similar material. In an embodiment, the detent ring 2611 is made from a polymer. In an embodiment, the detent ring 2611 is made from a rubber. In an embodiment, the detent ring 2611 is made from a metal. In an embodiment, the detent ring 2611 may be a metal C-ring.

In an embodiment, the detent ring 2611 is disposed between the charge sleeve 2610*h* and the catch sleeve 2610*i*. In an embodiment, the detent ring 2611 holds the catch sleeve 2610*i* in relative position to the charge sleeve 2610*h*.

The drilling mud flows from the charge sleeve 2610*h* through a bypass port 2617*a* into a drilling mud volume 2622*a* in the body 2605. Then, the drilling mud flows from the drilling mud volume 2622*a* through a return port 2616*a* in the charge sleeve 2610*h* and in the catch sleeve 2610*i* back into the interior of the charge sleeve 2610*h* to provide a bypass flow of drilling mud to the drill bit 132.

The charge sleeve 2610*h* moves downward to a lower position (to the right in FIG. 26G) and forces pressurized hydraulic fluid through the hydraulic fluid ports 2614 in the transfer sleeve 2610*j* and through the hydraulic ports 2414*a* along an outer diameter of the transfer sleeve 2610*j* to activate one or more selectable hole cutters 1401.

This pressurized hydraulic fluid activates the one or more cutter pistons 1402 of the selectable hole cutters 1401, which extends the one or more cutter pistons 1402 and the one or more cutters 1406 outward radially to engage and cut a side surface of the drilled hole 130.

In an embodiment, the charge sleeve 2610*h* has an internal stop (not shown) to prevent the catch sleeve 2610*i* from moving further downward. In an embodiment, the charge sleeve 2610*h* has the internal stop (not shown) at about an axial mid-position to prevent the catch sleeve 2610*i* from moving further down ward.

Until the downhole device 2600 is manually signaled to activate, the one or more selectable hole cutters 1401 will remain in the deactivated position. In other words, the one or more cutter pistons 1402 will remain in the deactivated position with the one or more cutters 1406 also in the deactivated position.

When the downhole device 2600 is sliding or tripping into or out of a borehole, the downhole device 2600, namely the one or more selectable hole cutters 1401 are in a deactivated position. The one or more cutter pistons 1402 are in a deactivated position with the one or more cutters 1406 also the deactivated position.

Until the downhole device 2600 is manually signaled to activate, the one or more selectable hole cutters 1401 will remain in the deactivated position. In other words, the one or more cutter pistons 1402 will remain in the deactivated position with the one or more cutters 1406 also in the deactivated position.

When the downhole device 2600 is sliding or tripping into or out of the borehole, the one or more selectable hole cutters 1401 are designed to be in a deactivated position. In other words, the one or more cutter pistons 1402 are in a deactivated position with the one or more cutters 1406 also in the deactivated position. The signal to activate may be by manual means from an operator.

Manual Actuation

When the downhole device 2600 is manually signaled to activate, the activation ball 2640 is dropped to seal the seat 2644 on the catch sleeve 2610*i*, to increase the hydrostatic pressure of the drilling mud above the sealed ball 2640. The hydrostatic pressure of the drilling mud on the activation ball 2640 in the seat 2644 disengages the detent ring 2611 (between the charge sleeve 2610*h* and the catch sleeve 2610*i*) and allows the catch sleeve 2610*i* to move slightly downward to the lower position (to the right in FIG. 26E) within the charge sleeve 2610*h*.

The drilling mud flows from the charge sleeve 2610*h* through the bypass port 2617*a* into a drilling mud volume 2622*a* in the body 2605. Then, the drilling mud flows from the drilling mud volume 2622*a* through the return port 2616*a* in the charge sleeve 2610*h* and in the catch sleeve 2610*i* back into the interior of the charge sleeve 2610*h* to provide the bypass flow of drilling mud to the drill bit 132.

The charge sleeve 2610*h* moves downward to the lower position and forces pressurized hydraulic fluid through the hydraulic fluid ports 2614 in the transfer sleeve 2610*j* and through the hydraulic ports 2414*a* along an outer diameter of the transfer sleeve 2610*j* to activate one or more selectable hole cutters 1401.

This pressurized hydraulic fluid activates the one or more cutter pistons 1402 of the selectable hole cutters 1401, which extends the one or more cutter pistons 1402 and the one or more cutters 1406 outward radially to engage and cut a side surface of the drilled hole 130.

Until the flow of the drilling mud stops), the one or more selectable hole cutters 1401 will remain in the activated position. In other words, the one or more cutter pistons 1402 will remain in the activated position with one or more cutters 1406 also in the activated position.

When the flow of drilling mud stops (e.g., drilling rig pumps are shut-off), the one or more selectable hole cutters 1401 will be in a deactivated position. As such, the one or more selectable hole cutters 1401 are deactivated via the spring 1410, returning the one or more cutter pistons 1402 back to the deactivated position via a spring 1410 and returning the charge sleeve 2610*h* and catch sleeve 2610*i* upward to their upper positions due to increased hydraulic fluid pressure. See e.g., FIG. 26F.

The downhole device 2600 is ready to operate and to activate the one or more selectable hole cutters 1401 again when the flow of drilling mud continues.

When the flow of drilling mud continues (e.g., drilling rig pumps are turned on), the charge sleeve 2610*h* and the catch sleeve 2610*i* will move downward again to the lower position (to the right in FIG. 26G), as discussed above.

When the flow of drilling mud stops (e.g., drilling rig pumps are shut-off), the one or more selectable hole cutters 1401 will be in a deactivated position. As such, the one or more selectable hole cutters 1401 are deactivated via the spring 1410, returning the one or more cutter pistons 1402 back to the deactivated position via a spring 1410 and returning the charge sleeve 2610*h* upward to the upper position (to the left in FIG. 26F) due to increased hydraulic fluid pressure. See e.g., FIG. 26F.

The downhole device 2600 is ready to slide or trip out of the borehole.

When the downhole device 2600 is sliding or tripping out of the borehole, the drilling mud above the actuation ball in the charge sleeve drains through a port 2616*b* into the drilling mud volume 2622*a*. Then, the drilling mud drains from the drilling mud volume 2622*a* through the return port 2616*a* back into the interior of the charge sleeve 2610*h* and out of the selectable hole trimmer 2600.

In an embodiment, the selectable hole cutter 1401 has a cutter piston 1402. In an embodiment, the cutter piston 1402 has one or more cutters 1406 affixed to the cutter piston 1402. In an embodiment, a spring 1410 and a spacer 1412 are disposed between the cutter piston 1402 and the container 1408 or cutout.

Figure 27A:
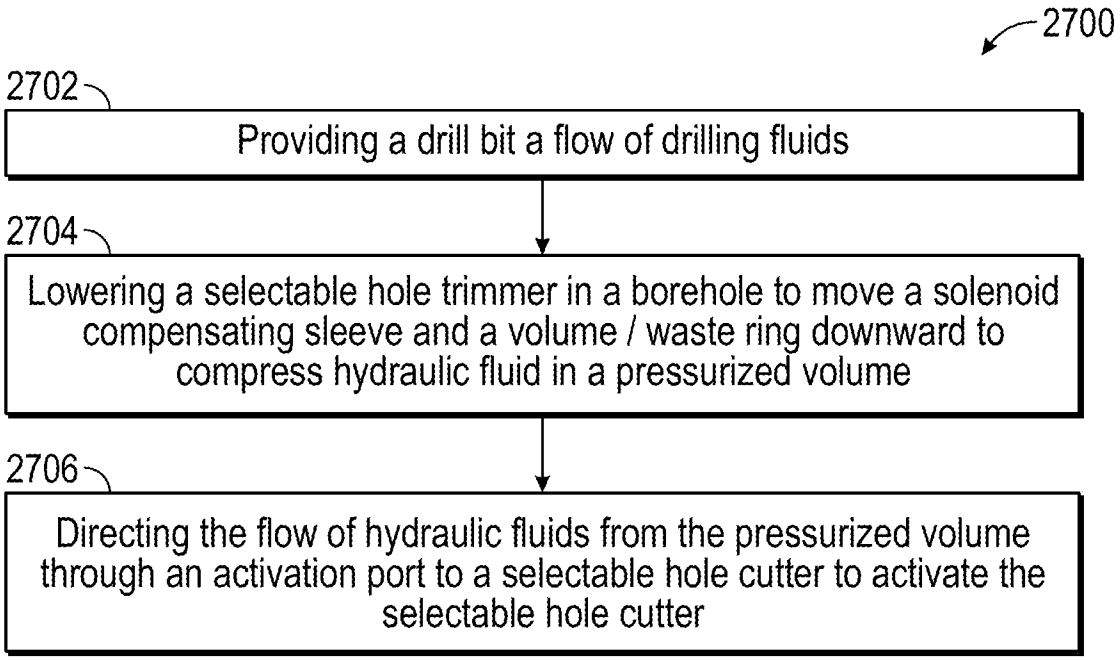
FIG. 27A is a shows a flow diagram of a method of using the selectable hole trimmer of FIG. 25.
Figure 27B:
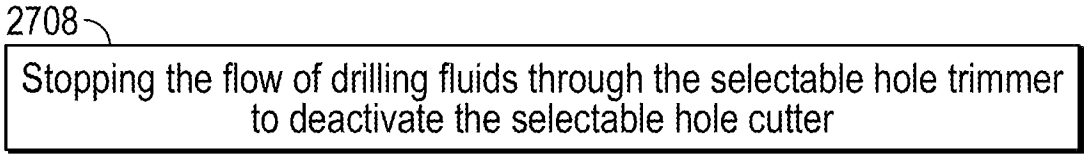
FIG. 27B shows a flow diagram of additional steps for the method of FIG. 27A.
Figure 27C:
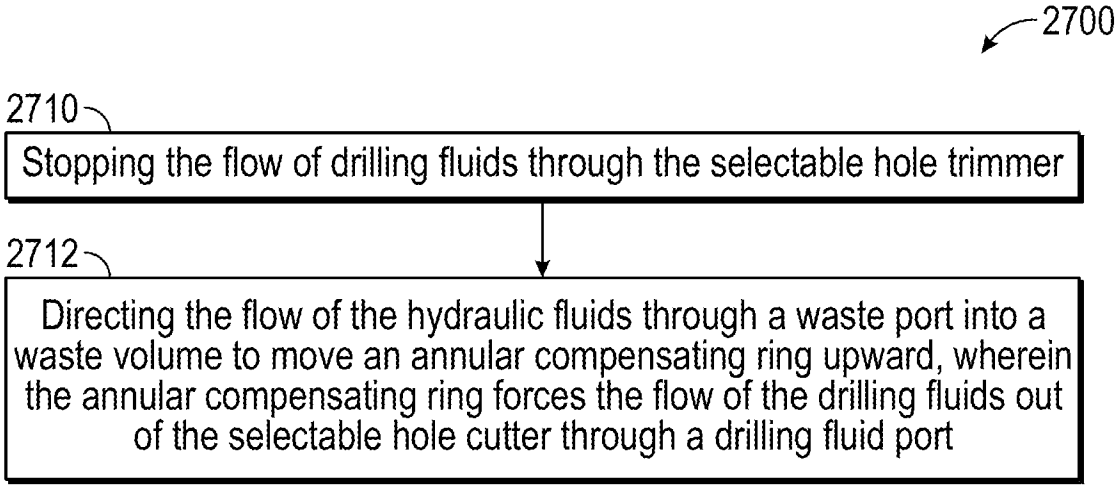
FIG. 27C shows a flow diagram of additional steps for the method of FIG. 27A.
Figure 27D:
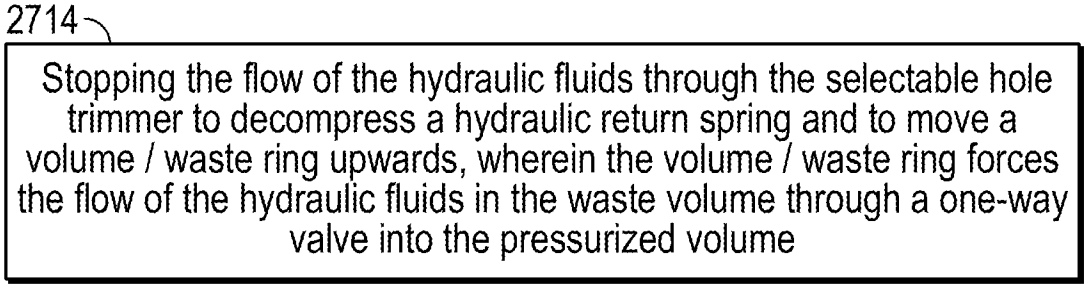
FIG. 27D shows a flow diagram of additional steps for the method of FIG. 27A.

Method of Using Second Alternative Downhole Device Configured as Selectable Hole Trimmer FIG. 27A shows a flow diagram of a method of using the selectable hole trimmer 2700 of FIG. 24; and FIGS. 27B-27D show flow diagrams of additional steps for the method 2700 of FIG. 27A. As shown in FIG. 27A, the method of using the selectable hole trimmer 2700 may include: providing a drill bit a flow of drilling fluids 2702; lowering a selectable hole trimmer in a borehole to move a solenoid compensating sleeve and a volume/waste ring downward to compress hydraulic fluid in a pressurized volume 2704; and directing the flow of hydraulic fluids from the pressurized volume through an activation port to a selectable hole cutter to activate the selectable hole cutter 2706.

As shown in FIG. 27B, the method 2700 may further include stopping the flow of drilling fluids through the selectable hole trimmer to deactivate the selectable hole cutter 2708.

As shown in FIG. 27C, the method 2700 may further include stopping the flow of drilling fluids through the selectable hole trimmer 2710 and directing the flow of the hydraulic fluids through a waste port into a waste volume to move an annular compensating ring upward, wherein the annular compensating ring forces the flow of the drilling fluids out of the selectable hole cutter through a drilling fluid port 2712.

As shown in FIG. 27D, the method 2700 may further include stopping the flow of the hydraulic fluids through the selectable hole trimmer to decompress a hydraulic return spring and to move a volume/waste ring upwards, wherein the volume/waste ring forces the flow of the hydraulic fluids in the waste volume through a one-way valve into the pressurized volume 2714.

Figure 28A:
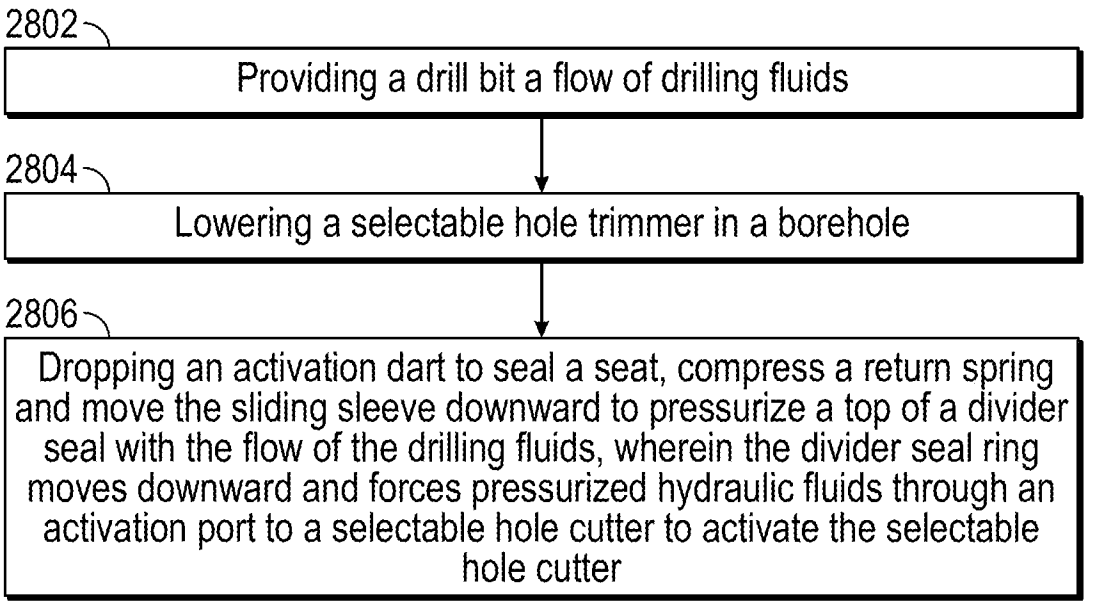
FIG. 28A shows a flow diagram of a method of using the selectable hole trimmer of FIGS. 25A and 25B.
Figure 28B:
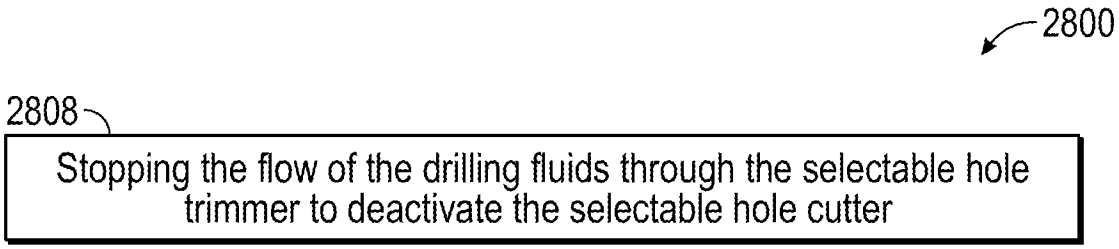
FIG. 28B shows a flow diagram of additional steps for the method of FIG. 28A.
Figure 28C:
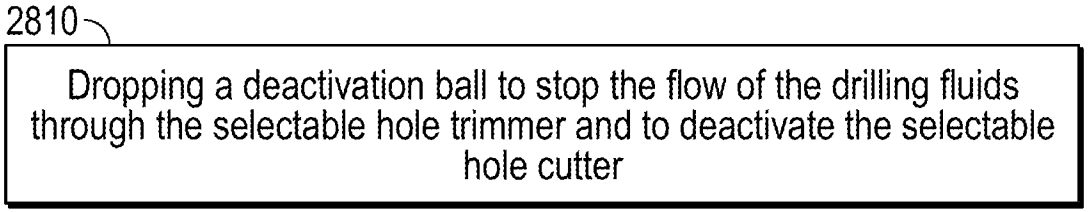
FIG. 28C shows a flow diagram of additional steps for the method of FIG. 28A.

Method of Using Third Alternative Downhole Device Configured as Selectable Hole Trimmer FIG. 28A shows a flow diagram of a method of using the selectable hole trimmer 2800 of FIGS. 25A-25B; and FIGS. 28B-28C show flow diagrams of additional steps for the method 2800 of FIG. 28A. As shown in FIG. 28A, the method of using the selectable hole trimer 2800 may include providing a drill bit a flow of drilling fluids 2802; lowering a selectable hole trimmer in a borehole 2804; and dropping an activation dart to seal a seat, compress a return spring and move the sliding sleeve downward to pressurize a top of a divider seal with the flow of the drilling fluids, wherein the divider seal ring moves downward and forces pressurized hydraulic fluids through an activation port to a selectable hole cutter to activate the selectable hole cutter 2806.

As show in FIG. 28B, the method 2800 may further include stopping the flow of the drilling fluids through the selectable hole trimmer to deactivate the selectable hole cutter 2808.

As shown in FIG. 28C, the method 2800 may further include dropping a deactivation ball to stop the flow of the drilling fluids through the selectable hole trimmer and to deactivate the selectable hole cutter 2810.

Method of Using Fourth Alternative Downhole Device Configured as Selectable Hole Trimmer FIG. 29A shows a flow diagram of a method 2900 of using the selectable hole trimmer 2600 of FIGS. 26A-26I; and FIGS. 29B-29C show flow diagrams of additional steps for the method 2900 of FIG. 29A. As shown in FIG. 29A, the method of using the selectable hole trimer may include: providing a drill bit a flow of drilling fluids 2902; lowering a selectable hole trimmer in a borehole 2904; dropping an activation ball to seal a seat, disengage a detent ring between a charge sleeve and a catch sleeve and allow the charge sleeve to move downward to a lower position within the charge sleeve 2906; and directing the flow of the drilling fluids from the charge sleeve through a bypass port into a drilling fluid volume and from the drilling fluid volume through a return port back into an interior of the charge sleeve to move the charge sleeve downward, wherein the charge sleeve forces hydraulic fluid through an activation port to a selectable hole cutter to activate a selectable hole cutter 2908.

As shown in FIG. 29B, stopping the flow of the drilling fluids through the selectable hole trimmer to deactivate the selectable hole cutter 2910.

As shown in FIG. 29C, stopping the flow of the drilling fluids through the selectable hole trimmer 2912; raising the selectable hole trimer in the borehole 2914; and draining drilling fluids from above the actuation ball in the charge sleeve through a port into the drilling mud volume and from the drilling mud volume through the return port back into the interior of the charge sleeve and out of the selectable hole trimmer 2916.

In the foregoing description of certain embodiments, specific terminology has been resorted to for the sake of clarity. However, the disclosure is not intended to be limited to the specific terms so selected, and it is to be understood that each specific term includes other technical equivalents, which operate in a similar manner to accomplish a similar technical purpose. Terms (e.g., "outer" and "inner," "upper" and "lower," "first" and "second," "internal" and "external," "above" and "below" and the like) are used as words of convenience to provide reference points and, as such, are not to be construed as limiting terms.

The embodiments set forth herein are presented to explain the present invention and its practical application and to thereby enable those skilled in the art to make and utilize the invention. However, those skilled in the art will recognize that the foregoing description has been presented for the purpose of illustration and example only. The description as set forth is not intended to be exhaustive or to limit the invention to the precise form disclosed. Many modifications and variations are possible in light of the above teaching without departing from the spirit and scope of the following claims.

Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

Definitions

As used herein, the terms "a," "an," "the," and "said" mean one or more, unless the context dictates otherwise.

As used herein, the term "about" means the stated value plus or minus a margin of error plus or minus 10% if no method of measurement is indicated.

As used herein, the term "or" means "and/or" unless explicitly indicated to refer to alternatives only or if the alternatives are mutually exclusive.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "containing," "contains," and "contain" have the same open-ended meaning as "comprising," "comprises," and "comprise," provided above.

As used herein, the terms "having," "has," and "have" have the same open-ended meaning as "comprising," "comprises," and "comprise," provided above.

As used herein, the terms "including," "includes," and "include" have the same open-ended meaning as "comprising," "comprises," and "comprise," provided above.

As used herein, the phrase "consisting of" is a closed transition term used to transition from a subject recited before the term to one or more material elements recited after the term, where the material element or elements listed after the transition term are the only material elements that make up the subject.

As used herein, the term "simultaneously" means occurring at the same time or about the same time, including concurrently.

Incorporation by Reference. All patents and patent applications, articles, reports, and other documents cited herein are fully incorporated by reference to the extent they are not inconsistent with this invention.

What is claimed is:

1. A device for a selectable hole trimmer, the device comprising:

a body having a central mud feed line configured to receive a drilling fluid at a bore pressure;

an intermediate sleeve sealingly affixed inside the body via a stop block, the intermediate sleeve having a first activation port in fluid communication with a cutter piston of a selectable hole cutter;

a sliding sleeve sealingly slidable inside the intermediate sleeve to form a pressurized volume there between, the sliding sleeve having a second activation port configured to selectively align with the first activation port;

a radial compartment disposed in the body and fluidly connected to the central mud feed line via a drill string inlet, the radial compartment configured to house an actuator;

the actuator fluidly connected to the pressurized volume via a port, wherein the actuator is configured to selectively align the first activation port and the second activation port to provide a pressure to the selectable hole cutter and actuate a cutter piston of the selectable hole cutter to move relative to the body, wherein the cutter piston comprises one or more cutters; and a controller configured to operate the actuator in response to a change of a monitored operation condition.

2. The device of claim 1, wherein the cutter piston comprises a cutter blade, wherein the cutter blade comprises the one or more cutters.

3. The device of claim 1, wherein the selectable hole cutter comprises one or more cutter pistons, wherein the one or more cutter pistons comprise a cutter blade and wherein the cutter blade comprises the one or more cutters.

4. The device of claim 1, wherein the sliding sleeve is biased against a return spring at a first end and against a compensating spring at a second end.

5. The device of claim 1, wherein the radial compartment houses at least one of a pump, a battery, or the controller.

6. The device of claim 1, wherein the actuator includes a two-way control valve.

7. The device of claim 1, wherein the actuator includes an oil accumulator, a pressure compensator, or both.

8. The device of claim 1, wherein the controller is configured to operate the actuator in response to an internal drill string pressure variation measured in a pressure transducer, wherein the internal drill string pressure variation satisfies a trigger condition.

9. A device for a selectable hole trimmer, the device comprising:

a body having a central mud feed line configured to receive a drilling fluid at a bore pressure;

an intermediate sleeve sealingly affixed inside the body via a stop block;

a sliding sleeve sealingly slidable inside the intermediate sleeve to form a pressurized volume;

a radial compartment disposed in the body upbore or downbore of a cutter piston of a selectable hole cutter, the radial compartment fluidly connected to the central mud feed line via a compensating port and configured to house an actuator;

the actuator fluidly connected to the pressurized volume via a hydraulic port, wherein the actuator is configured to provide a pressure to the selectable hole cutter of the body via the hydraulic port and actuate a cutter piston of the selectable hole cutter to move relative to the body, wherein the cutter piston comprises one or more cutters; and a controller configured to operate the actuator in response to a change of a monitored operation condition.

10. The device of claim 9, wherein the cutter piston comprises a cutter blade, wherein the cutter blade comprises the one or more cutters.

11. The device of claim 9, wherein the selectable hole cutter comprises one or more cutter pistons, wherein the one or more cutter pistons comprise a cutter blade and wherein the cutter blade comprises the one or more cutters.

12. The device of claim 9, wherein the radial compartment houses at least one of a pump, a battery, or the controller.

13. The device of claim 9, wherein the actuator includes a two-way control valve.

14. The device of claim 9, wherein the actuator includes an oil accumulator, a pressure compensator, or both.

15. The device of claim 9, wherein the controller is configured to operate the actuator in response to an internal drill string pressure variation measured in a pressure transducer, wherein the internal drill string pressure variation satisfies a trigger condition.

16. A method of using a downhole device as a selectable hole trimmer comprising:

providing a drill bit a flow of drilling fluids in the drill string, wherein the flow of drilling fluids returns in an annulus;

determining whether a trigger condition has been satisfied;

upon determining the trigger condition has been satisfied, opening a valve in a control system to pressurize a volume;

at least partially pressurizing an activation port to a selectable hole cutter of a body; and directing a portion of the flow of drilling fluids through the activation port to the selectable hole cutter to activate the cutter piston;

wherein determining the trigger condition being satisfied comprises comparing a pressure of the drilling fluids inside the drill string and a pressure of the drilling fluids in the annulus outside the drill string to ascertain a pressure difference; and wherein comparing the pressure of the drill fluids inside the drill string and the pressure of the drilling fluids in the annulus outside the drill string comprises receiving the drilling fluids inside the drill string in an accumulator or pressure compensator and receiving the drilling fluids in the annulus in another accumulator or pressure compensator.

17. The method of claim 16, wherein determining the trigger condition being satisfied comprises measuring a value related to a rotation speed of the downhole drill bit or a pressure of the drilling fluids and comparing the measured value to a reference value.

18. The method of claim 16, wherein determining the satisfaction of the trigger condition comprises receiving a control signal from a controller, wherein the control signal is provided in response to a rotation protocol.

19. The method of claim 16 further comprising:

operating a pump in the control system to return the drilling fluids to the volume and to deactivate the cutter piston upon determining the trigger condition has not been satisfied; and closing the valve in the control system.

20. The method of claim 16 further comprising:

in an event of a power failure, a hydraulic fluid leak or a temperature spike, opening a fail-safe valve to vent drilling fluids out of the downhole device and to deactivate the cutter piston.

21. The method of claim 19 further comprising:

in an event of a power failure, a hydraulic fluid leak or a temperature spike, opening a fail-safe valve to vent drilling fluids out of the downhole device and to deactivate the cutter piston.

* * * * *